United States Patent [19]

Tibbals, Jr.

[11] Patent Number: 4,796,444

[45] Date of Patent: Jan. 10, 1989

[54] CIRCULAR WEFT KNITTING MACHINE

[76] Inventor: E. C. Tibbals, Jr., Rte. 2, Box 386, High Point, N.C. 27260

[21] Appl. No.: 901,313

[22] Filed: Aug. 28, 1986

Related U.S. Application Data

[62] Division of Ser. No. 398,303, Jul. 14, 1982, Pat. No. 4,608,839.

[51] Int. Cl.[4] ..... D04B 15/78; D04B 15/06; D04B 35/00

[52] U.S. Cl. ..... 66/13; 66/90; 66/91; 66/104; 66/220

[58] Field of Search ..... 66/8, 13, 40, 90, 91, 66/104, 220

[56] References Cited

U.S. PATENT DOCUMENTS

| | | | |
|---|---|---|---|
| 459,827 | 9/1891 | Gulick et al. | 66/8 X |
| 1,882,430 | 10/1932 | Lawson | 66/8 |
| 3,426,550 | 2/1969 | Schmidt | 66/13 |
| 3,934,431 | 1/1976 | Westmoreland, Sr. | 66/90 X |
| 3,964,275 | 6/1976 | Busi et al. | 66/91 |

FOREIGN PATENT DOCUMENTS

| | | | |
|---|---|---|---|
| 609160 | 9/1960 | Italy | 66/8 |
| 712201 | 8/1966 | Italy | 66/8 |
| 9700 | of 1908 | United Kingdom | 66/91 |

*Primary Examiner*—Wm. Carter Reynolds

[57] ABSTRACT

Methods for circular weft knitting of variegated articles and selectively programmable circular weft knitting machine apparatus for carrying out such methods including means for effecting selective, controlled two dimensional displacement of compound needle member components and associated sinker elements so as to provide each such needle member with the selectable capability of performing a knit, tuck or float operation at each yarn feed location independent of the direction of knitting needle approach thereto. Also included therein are constructions for compound needle elements, sinker elements and terry instruments, as well as the provision of unbroken continuous cam tracks for effecting such controlled two dimensional displacement of yarn engaging knitting elements in a path that is symmetric about each adjacent pair of yarn feed locations and also is symmetric with respect to the midlocation halfway therebetween; an yarn feed system capable of presenting a plurality of yarns for selected utilization at each one of a plurality of yarn feed locations and means for monitoring yarn consumption and effecting adjustments in actual stitch length in response thereto. All of the foregoing are incorporated in an overall processor controlled knitting system that provides for central computerized control and performance monitoring of a plurality of remote knitting machines in association with individual control means associated with each knitting machine, each of the latter being of a construction that accommodates operations in accord with preprogrammed instruction and continuous monitoring of individual knitting machine performance in comparison therewith.

15 Claims, 31 Drawing Sheets

652
TERRY
$Z_0$
CLOSING ELEMENT
TUCK (INSIDE CAM)
646
644
646
644
g
l
h
i
j
k
OUTSIDE
CAM
KNIT
OR
FLOAT
650
RAKE
$Z_0$

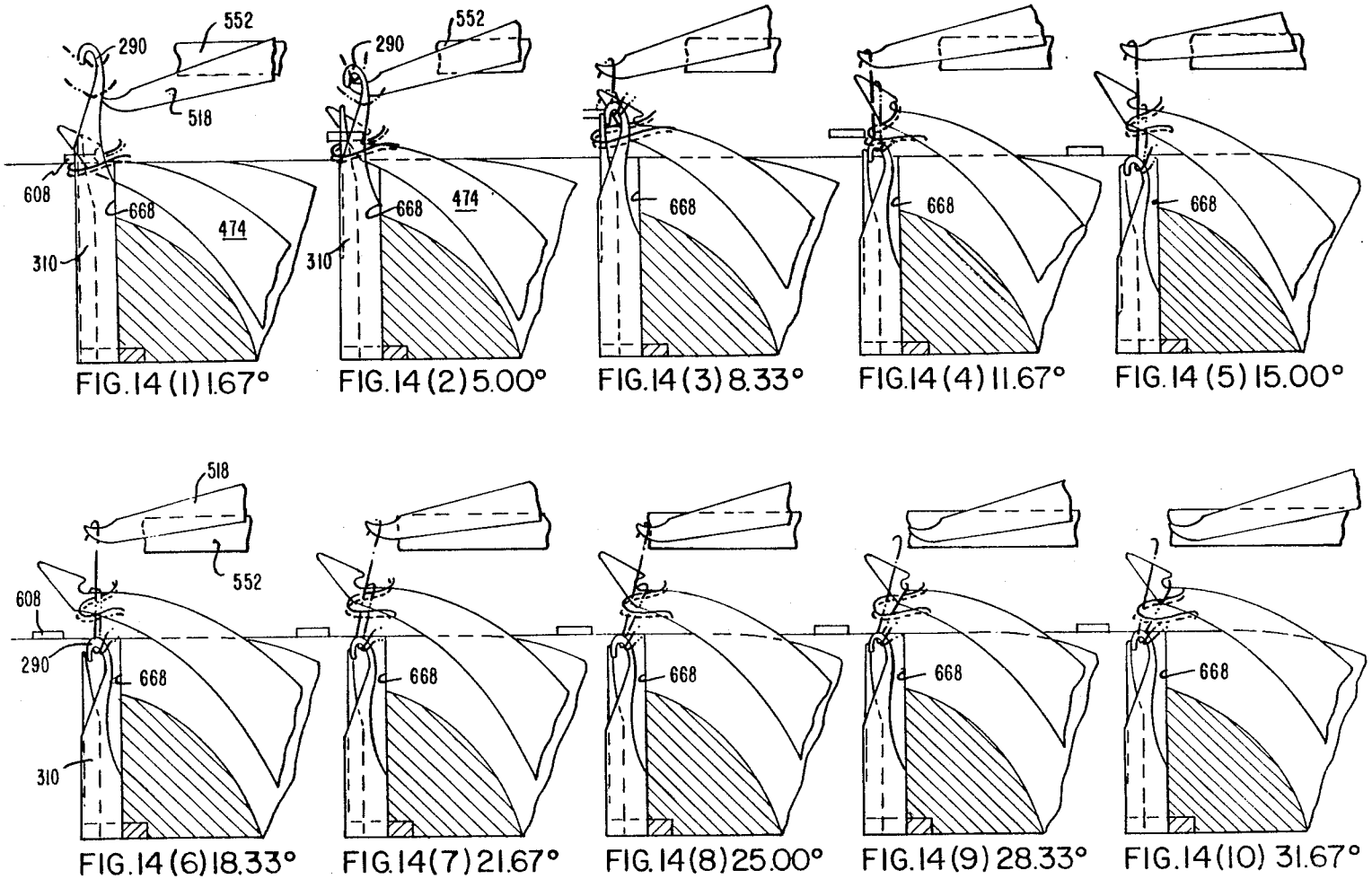
FIG.14(1)1.67°
FIG.14(2)5.00°
FIG.14(3)8.33°
FIG.14(4)11.67°
FIG.14(5)15.00°
FIG.14(6)18.33°
FIG.14(7)21.67°
FIG.14(8)25.00°
FIG.14(9)28.33°
FIG.14(10)31.67°

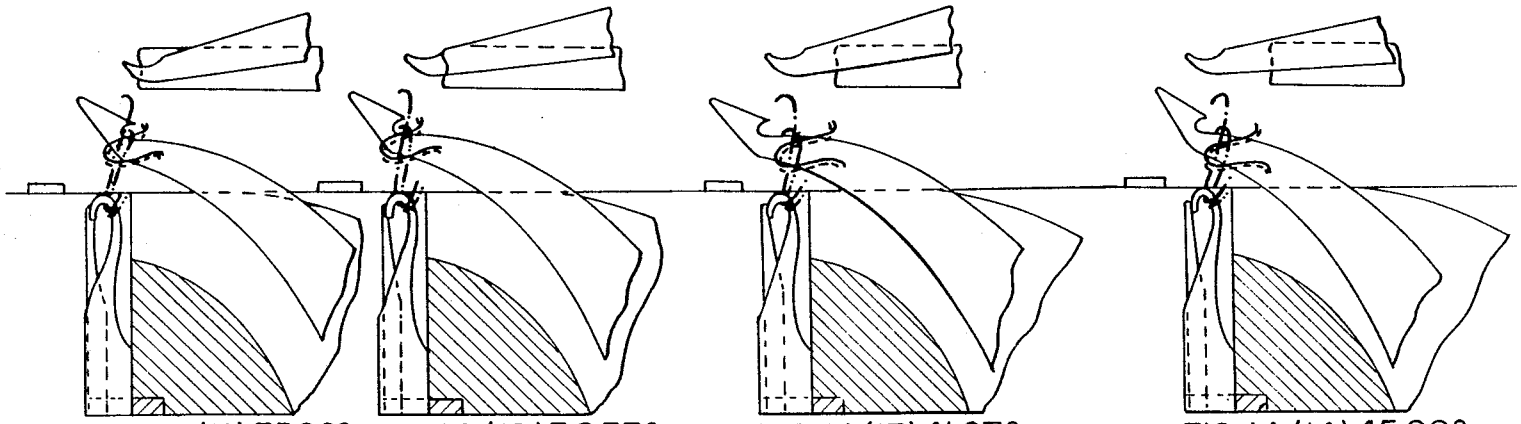
FIG. 14 (11) 35.00°
FIG. 14 (12) 38.33°
FIG. 14 (13) 41.67°
FIG. 14 (14) 45.00°
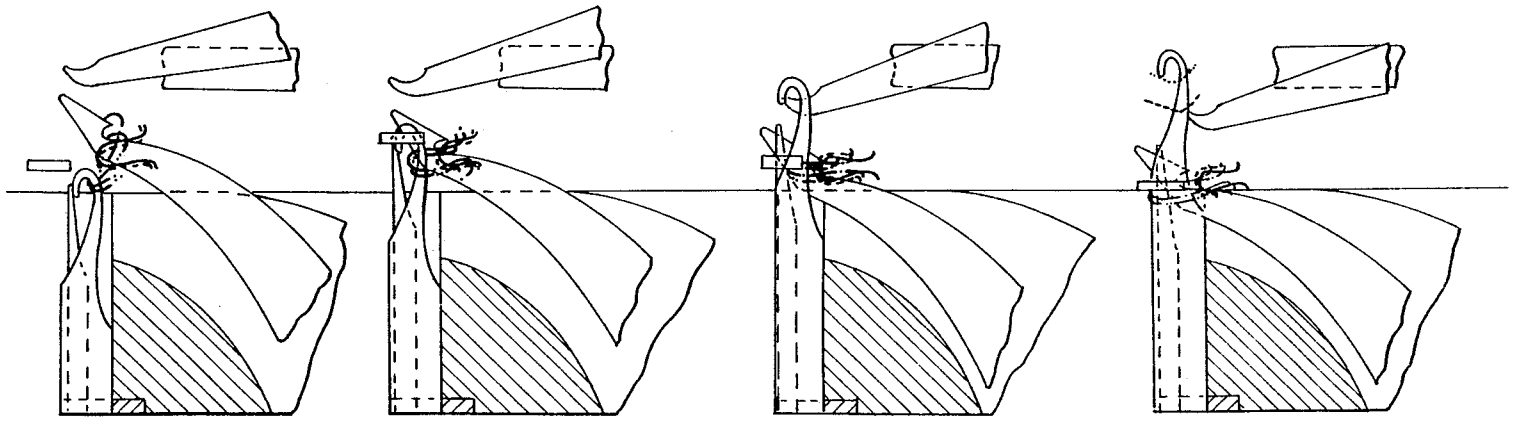
FIG. 14 (15) 48.33°
FIG. 14 (16) 51.67°
FIG. 14 (17) 55.00°
FIG. 14 (18) 58.67°

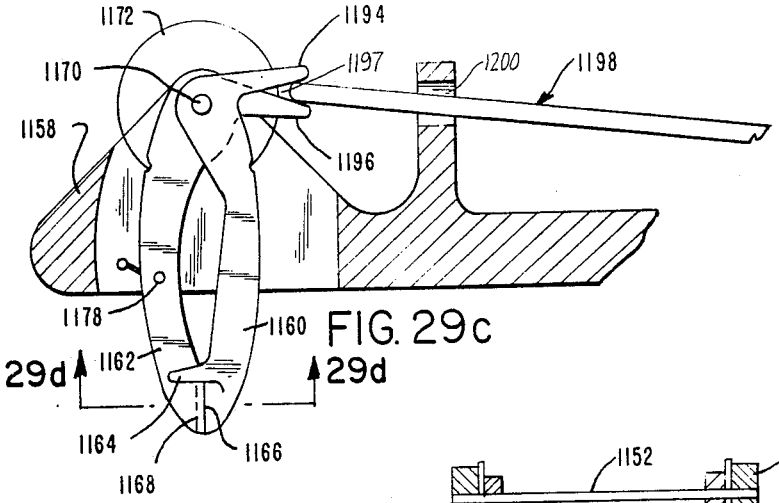
FIG. 29c
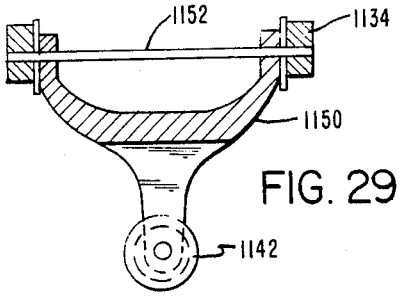
FIG. 29b
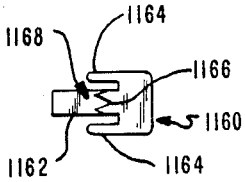
FIG. 29.d
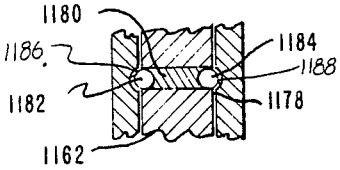
FIG. 29e
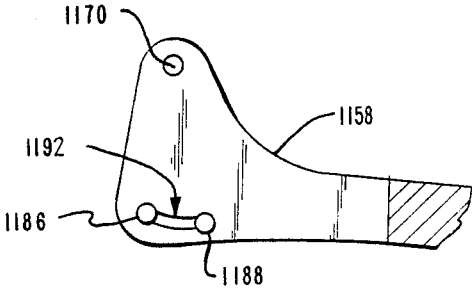
FIG. 29f
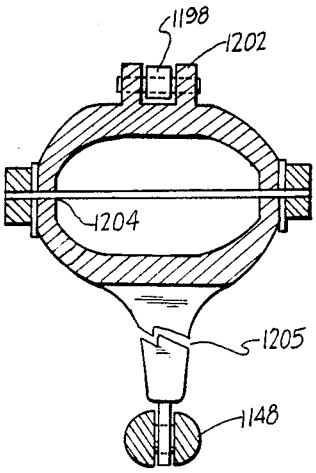
FIG. 29g

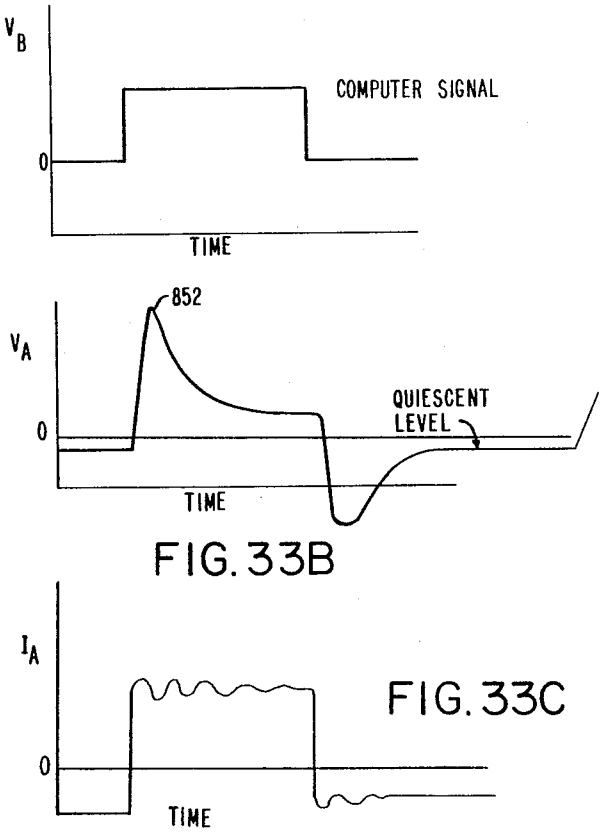
FIG. 33A
FIG. 33B
FIG. 33C
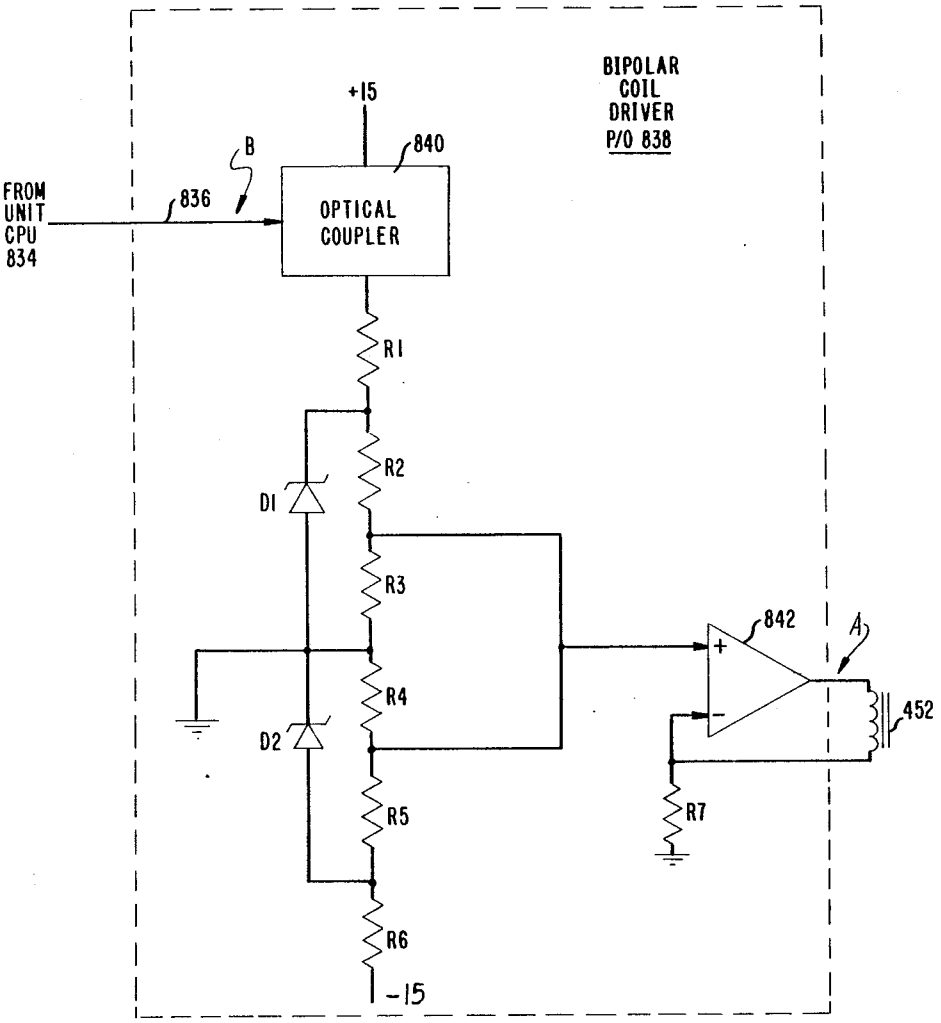
FIG. 32

CIRCULAR WEFT KNITTING MACHINE

This is a division, of application Ser. No. 398,303, filed July 14, 1982, now U.S. Pat. No. 4,608,839.

This invention relates to circular knitting machines and, more particularly, to selectively programmable, electronically controlled circular weft knitting machines of improved character for the economic and high speed fabrication of variously shaped and/or patterned tubular knit-wear items such as diversiform and variegated hosiery of both the sock and stocking categories selectively patterned fabrics and the like.

BACKGROUND OF INVENTION

Circular weft knitting machines of the general type herein of interest are both old and well known in the art. The basic precepts determinative of the circular weft knitting operation extend back over 70 years and the intervening period has been characterized by a progression of generally relatively minor and essentially unitary component improvements, all to the general end of increasing machine speed and/or versatility but, in general, with little or no radical departures from fundamental structure or mode of operation.

While the machine variants employed in present day commercial operations are legion, most, if not all, of the commercially available circular weft knitting machines conventionally include a rotatably displaceable cylinder member having a multiplicity of longitudinal grooves on its outer surface, with each of said grooves containing and guiding a single frictionally restrained but reciprocally displaceable knitting needle member therein. Such needles are selectively displaced in relation to a yarn feed location to permit successive needle-yarn engagements and introduction of engaged yarn into the previously knit portions of the article being fabricated. Among the known needle member constructions, the most commonly employed is the so-called "latch" needle employing a pivotally mounted latch element at the hook bearing end of the needle element that is rotatably displaceable between a hook open and a hook closed position. Another variant, the so-called "compound" needle employs a separate and independently displaceable longitudinally reciprocable closing element in association with each needle element. Such compound needle construction has long offered marked advantages in both fabric quality and speed of fabric formation through diminution of stroke length and permitted positive closing element control; however such advantages have never attained substantial commercial fruition. Another known needle construction is the so-called "spring beard" needle which does not reciprocate longitudinally of the rotating knitting cylinder. A common field of use for such needles has been in the fabrication of sweatshirts and similar articles.

Individual needle reciprocation for the most commonly employed latch type needle within its respective path defining and confining groove on the periphery of the knitting cylinder has been most commonly initiated and effected through needle engagement with elevating cams with the latter in turn being operatively controlled through selectively shaped "selection jacks". In turn, each selection jack is vertically actuated by a jack cam induced displacement after radial displacement by a presser cam. An associated control selector, conventionally an extending pin on a rotating drum or the like adapted to engage the selector plate cams which in turn contact the selection jack, operates to associate or dissociate the selection jack from the jack cam. When the selection jack is displaced by the jack cam it elevates an extending cam butt on the needle into operative driving engagement with an adjacent cam track or the like. In such systems, the pin location settings of the control members and selection jack butt contour essentially constitute a mechanical program to selectively displace the needles, through intermediate displacement of their respective selection jacks, into operative engagement with an associated cam track and to thereby control both the nature and extent of reciprocable needle displacement and which, in turn, is at least partially determinative of workpiece configuration and patterning. In such mechanically programmed machines, the selection jacks are normally selectively contoured and such jacks, together with the mechanical programming device must be modified and/or replaced whenever a configuration or pattern change in a product being fabricated is involved. That is to say, while such conventional circular weft knitting machines may be mechanically programmed to produce a particular shape and/or pattern for a given product they must also be basically modified, a relatively time consuming and expensive manual procedure requiring highly skilled personnel, whenever the shape and/or pattern of the product is to be changed. One practical result of such required program modification is either excessive machine downtime or buildup of undesired inventory if units are permitted to continue operation after completion of a particular production order. In conjunction with the above, conventional machine structure has generally also operated to limit mechanical programming to a selection between "tucking" or "floating" or to a selection between "knitting" or "floating" at a given yarn feed location. Conventional mechanical constructions or heretofore electronically programmable machines do not provide for Jacquard selection among "knitting", "tucking" and "floating" operations at each yarn feed location.

Apart from the above noted time-consuming and expensive character of manual program modification, the conventional circular weft knitting machines are also highly and unduly dependent upon the immediate availability of such highly skilled personnel in order to maintain any appreciable continuity of operation. Among the continued set-up and maintenance operations required is the bending or "setting" of the needle elements necessary to maintain the requisite degree of frictional engagement thereof within the slots on the knitting cylinders to avoid inadvertent displacement thereof and the selective modification of parts including part reshaping and redefinition of frictionally engaged surfaces such as cam tracks and the like, to accommodate wear.

Over the more recent years and in an effort to increase machine versatility and accommodate greater fabric patterning complexities, attempts have been made to incorporate electromechanical needle selection and displacement control systems in circular weft knitting machines, such as by actuating selection jack displacement through tape controlled solenoids or the like. However, such improvements, at least to date, are ones of degree only and have not, because of practical considerations such as undue power consumption, slow speed of operation and lack of operational reliability, been commercially employed on any widespread basis.

Commercial circular weft knitting machines also conventionally employ a multiplicity of "sinker" members, each radially reciprocable relative to the knitting cylinder and in a path essentially normal to that of needle displacement, to cooperate with the yarn feed and with the individual needle members in effecting stitch draw and stitch hold-down operations. Such sinkers are conventionally mounted on either an internal sinker pot or on an external sinker bed plate rotatable with the rotatable knitting cylinder and are individually radially displaced relative thereto by a separate cam track. Conventionally, the initiation and extent of individual radial sinker displacement is selectively determined by the character of such cam track. Certain recent developments have been directed to incorporating a limited capability to independently move the sinker members in the vertical direction intermediate periods of radial displacement thereof in order to reduce yarn tension and barre. However such developments have had only limited commercial use at the present time, largely because of mechanical problems attendant thereto.

While circular weft knitting machines conventionally employed in fabric knitting employ only a single direction of knitting cylinder rotation, circular knitting machines conventionally employed in hosiery fabrication often incorporate means for effecting reversal of direction of knitting cylinder rotation. Such machines, however, have been capable of traversing only a single fixed distance in the reverse direction in accord with machine design. Such machines also employ two individually nonsymmetrical but essentially 180° out-of-phase or reversed cam track contours, each adapted to accommodate only unidirectional needle element movement therewithin, to achieve stitch draw and latch clearing operations for such bidirectional knitting cylinder displacement. In such standard construction, not only are two individually nonsymmetrical cam tracks employed, but such cam tracks are necessarily "open" at the crossover or junction points, at which location the needle members are subject to undesired and/or uncontrolled displacement in the vertical direction. As noted above, needle displacement, in conventional circular knitting machines, is effected against the frictional forces normally restraining needle movement and such frictional forces are normally the only forces that operate to restrain undesired and unintentional needle movement as might occur at the open cam track crossover points or the like.

Conventional circular weft knitting machines are also generally characterized by a multiplicity of selectively positionable components that are determinative of the nature of the displacement paths taken by the yarn engaging elements in the knitting operation both in accord with the nature of track defining surfaces thereon and in accord with how such components are positioned relative to other machine components. Within this two variable environment, modification of both the contour of the control track surfaces and the positioning of the components is most usually manually effected for each yarn feed within each machine in accord with the visually observed nature of the product being fabricated. Such manual modification and positional adjustments are not only effected in accord with the desires of individual maintenance personnel but have the cumulative result that every machine is or rapidly becomes effectively unique in both its structure and in its operation with an accompanying cumulative lack of reliability of operation on a repetitive basis.

It is often desirable to incorporate, in circular weft knitting machines, the capability of forming a so-called "terry cloth" type of surface on all or on a portion of a knitted article such as on the sole and/or heel portions of a sock to enhance both wearer comfort and durability. Such "terry cloth" surface is formed by incorporating into the fabric a multiplicity of extending yarn loops, conventionally termed "terry loops". In most circular weft knitting machines, the formation of such "terry loops" is conventionally effected through the use of sinkers with an elevated land which serves to divide the converging yarns during the stitch draw operation. Other circular weft knitting machines employ auxiliary yarn feed engaging elements known as terry "bits" or terry "instruments". In the latter type construction, the terry bits are conventionally mounted for individual radial displacement relative to the knitting cylinder and in a path normal to that of needle displacement within a terry dial in a suspended housing assembly disposed above and coaxial with the knitting cylinder. Such terry bits conventionally include a cam butt that is selective engageable with one of two stationary cam tracks. When a terry bit cam butt is operatively engaged in one of such cam tracks, the terry bit is appropriately subject to radial displacement and cooperates with the reciprocating needles and the yarn feed mechanism to form the desired terry loops. In contradistinction thereto, when the terry bit cam butts are disposed in the other cam track, the terry bits will be positioned in a retracted location out of the path of needle displacement and yarn feed and are so rendered effectively inoperative.

As pointed out above, the development of circular weft knitting machines of the type herein of interest has been characterized by a progression of generally relatively minor and essentially unitary component improvements with little or no radical departures from fundamental structure or mode of operation. The economic pressures that have been attendant recent years have served however to accentuate the long recognized and continued need for circular weft knitting machines of significantly increased reliability and expanded versatility as to increased pattern and contour capabilities in general, a marked diminution in the dependence upon the highly skilled set-up and maintenance personnel who are of limited availability and for circular weft knitting machines of significantly increased speed of operation with consequent higher unit production rates as well as a diminution of the time required for machine changeover to accommodate either product or pattern changes. Unfortunately, however, commercially available circular weft knitting machines have not met such needs and are, at the present time, generally subject to one or more of the following disabilities, the net effect of which has effectively precluded the attainment of the desired objective of the provision of an improved circular knitting machine of significantly increased reliability, versatility, speed of operation and economy of production.

Among such long recognized disabilities are an inherent lack of reliability of machine operation; undue downtime required for machine modification to accommodate product or pattern change; undue dependence upon the unique abilities of individual maintenance personnel; cumulative modification of individual machine components in accord with exigencies dictated by visual product observation; limitation on stitch draw speed directly attributable to necessary usage of needle butt cam track slopes of 45° or less in association with vertically fixed verges or sinkers; the inability of machines employing latch type needles to positively control latch element displacement independently of needle reciprocation; the lack of an effective control over stitch length; excessive length of required needle displacement; speed limitations inherent in mechanical needle selection and in the power usage and speed limitation attendant electromechanical needle selection and in the conventional employment of surface interrupted cam tracks controlling the nature and extent of needle displacement; the lack of effective means to assure uniform yarn feed; inability to control yarn tensions and the robbing back of yarn from immediately preceding knit operations and consequent product variation; the limitation of the number of permissible yarn feed stations within a 360° circumference for a given knitting cylinder diameter; a basic lack of awareness of the status of the actual knitting operation in progress in comparison to desired programmed operation, except through visual observation of the product being fabricated; inability to selective vary terry loop lengths; the inability to utilize a plurality of simultaneous yarn feeds and to produce uniform fabric from each feed; and the inability to symmetrically operate when the knitting cylinder is in a reciprocatory or bidirectional mode of operation.

The foregoing are but some of the generally characteristic, if not inherent, structural and operational limitations of the state of the art circular weft knitting machines. The subject invention, as hereinafter described and claimed, represents a radical departure from conventional technology in a number of the basic circular weft knitting machine operational steps and component subassemblies, the individual and combined effect of which is to provide a markedly improved and electronically preprogrammable circular weft knitting machine construction that incorporates novel methods of machine operation and component displacement to the end of providing commercially significant and readily realizable improvements in product contour and patterning versatility at significantly increased speeds, with improved operational reliability and attendant economies of operation that flow therefrom and from reduced dependence upon highly skilled maintenance and operating personnel

SUMMARY OF THE INVENTION

As noted above, this invention comprises a selectively programmable, electronically controlled circular weft knitting machine of markedly improved character and reliability for the economic and high speed production of variously shaped and patterned tubular knitwear items. Such improved machine is compositely constituted of, and characterized by, marked improvements in a number of the basic circular weft knitting machine components and in the operational modes thereof which serve to contribute, both individually and collectively, to the attainment of the desired objective of reliable, high speed and economic production of variously shaped and patterned tubular knitwear items.

For initial orientation and convenience, the subject invention includes, in its broad aspects and without order as to relative importance, (1) An improved knitting method for circular weft knitting machines wherein the yarn engaging knitting elements are selectively displaced in a positively controlled path that is symmetric about adjacent yarn feed locations and also with respect to the midlocation halfway between adjacent yarn feed locations and thus permit employment of the same path of yarn engaging knitting element displacement to both draw and clear a stitch independent of the direction of knitting element approach to a yarn feed location.

(2) An improved knitting method for circular weft knitting machines that affords the ability to knit, tuck or float on any knitting element at any yarn feed location and independent of the direction of knitting element approach to such yarn feed location.

(3) An improved knitting method for circular weft knitting machines wherein operational control of the path of knitting element displacement is effected at a location intermediate adjacent yarn feed locations and independent of the direction of knitting element approach thereto.

(4) An improved knitting method for circular weft knitting machines that affords the ability to knit, tuck or float on any knitting element at any yarn feed location and independent of the direction of knitting element approach to such yarn feed location through application of electrical signals of predetermined character as such knitting element passes through a predetermined location intermediate adjacent two yarn feed locations.

(5) An improved knitting method for circular weft knitting machines that includes the step of varying the location of sinker elements in accord with the amount of yarn used per course.

(6) An improved knitting method for circular weft knitting machines wherein stitch drawing is effected by the conjoint action of a vertically moving compound needle element and a sinker element with a consequent decrease in total wrap angle of the yarn about the knitting elements and lowered tension operation at the knitting point.

(7) An improved knitting method for circular weft knitting machines wherein the yarn engaging knitting elements are maintained in constant spaced relation immediately subsequent to stitch drawing to preclude robbing back of yarn from previously knit stitches and thereby insure a positive yarn feed independent of incoming yarn tension.

(8) An improved system for effecting needle member displacement in circular weft knitting machines wherein compound needle members of novel construction having selectively shaped, flexible shank needle and closing elements are provided with a novel and improved drive system that selectively affords, in response to preprogrammed instructions, two discrete, selectively shaped and operationally closed continuous cam track control paths for needle element displacement and two discrete, selectively shaped and operationally closed continuous cam track control paths for closing element displacement and which, in selected permutations, function to positively displace the needle and closing elements of each compound needle member in such manner as to knit, tuck or float at each yarn feed location and for either direction of knitting cylinder rotation in accord with preprogrammed control and to thereby markedly increase knitwear shape and pattern capability.

(9) An improved type of control cam track for circular weft knitting machines that is of closed continuous character and of a configuration that is of symmetric character about adjacent yarn feed locations and with respect to the midlocation halfway between such yarn feed locations to permit the same path of yarn engaging knitting element displacement to both draw and clear a stitch independent of the direction of approach of said knitting element to a yarn feed location.

(10) Operatively associated with the above mentioned needle and closing element displacement system is an improved, electronically responsive and rapidly reacting method and apparatus for selectively effecting the operative engagement of the flexible shank needle and closing elements with the respective program directed cam track control paths. Such method and apparatus broadly comprises an initial mechanical biasing of the dependent flexible shank portions of the selectively shaped needle and closing elements with an accompanying storage of potential energy in the deformed shank portions thereof from one operative position toward a second operative position; the magnetic retention of such mechanically biased shank portions in displaced position within an elongate selection zone and a selective and discrete electronically controlled release thereof under preprogrammed control, all of which contributes, in addition to the aforesaid increase in machine versatility, to a marked increase in permitted speed of operation without diminution of shape and pattern reliability and with minimal expenditure of power.

(11) A novel and improved sinker element configuration that enables the sinker elements to have the operative capability of assisting in both stitch drawing and knockover operations at each feed location.

(12) A novel and improved sinker element displacement system that provides two dimensional sinker element displacement in conjunction with the aforesaid compound needle member displacement system to permit marked increases in stitch draw speed, overall speed of knitting machine operation and controlled increase in yarn back tension to prevent robbing back and to insure full yarn feed from the yarn supply.

(13) An improved stitch draw control system permitted by the employment of the aforesaid compound needle members and two directional displacement of selectively shaped sinker elements in association with a rake element that prevents upward yarn displacement following stitch drawing and assures positive disengagement of the drawn stitch from the needle and closing elements of the compound needle member.

(14) An improved terry bit configuration and associated displacement and loop shedding system that affords, where desired, selectively controlled and preprogrammable two dimensional terry bit displacement and positive terry loop shedding in conjunction with the aforesaid two dimensional sinker displacement and compound needle member displacement to permit marked increase in speed of operation where the desired product includes terry loop formation.

(15) An improved stitch length control system for controlling the length of the stitch draw independent of the displacement path of the compound needle members that is responsive to programmed control and specific measured yarn consumption and which is continuously operative in the course of knitting operations.

(16) A basic machine structure and mode of operation through complemental interaction of the above noted compound needle members, the compound needle member selection and drive systems, the two dimensionally displaceable sinker members and other yarn engaging components that permit a markedly higher speed of operation and all significant knitting machine operations to be controlled by a preprogrammable digital computer with a consequent marked increase in knitting machine versatility, contour and patterning capabilities and in significant economies of operation.

(17) Unitary control cam track housings for continual positive control of the displacement of all yarn engaging knitting elements that affords an extended effective operating life for the control cam tracks and associated yarn engaging knitting elements as well as a permitted interchangeability of parts and employment of planned maintenance cycles for all machines.

(18) A markedly increased number of permitted yarn feed stations for a given knitting cylinder diameter and concommitant controllable sectors of operation through permitted utilization of common control paths for needle and closure element displacement for stitch drawing, stitch shedding and for stitch knockover in bidirectional cylinder operation and through diminution of permitted distance between the electronically controlled compound needle operation selection point and the yarn feed location for each operating sector. One significant characteristic thereof is the provision of compound needle member control paths that are symmetrical both about the yarn feed locations at the defining marginal edge of an operational sector and about the midpoint of such sector where electronic selection of the requisite mode of operation for the needle and closing elements occur.

(19) A novel and improved yarn feed system employing yarn selecting, directing, inserting and cutting elements to provide for selective utilization and incorporation of one or more yarns into the product being fabricated, in response to preprogrammed control, from an available reservoir of a plurality of yarns at each operating sector.

(20) A continuously operable yarn length measuring system permitting continuous monitoring of actual yarn consumption against predetermined known standard values thereof for particular yarns and particular products being fabricated and an associated capability of varying stitch length to bring measured yarn consumption values into conformity with known standard values therefor without interruption of knitting machine operation.

(21) Individual computer control with "read-write" and "read only" storage capability to determine and control basic component operation to effect fabrication of varied products under preprogrammed control.

(22) Individual needle disengagement control for effecting product release upon completion of knitting operation with permitted gore point orientation for automated toe closing operation.

(23) A novel and improved stitch program memory organization which presents a relatively simple conversion of a designer's pattern into a digitally stored program and the direct use of such program in controlling the knitting operation.

(24) A knitting system organization wherein a plurality of knitting machine units are directed from one or more system computers.

(25) An automatic adjustment of stitch length to compensate for machine part wear and changes in the coefficient of friction or yarn tension during the knitting process.

In its more narrowed aspects the subject invention includes:

(1) The provision of closed continuous control cam tracks both interiorly and exteriorly of the knitting cylinder in association with appropriately located slots in the knitting cylinder wall to permit selective needle and closing element access thereto.

(2) The provision of a new and improved configuration for compound needle members including the incorporation of radially flexible shank portions and T shaped cam butts on the dependent ends of both the needle and closing element components thereof in association with a longitudinally slotted body portion for the needle element sized to slidably contain the dependent end of the flexible shank portion of the closing element.

(3) The provision of a new and improved configuration for sinker elements incorporating a pair of spaced cam lobes at one end thereof, and a curved body portion extending therefrom that outwardly terminates in a selectively contoured end having a pair of yarn engaging lands disposed on either side of yarn receiving recess.

(4) The provision of a bifurcated and bidirectionally displaceable rake member operatively associated with each needle and sinker member to assure disengagement of yarn from the needle element hooks and out of the path of travel of the closing elements during upward needle member displacement during knitting operations and to prevent needle reengagement with such yarn during the next needle downstroke.

(5) The provision of a new and improved configuration for terry instruments incorporating a pair of spaced and opposed cam butts and an arcuate body portion extending transversely therefrom that permits a suspended mounting of the terry dial assembly above the knitting cylinder.

(6) The provision of a terry loop shedding element operatively associated with each terry instrument to effect positive disengagement of a formed terry loop therefrom and which then withdraws to provide space behind the raised needles for yarn feed.

(7) The provision of a suspended terry dial cam system that is rotationally phaseable into and out of operational relationship with the knitting cylinder and yarn engaging elements associated therewith.

(8) A digitally controlled yarn selector system which affords selection of yarn from as many as 10 or 12 available yarns at each feed station with all of the latter being deliverable from enlarged storage creels disposed at locations remote from the knitting machine.

(9) An electrically operable yarn selection and displacement assembly adapted to move a selected yarn from a remote selection station to an appropriate location behind the needle elements so as to be engageable thereby on the needle element downstroke.

(10) An electrically operable yarn shearing assembly that prevents yarn ends from appearing on the inside of a hoisery article being fabricated or the like.

(11) An improved method and apparatus for effecting needle element and closing element displacement path selection without interference with knitting cylinder rotation and independent of direction thereof that includes (a) individually operable pressure pad members for biasing the upper ends of the needle and closing elements into compressive engagement with the back wall of the knitting cylinder slot upon needle member entry into a selection zone to serve as a fulcrum for dependent end flexure thereof;

(b) selectively operable means for mechanically biasing the dependent shank portions of the needle and closing elements in flexed condition upon entry into the selection zone with attendant stored potential energy therein;

(c) magnetic retention means for maintaining the needle and closing elements in flexed or biased condition as they are transported to a selection point; and (d) electronic release of magnetic retention forces at the selection point to effect preprogrammed displacement path selection of the moving needle and closure elements within a fraction of a millisecond.

(12) A positive action needle and closing element flexing system wherein the upper portions of the needle and closing elements are compressively engaged at the locus of entry into a selection zone to serve as a fulcrum for concurrent mechanical displacement of the lower portion of such needle and closing elements to bias the latter in flexed condition with accompanying storage of potential energy in the flexed elements.

(13) The permitted usage of integral or single unit cam track housing members securable to a common foundation or base plate with attendant uniformity of fabrication and minimization of opportunity for individual reshaping of cam tracks and modification and adjustment of component positioning in accord with exigencies of operation.

(14) A factory presettable base stitch length control that is common to all machines and readily identifiable by a selectively generated signal which serves as a ready reference point for controlled stitch length departures therefrom in accord with central preprogrammed control.

(15) The capability of preprogramming and storing of fabric production instructions for extended periods of time in association with automated monitoring of actual production with attendant simplification of inventory control of both finished product and raw materials as well as precontrolled plant operation.

Among the broad advantages of the subject invention is the provision of an improved selectively programmable and computer controllable circular weft knitting machine and circular weft knitting methods that affords significantly increased machine reliability and versatility in the production of variously shaped and patterned tubular knitwear items at significantly higher speeds and lowered unit costs to the anticipated extent of producing a better quality Jacquard type knit fabric at a tenfold production increase over that currently attainable. Other such broad advantages include a capability of continuously monitoring actual yarn consumption, effecting a comparison thereof with known standard values for a product being fabricated and initiating corrective action in response to predetermined differences therebetween which not only markedly increases the uniformity of product produced but affords savings in yarn consumption through permitted usage of narrower product design specifications. Another broad advantage is the provision of a circular weft knitting machine of markedly improved product versatility and operational reliability and which is significantly free of heretofore required dependence upon time consuming and expensive manual machine element modification in accord with varying product specifications and operational idiosynchrasies.

Further and more specific advantages of the subject invention include more uniform fabric production through uniform stitch drawing and avoidance of robbing back and avoidance of product pairing operations; the avoidance of unwanted inventory buildup and/or undue machine downtime through avoidance of difficulties and delays attendant machine and pattern modifications and attendant higher productivity per machine; and a permitted simplification of mill design through reductions in required floor space and reduced unit costs for power, air conditioning and the like.

Still further advantages of the subject invention include permitted economies attainable through the preprogramming and storage of article and pattern fabric production instructions for extended periods of time in association with automated monitoring of actual production with attendant simplification of inventory control of both finished product and raw materials, as well as precontrolled plant scheduling and operation on a long term basis.

Still another broad advantage of the subject invention is the provision of a circular weft knitting machine characterized by an internal machine, life monitoring capability, a ready interchangeability of component parts, adaptability to planned maintenance techniques and by component replacement in preference to selective component modification in accord with exigencies of operations.

A primary object is the provision of an improved knitting method for circular weft knitting machines where the displacement path of the yarn engaging knitting elements is symmetric intermediate adjacent yarn feed stations and also with respect to the midlocation between said adjacent yarn feed stations and thus permits employment of the same path of yarn engaging knitting element displacement to both draw and clear a stitch independent of the direction of approach of the knitting elements to a yarn feed location.

Another primary object of this invention is the provision of a knitting method for circular weft knitting machines that permits a knit, tuck or float operation by each knitting element at each yarn feed location independent of the direction of knitting element approach to such yarn feed location.

Another primary object of this invention is the provision of a new and improved circular weft knitting machine for the economic and high speed fabrication of variously shaped and patterned tubular knitwear items.

Another object of this invention is the provision of an improved circular weft knitting machine construction subject to selective operational control by a preprogrammable digital computer for the high speed fabrication of variously shaped and patterned knitwear items at reduced unit cost.

Still another object of this invention is the provision of a new and improved circular weft knitting machine of markedly improved operational reliability and product versatility that is significantly free of manual machine and component modification and resetting to accommodate product variation and operational idiosyncrasies of individual machines.

A further object of the subject invention is the provision of an improved needle member selection and displacement system for circular knitting machines.

A still further object of the subject invention is the provision of an improved selection and displacement system for the needle and closure elements of compound needle members in association with two dimensional displacement of sinker members in circular weft knitting machines.

Still another object of this invention is the provision of a compound needle member displacement system that employs closed continuous control cam tracks for effecting selected permutations of needle element displacement and closing element displacement.

Still another object of this invention is the provision of an improved circular weft knitting machine construction whose control cam tracks for needle member displacement are of closed continuous character symmetrical both about the yarn feed location and about an intermediate operation selection point.

As pointed out above, the circular weft knitting method and machine forming the subject matter of this invention embodies pronounced departures from many of the structural and operational interrelationships that have long characterized the more or less conventional or standard circular weft knitting machines of the art. Included therein are numerous changes in basic modes of operation and in basic machine structure, all of which contribute in varying degrees to the new and improved results that are attainable through usage of the subject matter hereof. The foregoing stated objects and advantages are not all-inclusive and do no more than note some of the broad advantages and objects of the invention.

To the above ends, other objects and advantages of the subject invention will be pointed out herein or will become apparent to those skilled in this art from the following portions of this specification and from the appended drawings which set forth, pursuant to the mandate of the patent statutes, the general structure and mode of operation of a circular weft knitting machine incorporating the principles of this invention and presently deemed to be the best mode for carrying out such invention. In conjunction therewith, it should be specifically noted that while the hereinafter described embodiment is particularly directed to a circular weft knitting machine adapted for sock fabrication, the principles of this invention are equally applicable to larger diameter knitting machines for general knit fabrics production and also to knitting machines for ladies hosiery and like articles Referring to the drawings:

Figure 2:
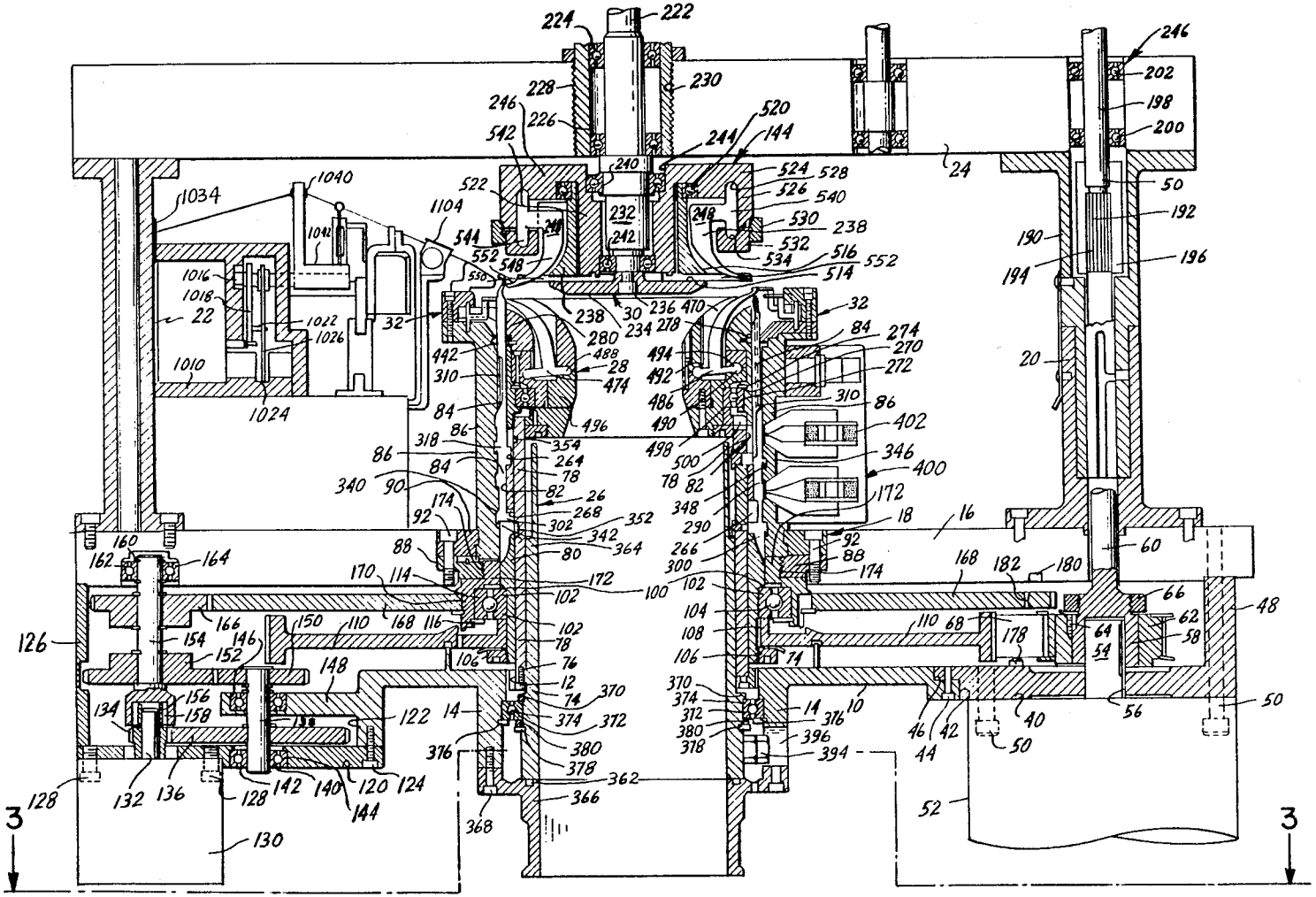
FIG. 2 is a vertical section with the lower portion as taken on the line 2—2 of FIG. 3 and the central portion as taken on the line 2A—2A of FIG. 4.
Figure 5A:
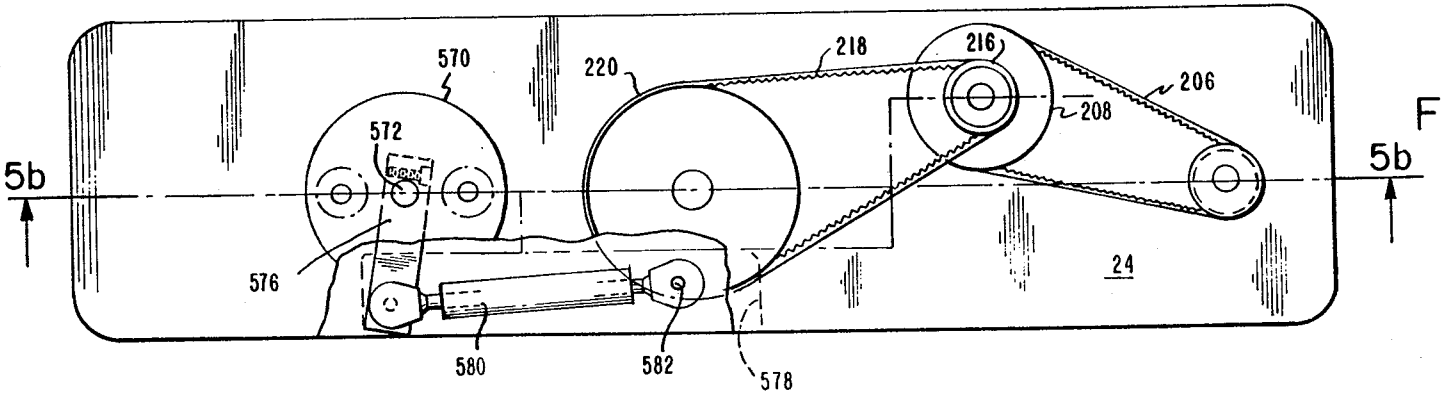
Figure 5B:
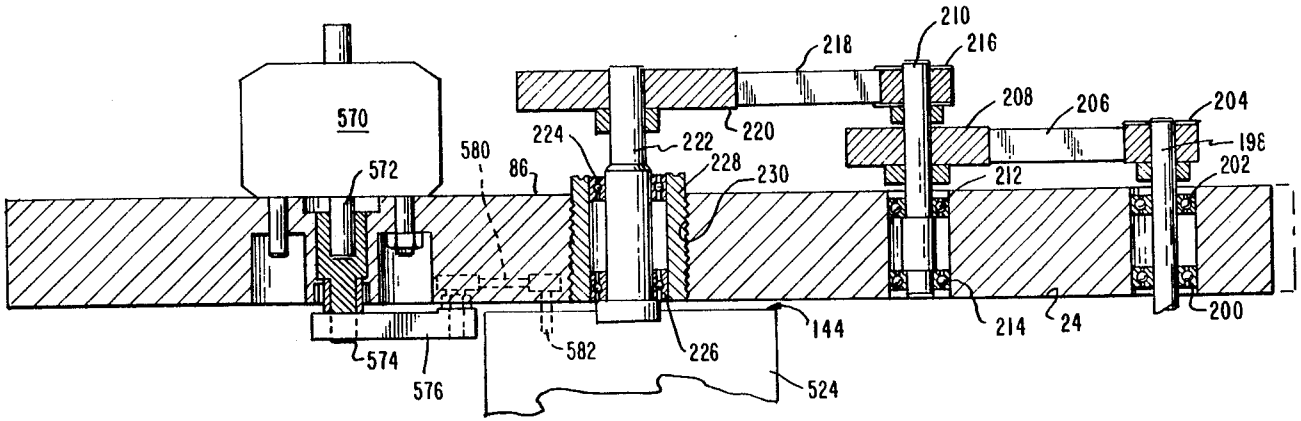

FIG. 5*a* is a top plan view, partially broken away as taken looking down from the top of FIG. 2;

FIG. 5*b* is a vertical section, with a portion thereof rotated for clarity of showing, as taken along the line 5*b*—5*b* of FIG. 5*a;*

Figure 6:
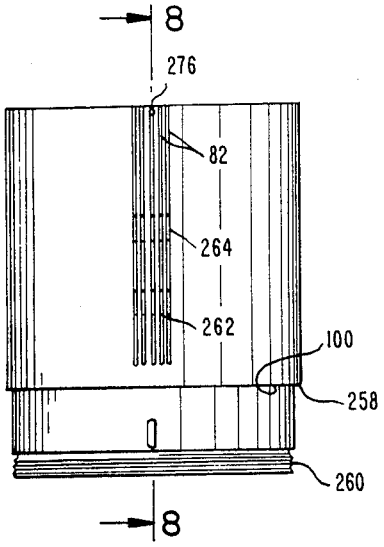
Figure 7:
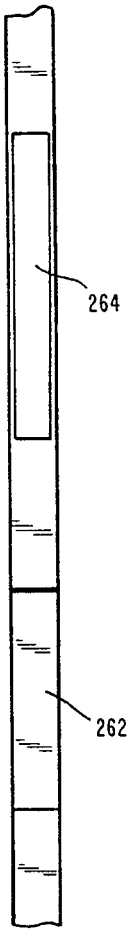
Figure 8:
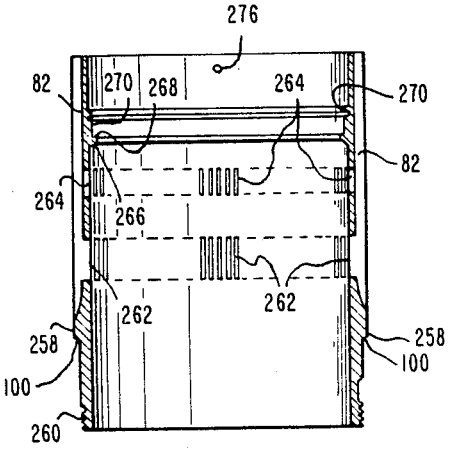
Figures 9, 10, 11, 12:
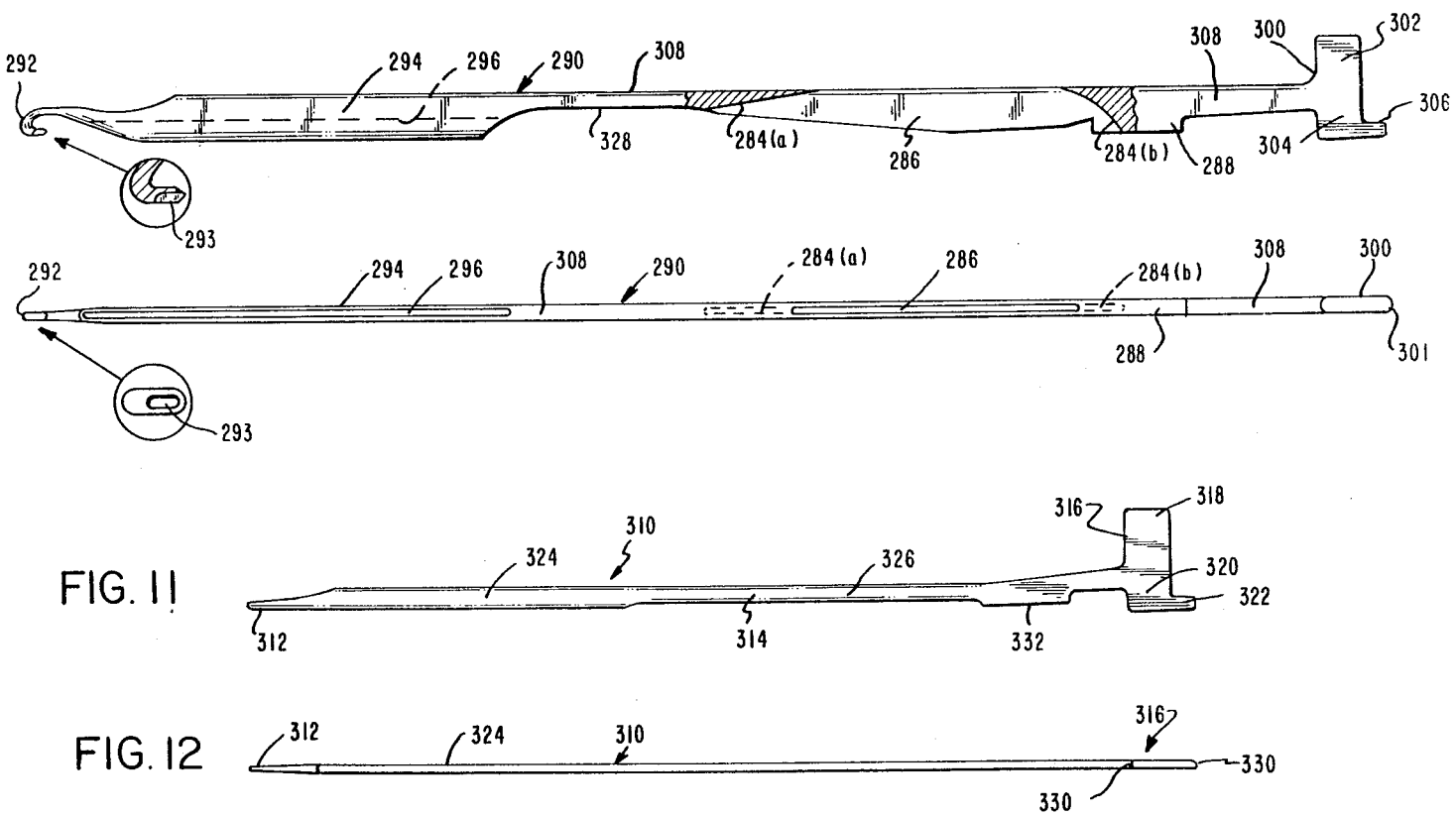
Figures 13A, 13C:
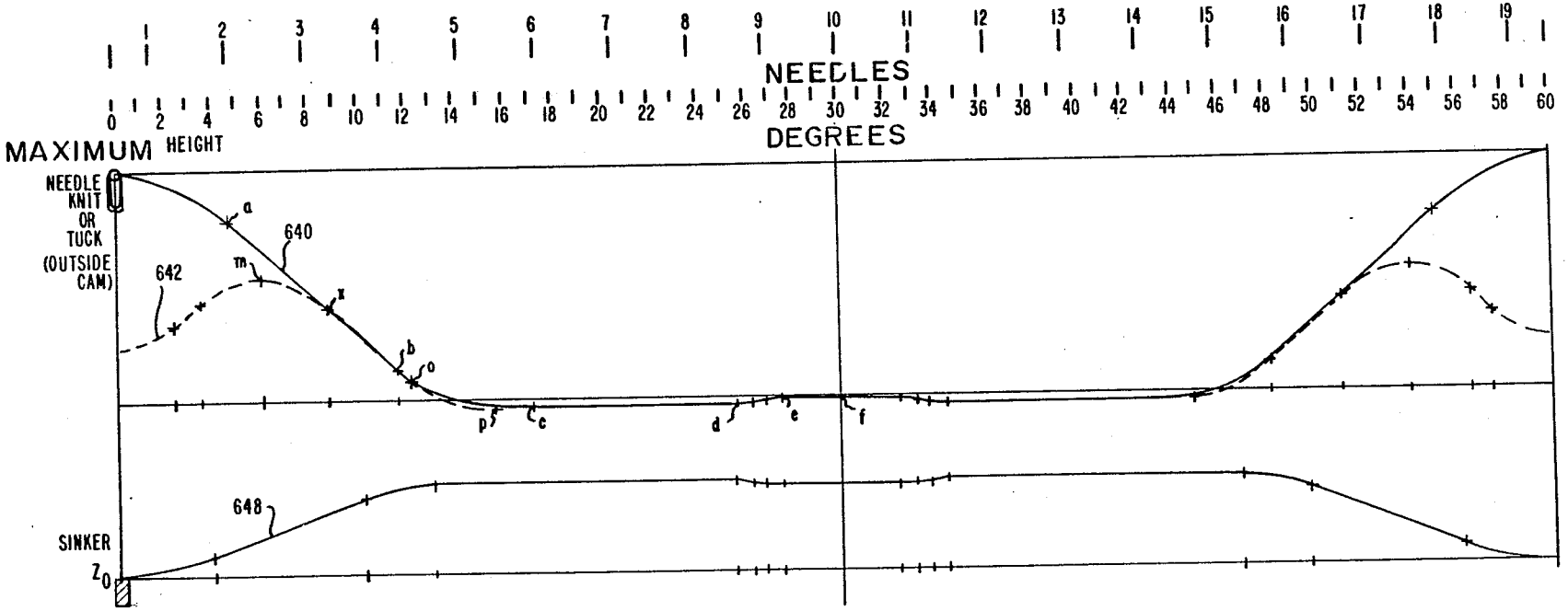
Figures 13B, 13D, 13E:
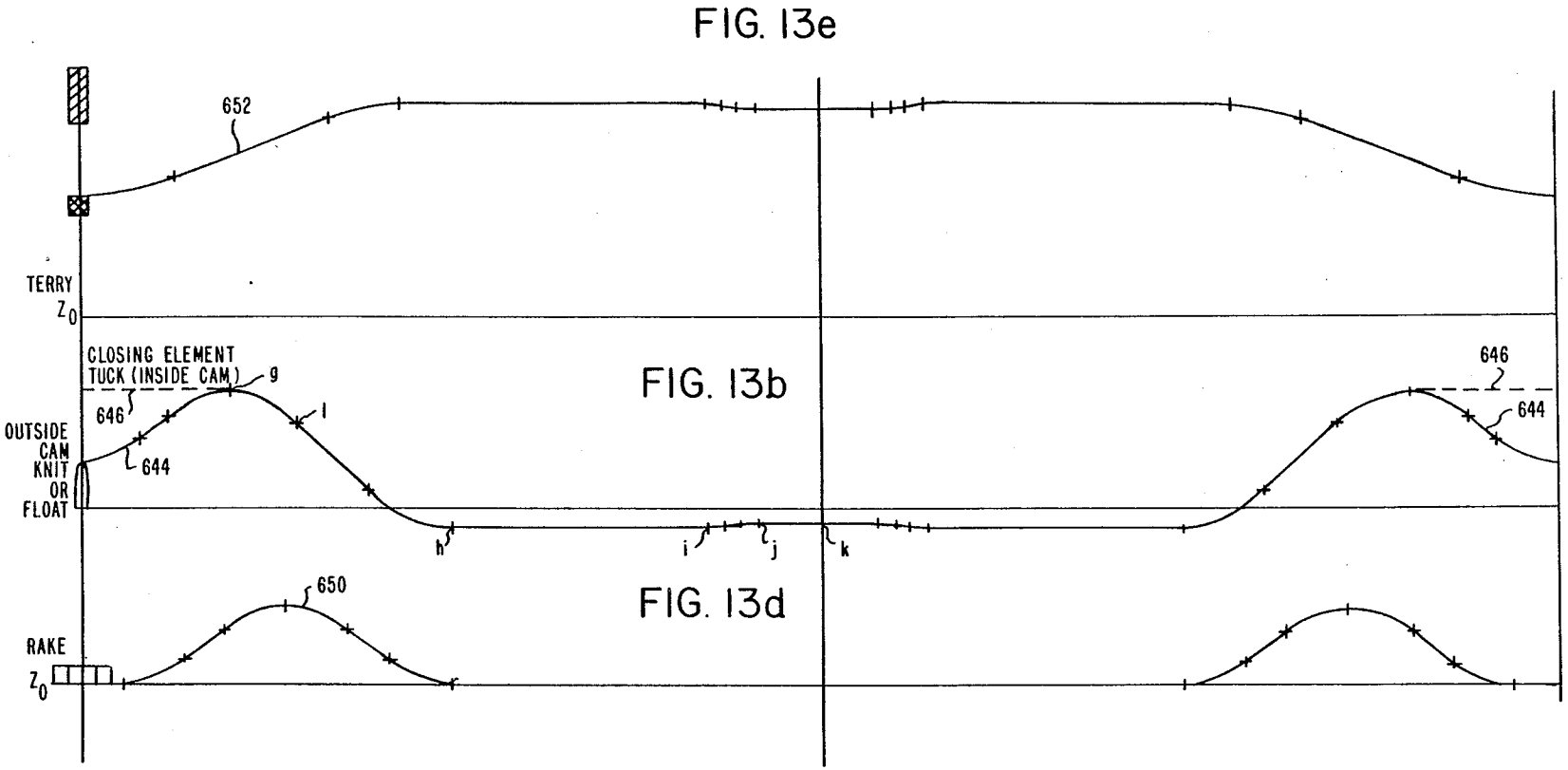
Figure 13F:
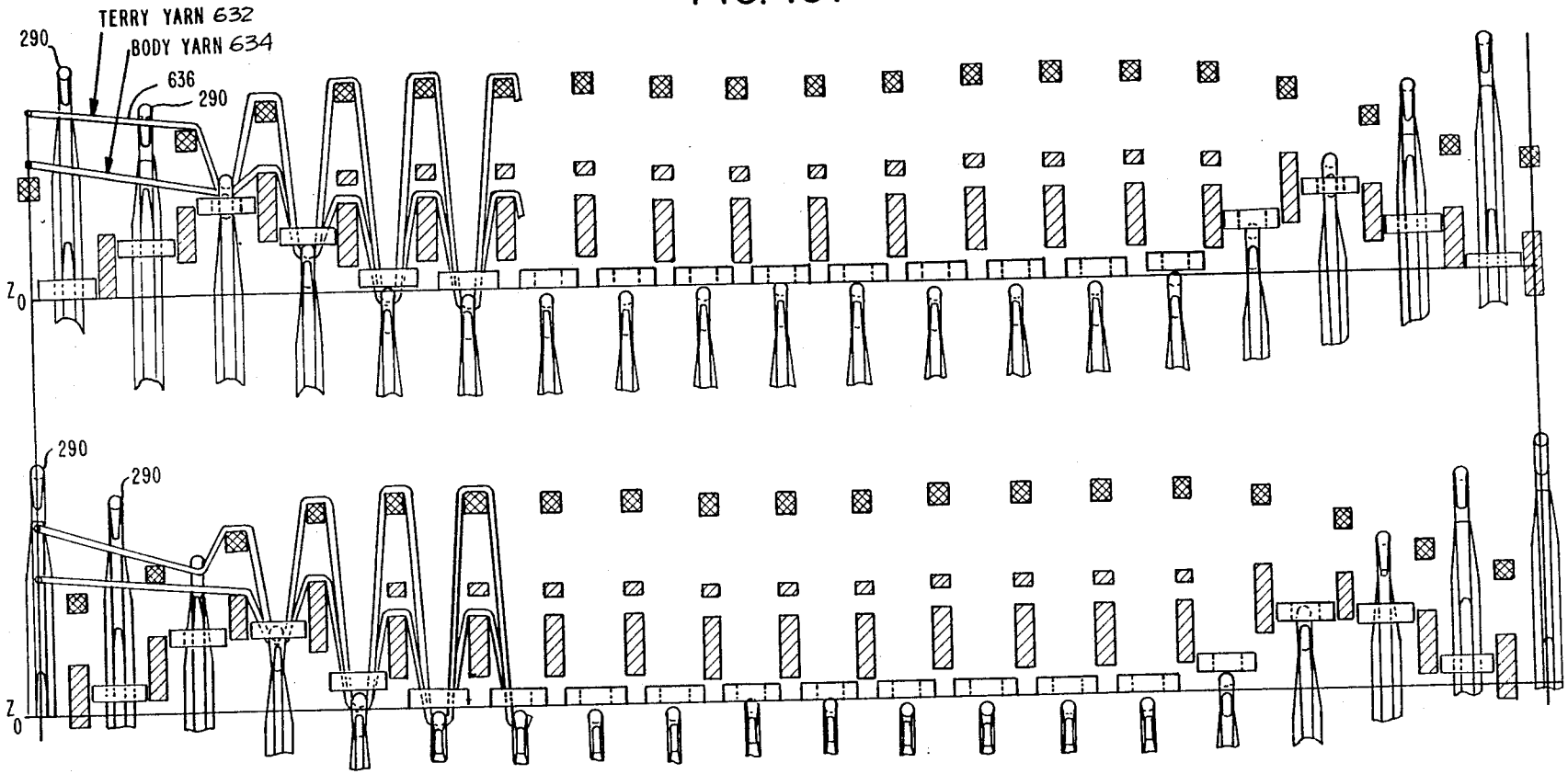

FIG. 6 is an elevational view of a presently prepared configuration for the knitting needle support cylinder;

FIG. 7 is an enlarged view of the slot configuration shown on FIG. 8;

FIG. 8 is a section taken on the line 8—8 of FIG. 6;

FIG. 9 is a side elevation, partially in section, of a presently preferred construction of a flexible shank compound needle element;

FIG. 10 is a plan view of the needle element illustrated in FIG. 9;

FIG. 11 is a side elevation of a presently preferred flexible shank closing element for the needle element illustrated in FIG. 9 and FIG. 10;

FIG. 12 is a plan view of the closing element illustrated in FIG. 11;

FIG. 13*a* is a schematic representation of the shape of the presently preferred cam track control paths for two available modes of composite vertical and horizontal needle element displacement for a 60° operating sector intermediate adjacent yarn feed locations;

FIG. 13*b* is a schematic representation of the shape of the presently preferred cam track control paths for the two available modes of composite vertical and horizontal needle closing element displacement for a 60° operating sector intermediate adjacent yarn feed locations;

FIG. 13*c* is a schematic representation of the presently preferred cam track control path for composite vertical and horizontal displacement of the sinker elements for a 60° operating sector intermediate adjacent yarn feed locations;

FIG. 13*d* is a schematic representation of the shape of the presently preferred cam track control path for the composite vertical and horizontal displacement of the rake elements for a 60° operating sector intermediate adjacent yarn feed locations;

FIG. 13*e* is a schematic representation of the shape of the presently preferred cam track control path for the composite vertical and horizontal displacement of the terry instruments for a 60° operating sector intermediate adjacent yarn feed locations;

FIG. 13*f* is a vertically split and horizontally unwrapped schematic vertical section that, when appropriately merged together, shows the relative vertical positioning of the needle, element, closing element, sinker element, terry instrument and rake element during their composite vertical and horizontal displacement intermediate adjacent yarn feed locations and resulting from the control cam track paths shown in FIGS. 13*a* to 13*e*.

Figure 13G:
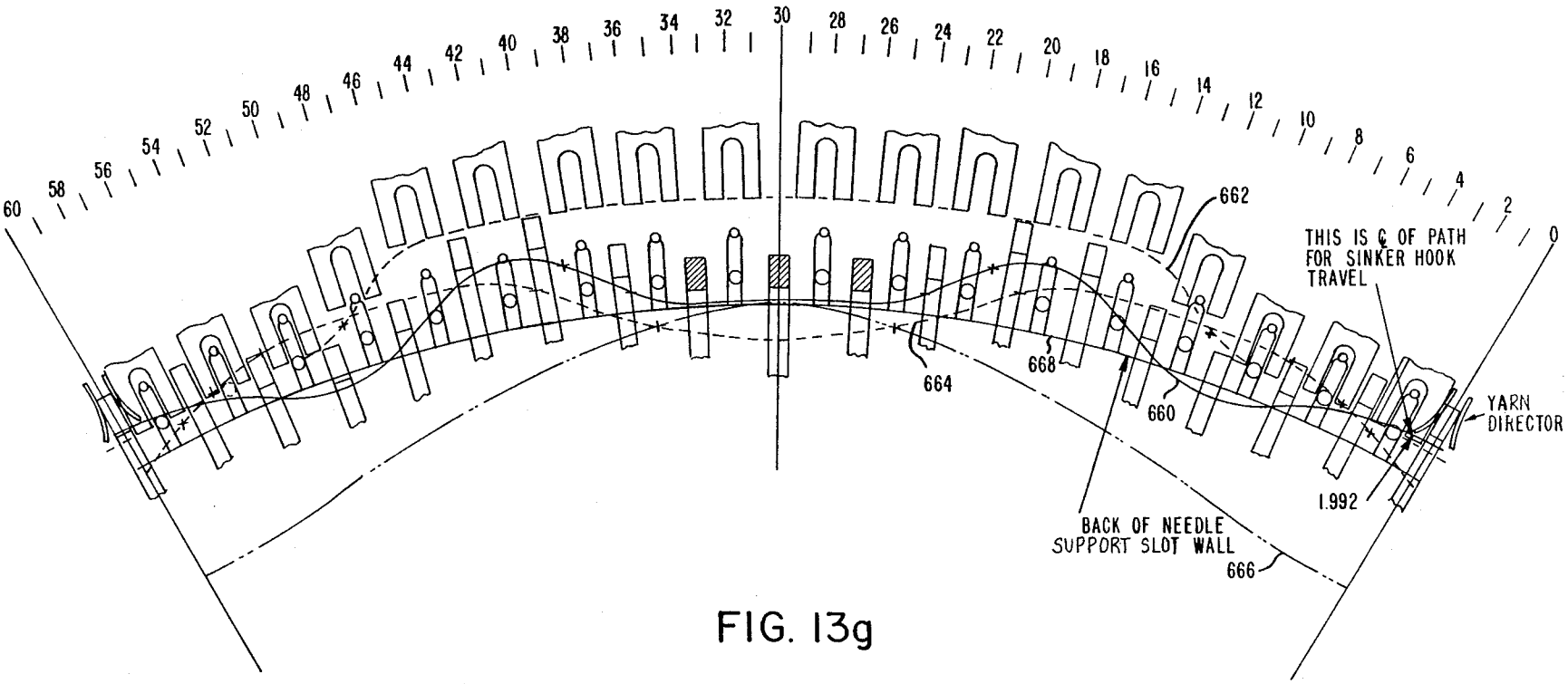

FIG. 13*g* is a schematic horizontal view that shows the relative radial (horizontal) positioning of the rake element, sinker element, terry instrument and shedder as the knitting cylinder element is rotated intermediate adjacent yarn feed locations.

FIGS. 14(1) through 14(18) are simplified schematic representations sequentially showing the relative positioning of the yarn engaging elements at the successively indicated angular locations with a 60° operating sector in general accord with the control paths depicted in FIG. 13.

Figure 15D:
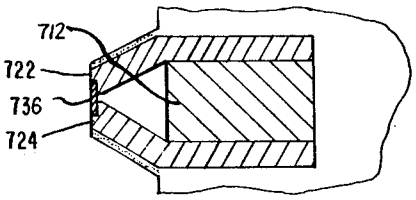
Figure 15C:
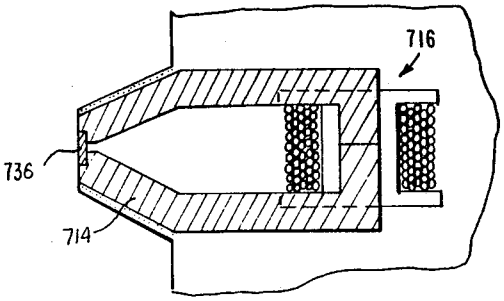
Figure 15A:
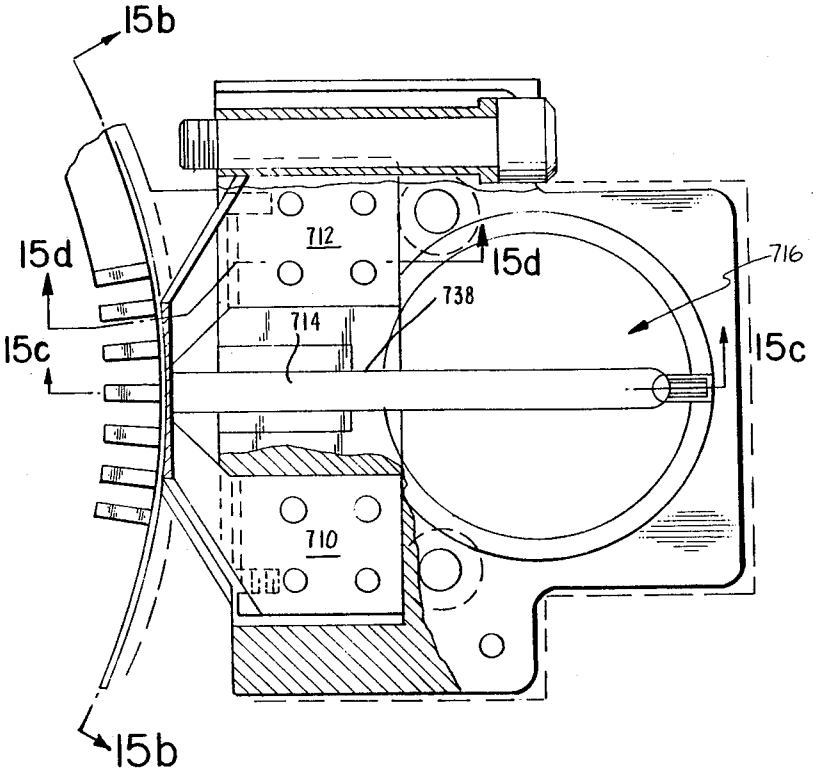
Figure 15B:
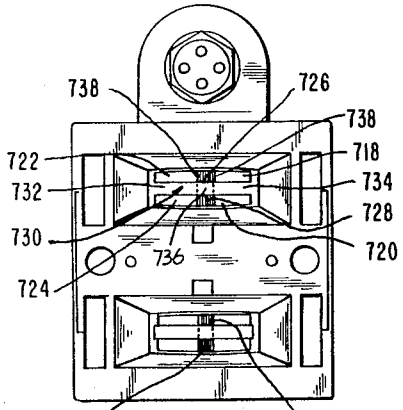

FIG. 15*a* is a plan view, partially in section of a modified and presently preferred construction for a magnetic retention assembly;

FIG. 15*b* is an elevational view as taken on the line 15*b*—15*b* on FIG. 15*a*;

FIG. 15*c* is a partial and enlarged vertical section as taken on the line 15*c*—15*c* on FIG. 15*a*;

FIG. 15*d* is a section on line 15*d*—15*d* of FIG. 15*a*.

Figure 16A:
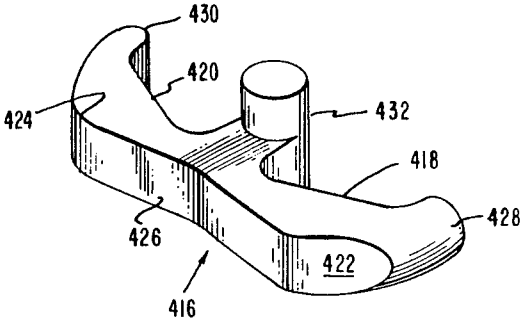
Figure 16C:
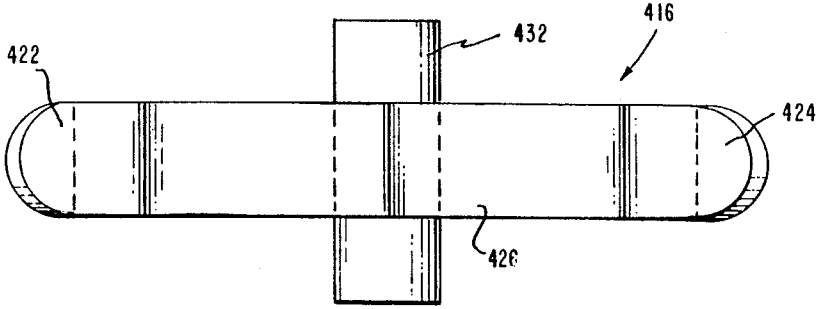
Figure 16B:
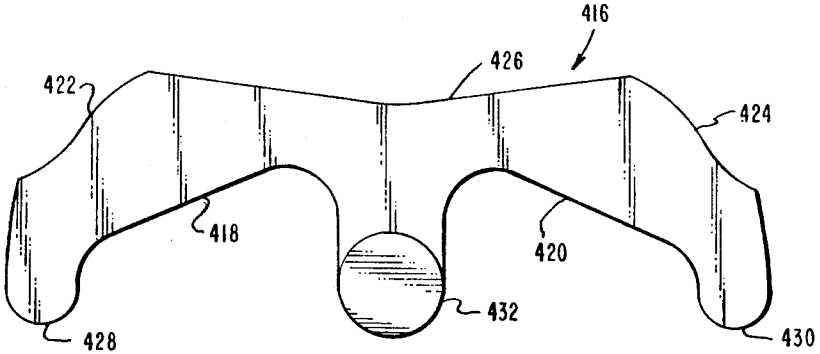
Figure 17:
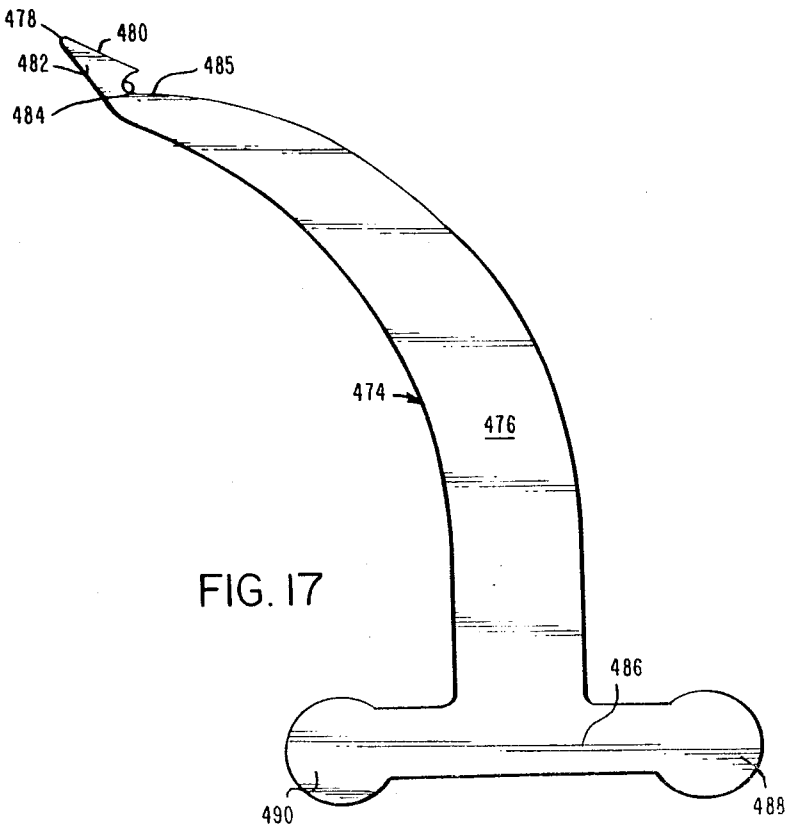
Figure 19:
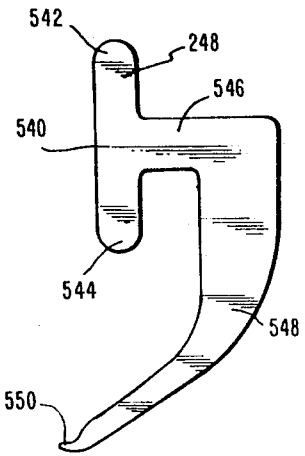
Figure 18C:
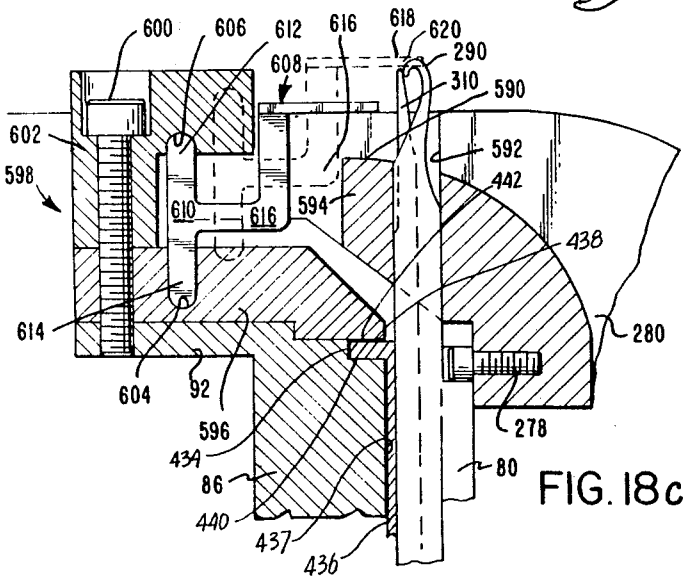
Figure 18A:
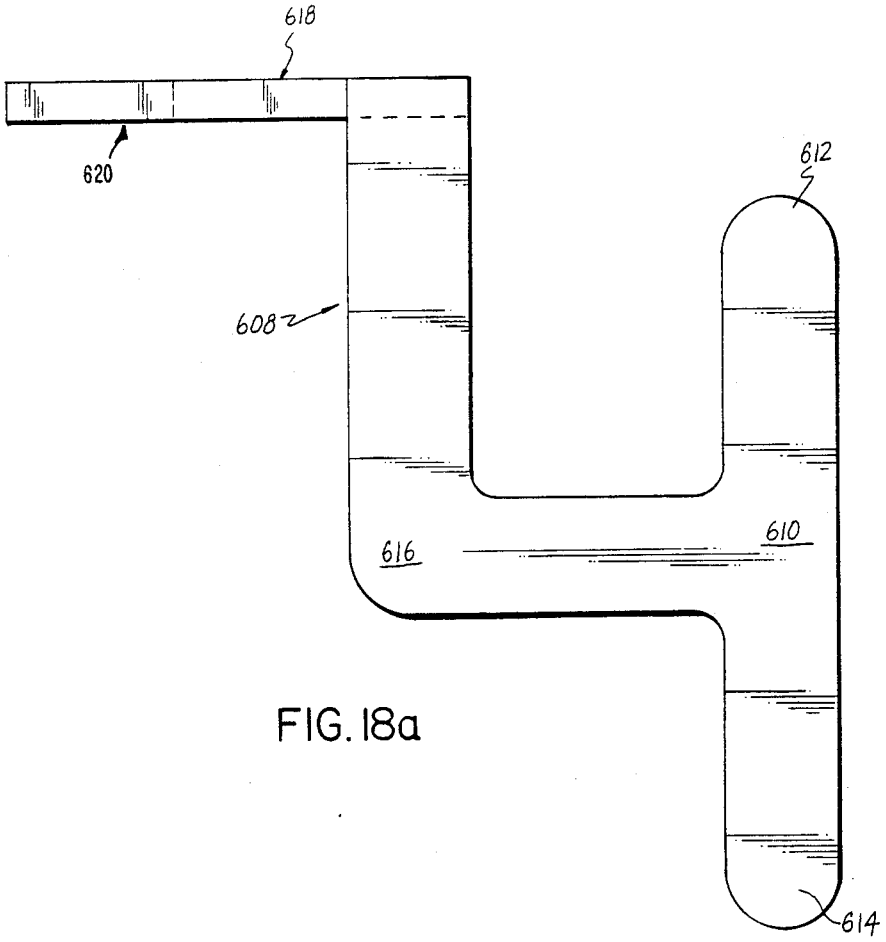
Figure 18B:
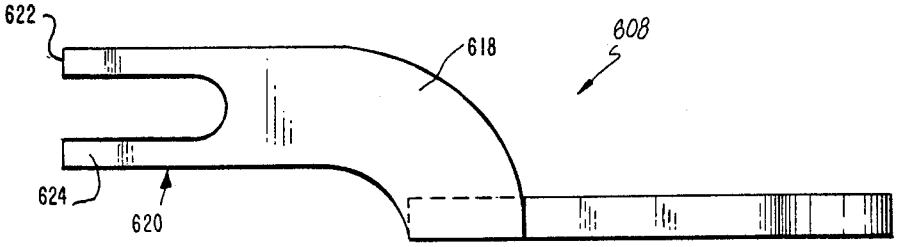
Figure 20:
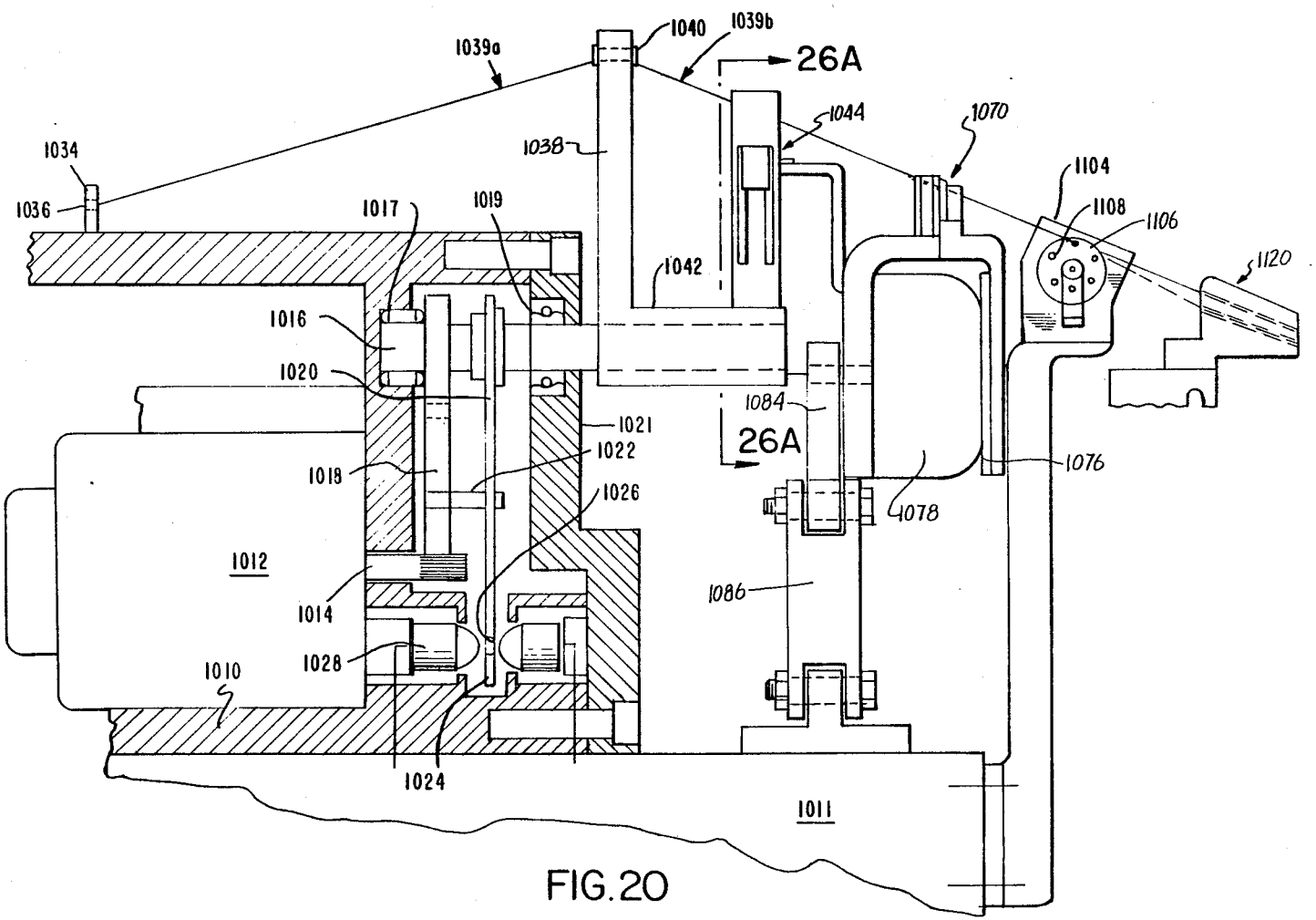
Figure 21:
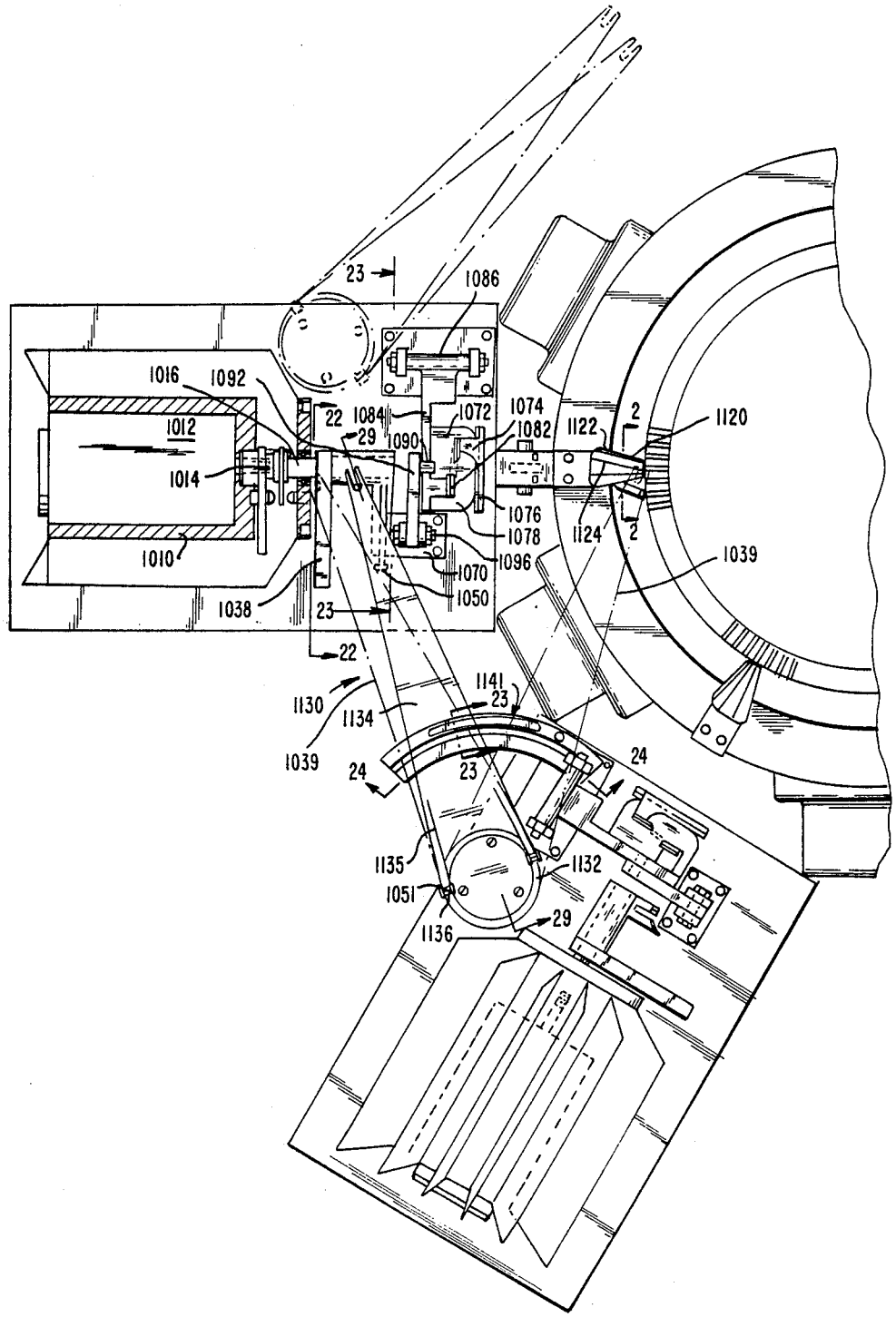
Figure 22A:
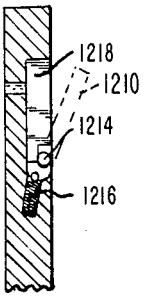
Figure 22:
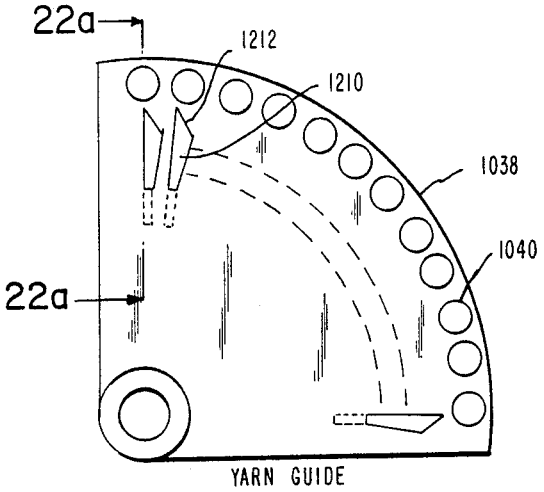

FIG. 16*a* is an oblique view of the presently preferred configuration for the presser cam;

FIG. 16*b* is a plan view of the presser cam illustrated in FIG. 16*a*;

FIG. 16*c* is a side view of the presser cam illustrated in FIG. 16*a*;

FIG. 17 is a plan view of the presently preferred configuration for the sinker element;

FIG. 18*a* is a side elevational view of a presently preferred configuration for a rake element;

FIG. 18*b* is a plan view of the rake element shown in FIG. 18*a*;

FIG. 18*c* is an enlarged sectional view showing the mounting of the rake assembly in the outer rake cam sleeve member;

FIG. 19 is a side elevation of a presently preferred configuration for a terry instrument;

FIG. 20 is a side elevation, partially in section, of a presently preferred construction for a yarn feed assembly;

FIG. 21 is a plan view, partially in section, of the yarn feed assembly components illustrated in FIG. 20;

FIG. 22 is a section taken on the line 22—22 of FIG. 21;

FIG. 22A is a typical section as taken on the line A—A of FIG. 22.

Figure 23:
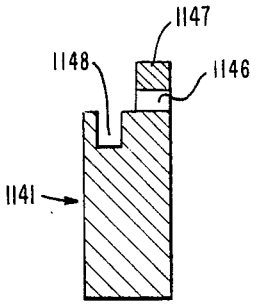
Figure 24:
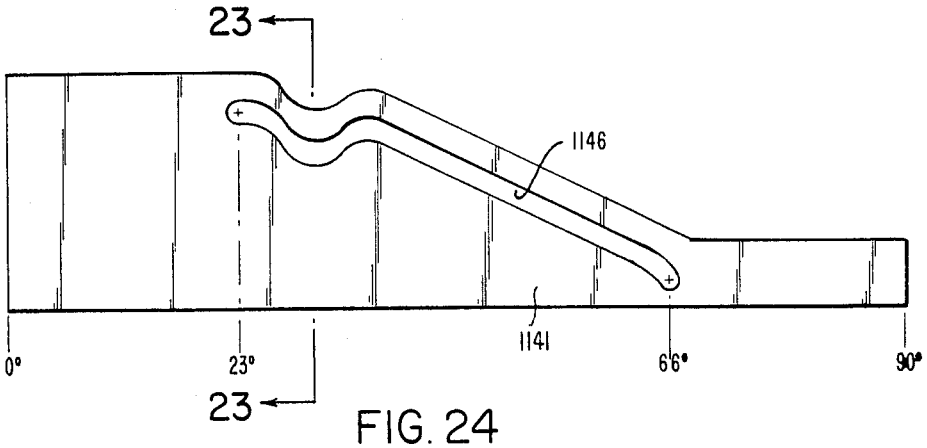
Figure 25:
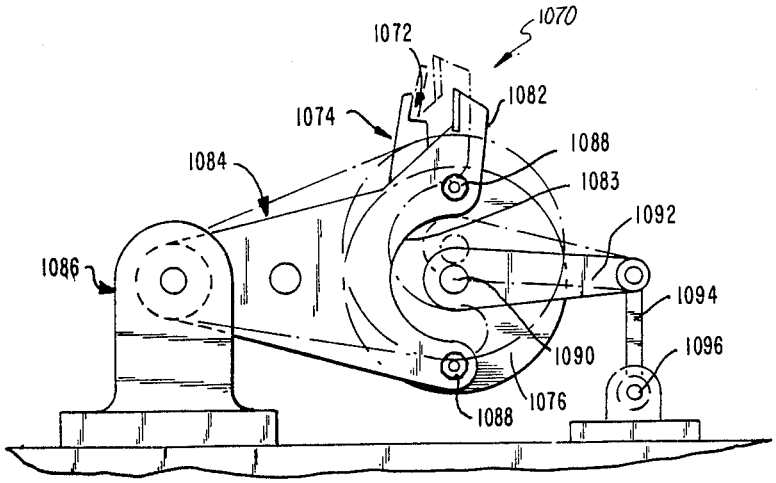
Figure 26C:
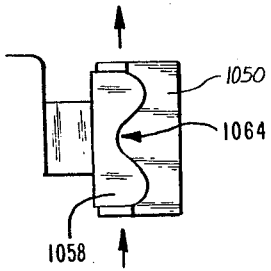
Figure 26B:
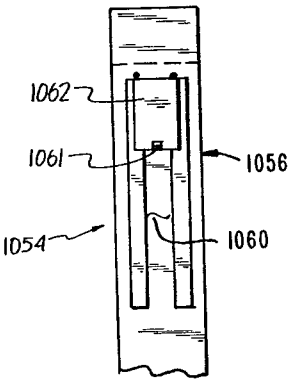
Figure 26A:
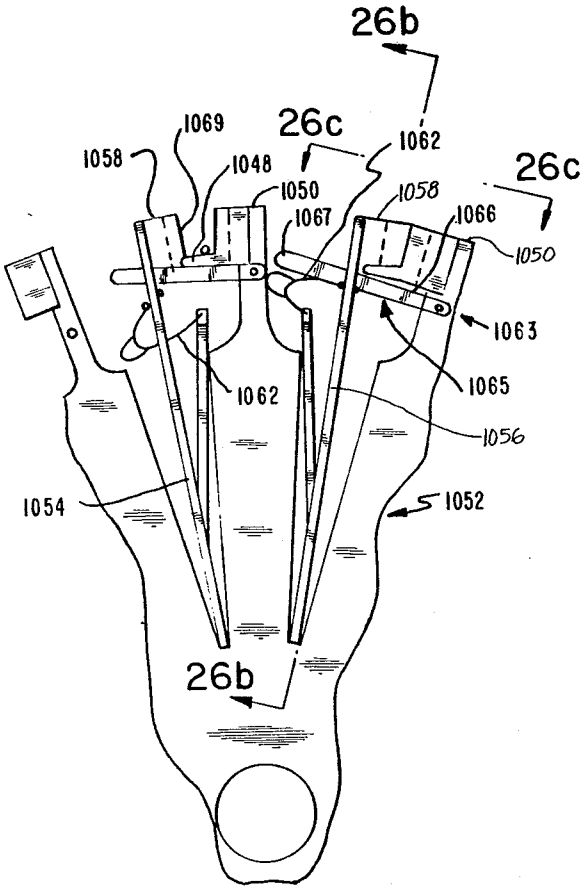

FIG. 23 is a section taken on the line 23—23 of FIG. 21;

FIG. 24 is a developed view of the track control cam taken on the line 24—24 of FIG. 21;

FIG. 25 is a section taken on the line 25—25 of FIG. 21;

FIG. 26A is a schematic sectional view of the yarn clamping members included in the yarn feed assembly;

FIG. 26B is a schematic elevation view of the moveable jaw member support element included in the yarn feed assembly as viewed from line B—B in FIG. 26A.

Figure 27:
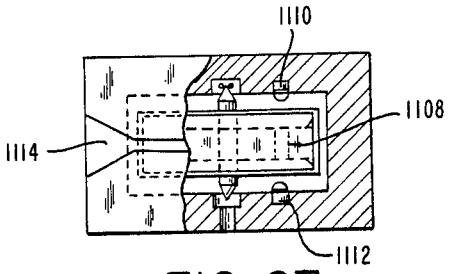
Figure 28:
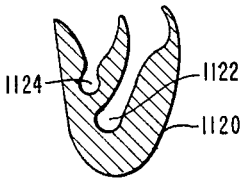
Figure 29:
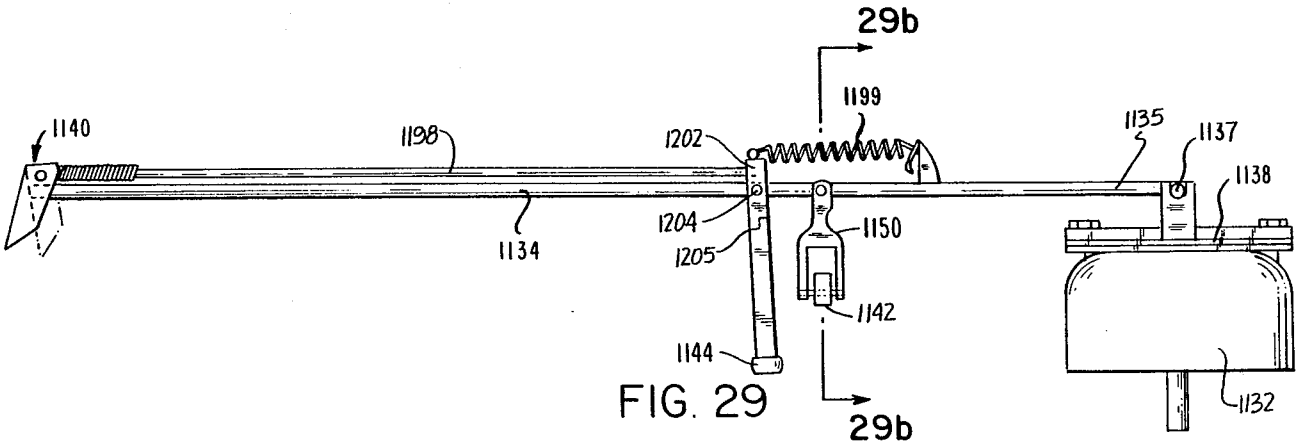
Figure 29A:
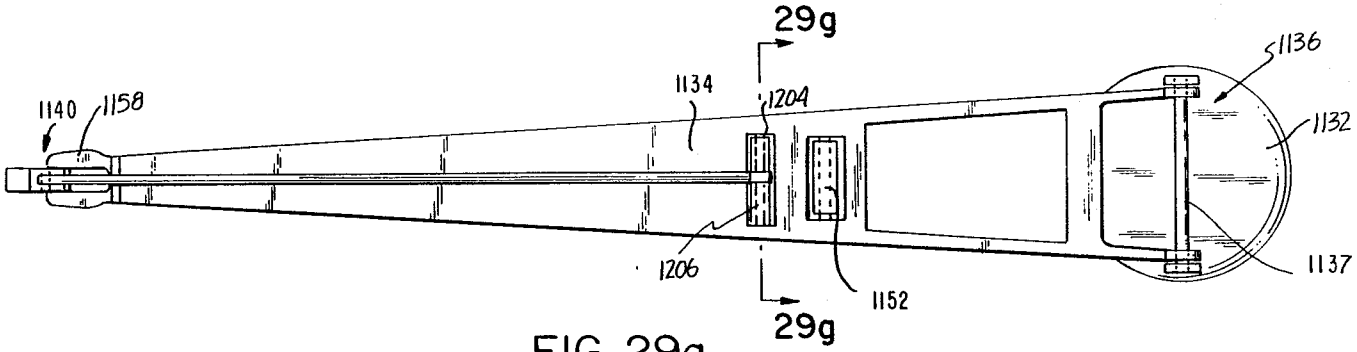

FIG. 26C is a schematic plan view as viewed from line C—C on FIG. 26A showing the surface configuration of the clamping members;

FIG. 27 is a top view, partially in section, of the body yarn use monitor assembly;

FIG. 28 is a section taken on the line 28—28 of FIG. 21;

FIG. 29 is a section taken on the line 29—29 of FIG. 21;

FIG. 29A is a plan view of the yarn selection carrier arm showing details thereof omitted from FIG. 21 in the interests of clarity.

Figure 30:
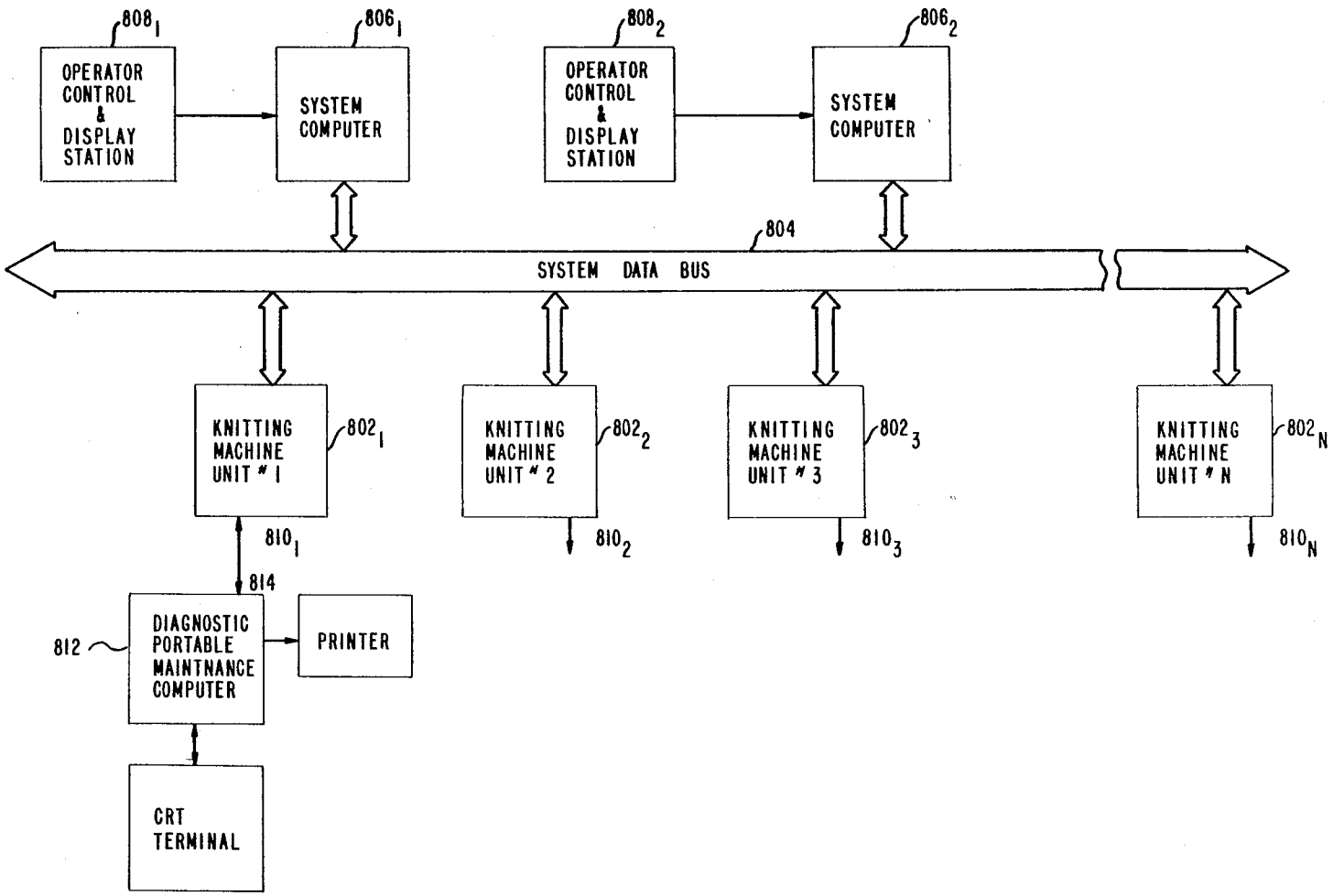
Figure 31A:
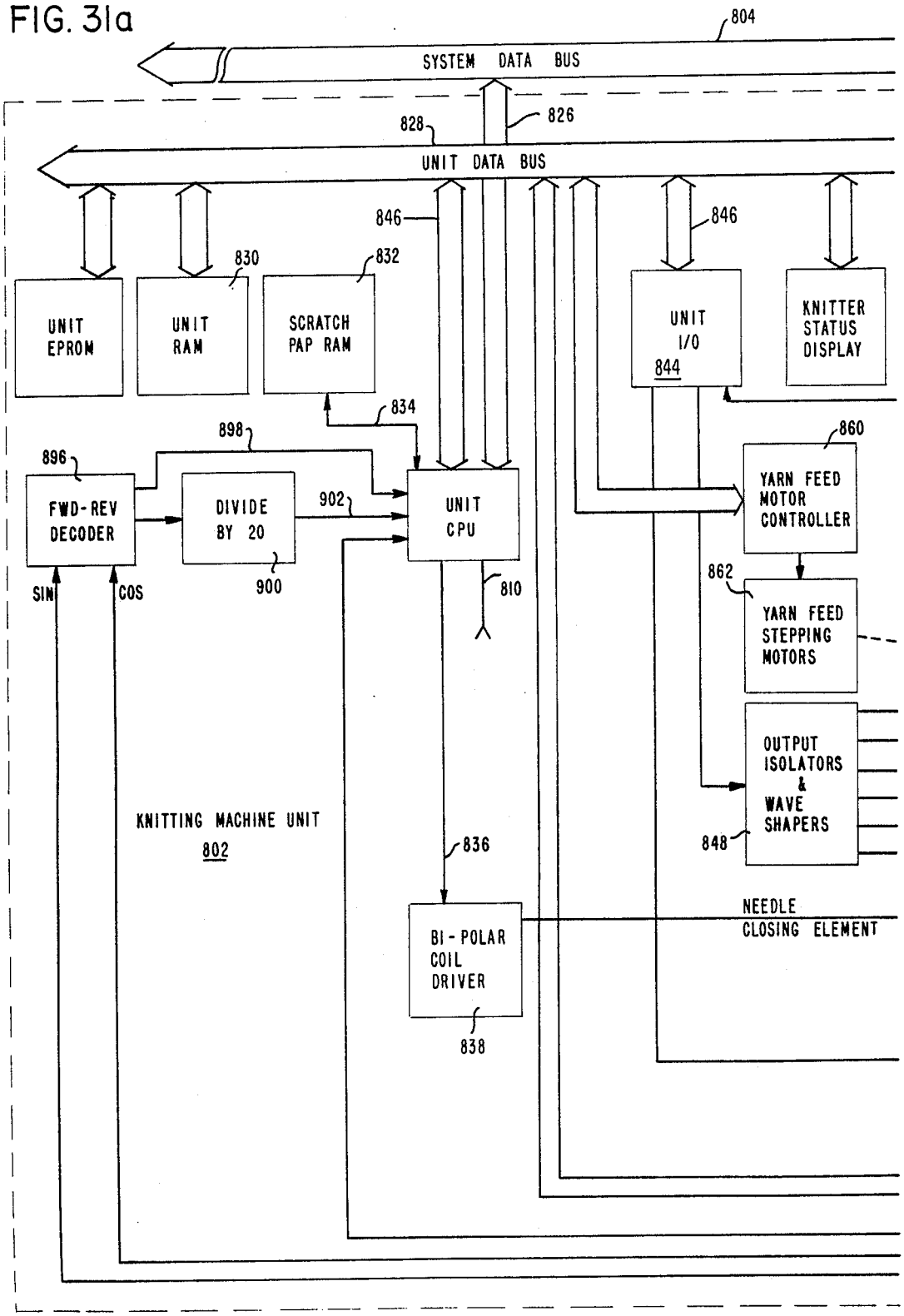
Figure 31B:
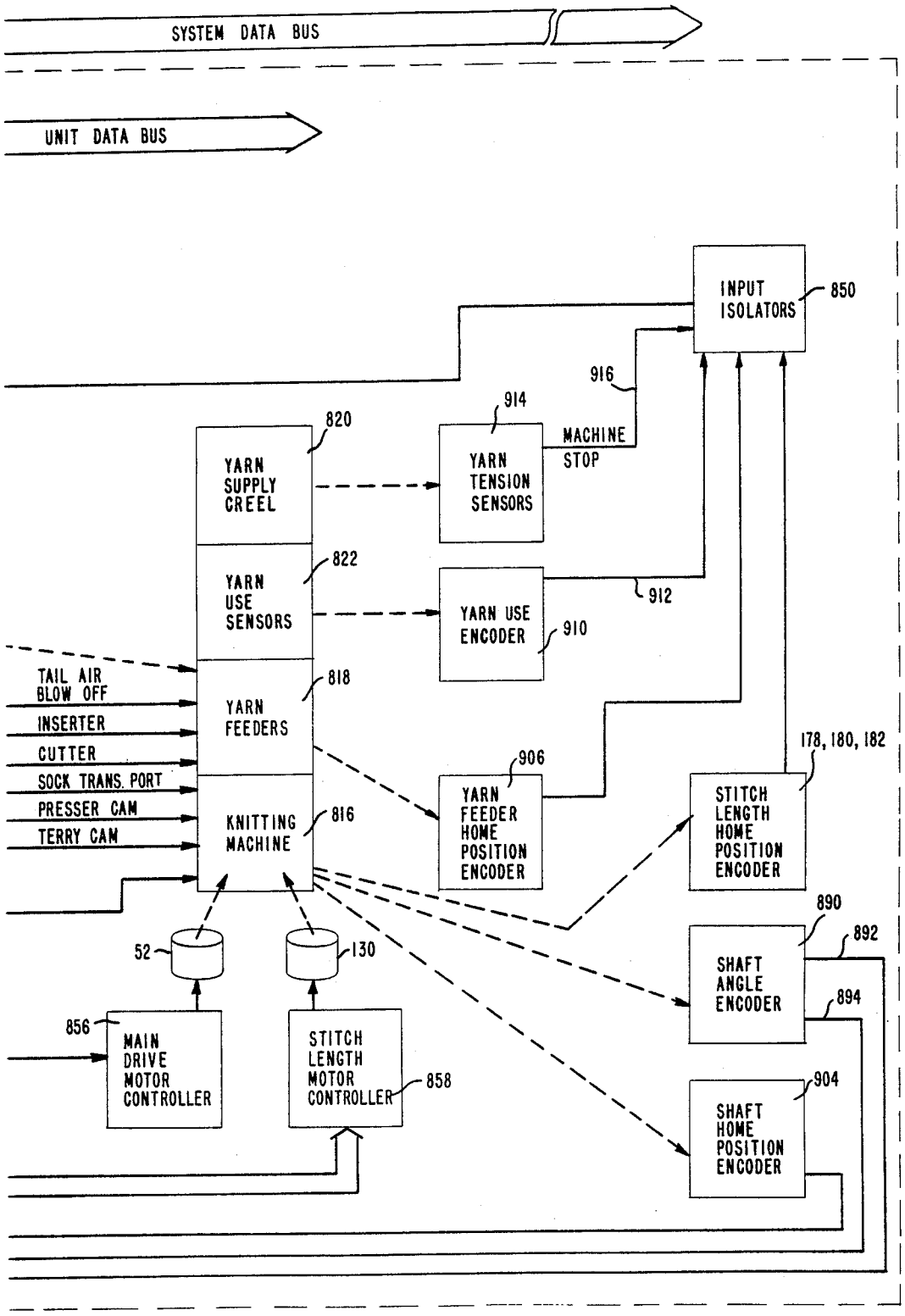

FIG. 29B is a section taken on the line B—B of FIG. 29;

FIG. 29C is an enlarged view, partially in section of the yarn engaging jaw components at the end of the yarn selection carrier arm;

FIG. 29D is an enlarged elevation, partially in section, as generally taken on the line D—D of FIG. 29C;

FIGS. 29E and F are details showing the two position detent control elements for jaw positioning;

FIG. 29G is a detail as generally taken on the line G—G of FIG. 29;

FIG. 30 is a simplified block diagram of a knitting system in which a plurality of knitting machine units are controlled from a central system computer;

FIGS. 31 A and B are a composite simplified block diagram of a knitting machine unit of FIG. 30;

FIG. 32 is a schematic diagram of a bipolar coil driver of FIG. 31.

Figure 34:
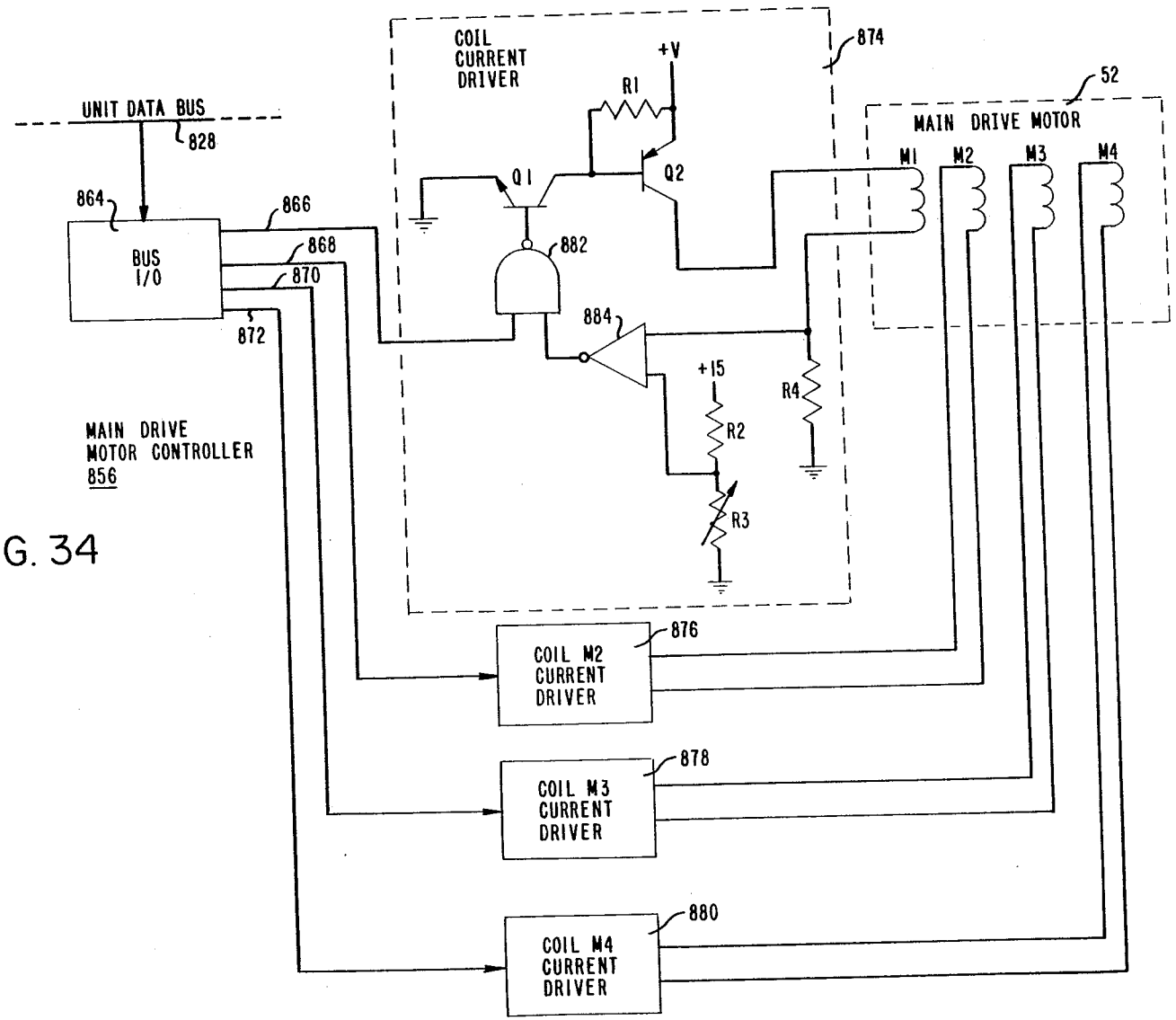
Figure 35A:
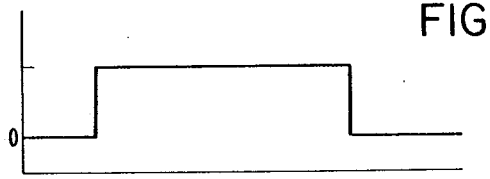
Figure 35B:
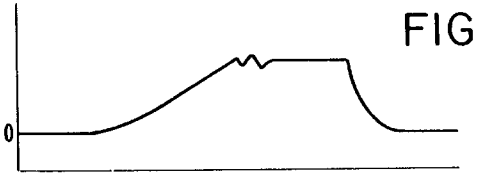
Figure 35C:
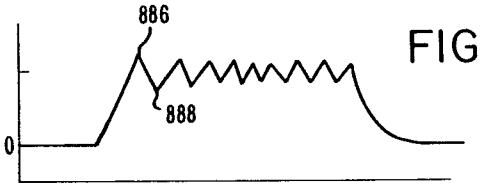
Figure 36:
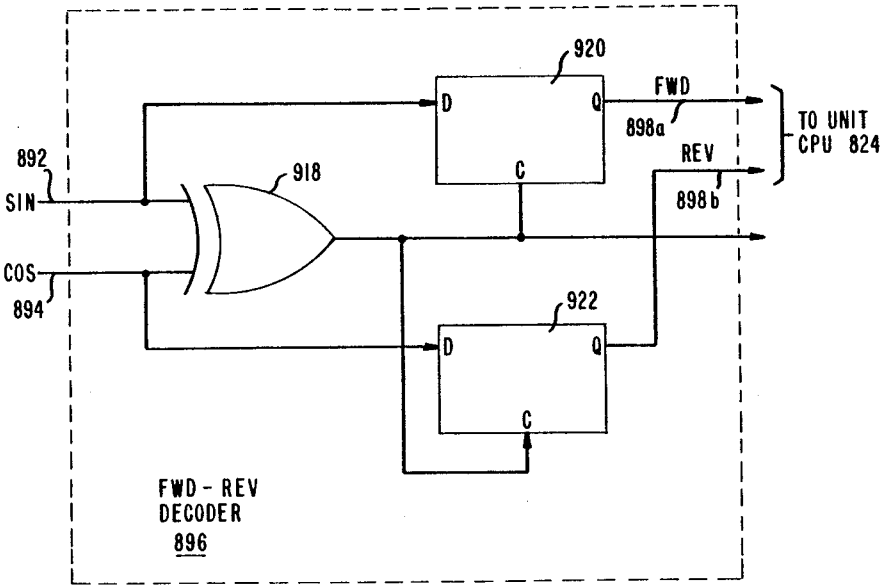

FIGS. 33A, B and C are voltage and current curves to which reference will be made in describing the wave shapers of FIG. 31;

FIG. 34 is a block schematic diagram of a main motor controller of FIG. 31;

FIGS. 35A through 35C are curves to which reference will be made in describing the operation of the main motor controller of FIG. 34; and FIG. 36 is a logic diagram of a forward-reverse decoder of FIG. 31.

As is apparent from a review of the above identified drawings, the disclosed circular weft knitting machine is made up of a number of structurally and operationally interrelated major and minor component subassemblages. In the interest of both convenience and clarity of description, the following portions of this specification will be subdivided, with appropriate titles, in general accord with such component subassemblages As will become equally apparent, while the hereinafter described embodiment is in the nature of a circular weft knitting machine that is primarily adapted for sock fabrication, the principles of the invention are broadly adaptable, with certain machine modifications, to circular weft knitting machines that are more primarily adapted to the fabrication of knitted fabrics and to ladies hosiery.

GENERAL MACHINE ORGANIZATION

Figure 1:
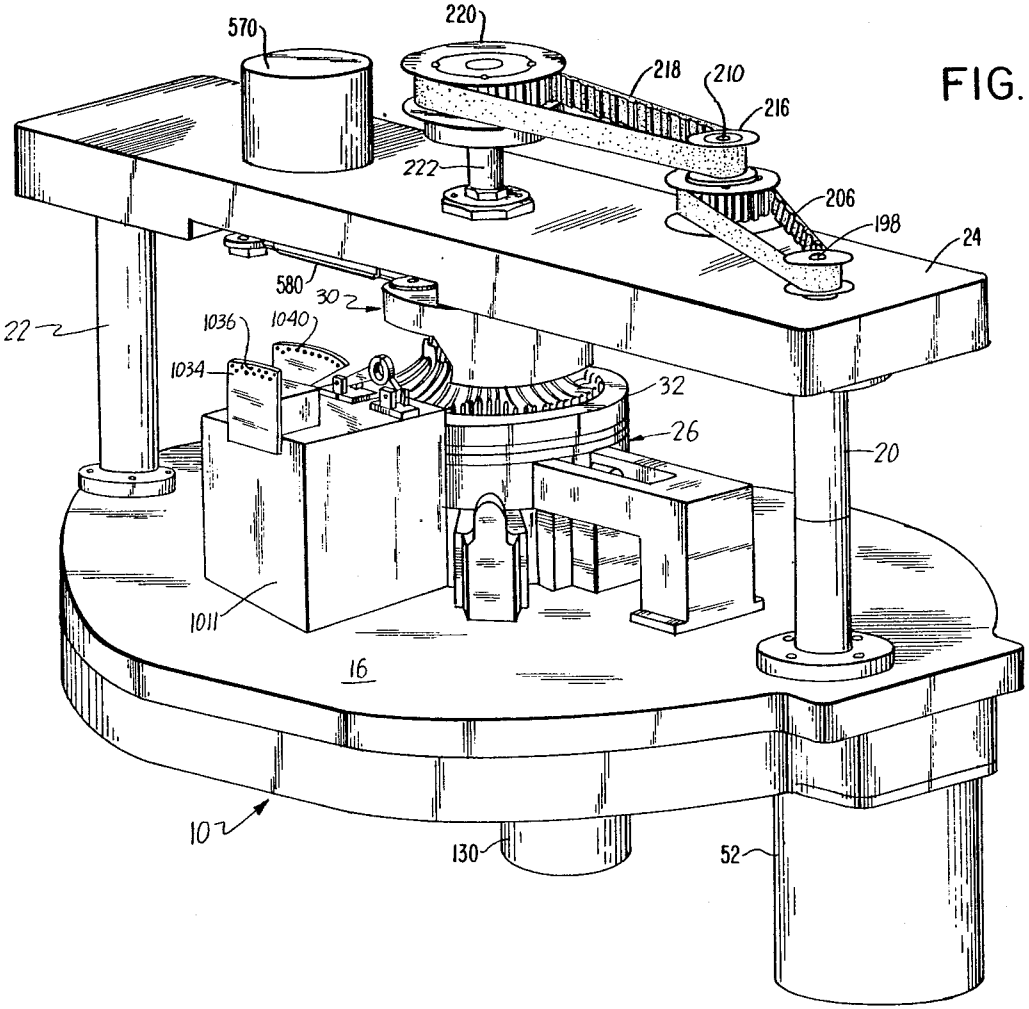
FIG. 1 is an oblique view schematically illustrative of the assembled machine and partially cutaway to show the relative positioning and general structural interrelationship of certain of the major components thereof.

Referring initially to FIGS. 1–5, and particularly to FIGS. 1 and 2, the subject machine includes a generally circular but selectively shaped lower housing plate member 10 having a central bore, generally designated 12, as also defined in part by the dependent cylindrical hub portion 14 thereof. The lower housing plate 10 generally serves as the basic motor and drive system mounting member and the cylindrical hub portion 14 serves as the basic support member for the presser cam sleeve member 364.

Disposed in superposed spaced relation with the lower plate member 10 is an annularly shaped upper housing plate member 16, which serves as the base plate for the subject machine and incorporates an enlarged central bore 18 coaxially aligned with, but spaced from, the aforesaid bore 12 in the lower housing plate member 10. Disposed in elevated spaced relation above the upper housing member 16 and supported by a pair of vertical columns, generally designated 20 and 22, is a terry instrument (or terry bit) dial support frame or beam member 24.

Disposed with the coaxially aligned bores 12 and 18 of the lower and upper housing plate members 10 and 16 respectively and disposed perpendicular thereto is the knitting needle support cylinder assembly, generally designated 26, having a sinker member assembly, generally designated 28, coaxially disposed at the upper end thereof. Disposed above the sinker member assembly 28 and in coaxial relation therewith is a terry loop dial and instrument assembly, generally designated 30, mounted on and suspended from the underside of the terry bit dial support beam or frame 24. Disposed essentially coplanar with the sinker member assembly 28 but located radially outwardly thereof is a rake member assembly, generally designated 32.

As will later become apparent, the sinker members in the sinker assembly 28; the terry instruments and shedder bars of the terry loop instrument assembly 30 and the rake members of the rake assembly 32, together with the hereinafter described compound needle element, generally comprise the yarn engaging members in the subject machine, whose configuration, displacement and modes of effecting operating element displacement form, both individually and in combination, definitive areas of novel and unobvious subject matter, as will hereinafter be described in detail and later claimed.

Preparatory to describing the structure and mode of operation of the subject machine, it should be preliminarily recognized that the construction and mode of operation thereof is such that it is particularly adapted to be software programmed to change the pattern or type of product being produced without the necessity for any manual change of the machine components or of its setup. It is particularly within the contemplation of this invention that each knitting machine to be described hereinafter may desirably comprise one of an indefinite number of such knitting machines forming parts of a knitting plant production system. Referring preliminarily to FIG. 30 for example, such a plant production knitting system, shown generally at 800, and which may be located in one or more buildings, includes a plurality of circular weft knitting machine units $802_1$, $802_2$ . . . $802_N$ each receiving data from and providing data to a system data bus 804. A system computer 806 is adapted to control the operation of each knitting machine unit and to monitor the operational status thereof That is, the system computer 806 serves as the source of knitting programs which can be fed individually to knitting machines $802_1$ to $802_N$. Thus, system computer 806 can instruct knitting machine unit 802 to produce a selectable number of pairs of socks of one size and/or pattern, while knitting machine unit $802_2$ may be engaged in producing a different number of socks of a different size and/or pattern and so forth, with change from size to size and/or pattern to pattern in each knitting machine unit being determined by commands from system computer 806.

An operator control and display station 808 is provided to permit the entry of commands into the system computer 806 for execution by knitting machine units and also to display status, production and other data collected from the remainder of the system by system computer 806. Each of knitting machines $802_1$, $802_2$ . . . $802_N$ includes a diagnostic data jack $810_1$, $810_2$ . . . $810_N$ respectively to which portable diagnostic display unit 812 may be interfaced using a jack 814. Diagnostic display unit 812 is for use by a maintenance technician for detailed analysis of machine performance during scheduled or unscheduled maintenance.

MAIN DRIVE SYSTEMS

The enclosed space disposed intermediate the upper and lower housing plate members 16 and 10 serves to generally contain the drive system components for both the main compound knitting needle support cylinder drive and for the stitch length control drive as well as certain components of the terry dial drive system.

Knitting Needle Support Cylinder Drive System

To the above ends, a main drive motor mounting frame member 40 is secured to an appropriately sized recess 42 in the periphery of the lower housing plate member 10, as by bolts 44 through the complemental shoulders 46. The outer perimetric wall portion 48 of the motor mounting frame 40 is secured to the underside of the upper housing member 16 by elongate bolts 50. Suspended from the underside of the motor mounting frame 40 an secured thereto by said bolts 50 is the main stepping drive motor 52.

The drive shaft 54 of the main drive stepping motor 52 extends vertically upward through a suitable bore 56 in mounting plate 40. Secured to the drive shaft 54 is the tapered base hub portion 58 of an elongate drive shaft extension 60 which extends upwardly through a hollow column 20 to provide for delivery of power to the terry dial assembly 30 mounted on the frame 24. Peripherally mounted on the base hub portion 58 of the drive shaft extension and secured thereto for conjoint rotation with the motor drive shaft 54 is the main drive pulley 62 for the knitting cylinder drive. The main drive pulley 62 is secured to the hub 58 by means of a key 64 and clamping nut 66.

Mounted within the central bore 12 defined by the lower housing plate 10 and terminally secured to an integral inwardly extending shoulder 74 at the upper end of the dependent hub portion 14 of the lower plate member 10, as by bolts 76, is the lower end of a nonrotatable, stationary and upwardly extending inner cam track sleeve member 78.

Disposed in sliding interfacial relation with the exterior surface of such stationary inner cam track sleeve member 78 is an elongate rotatably displaceable knitting needle support cylinder 80 having a plurality of longitudinally disposed radial slots 82 (see FIG. 6) on its outer surface, each adapted to contain and guide the path of displacement of individually displaceable compound needle elements, generally designated 84.

As also best shown in FIG. 2, surrounding the rotatably displaceable knitting needle support cylinder 80 is a nonrotatable, stationary and upwardly extending outer cam track sleeve member 86. The dependent end of the stationary outer cam track sleeve member 86 is supported on the periphery of an internally threaded stationary elevator ring 88 mounted on the inner marginal edge of the upper housing plate member 16 and held in locked engagement therewith by a clamping ring 90. As illustrated, the clamping ring 90 and the elevator ring 88 are secured to the inner marginal edge of the upper housing plate member 16 by bolts 92 and, together with the stationary outer cam track sleeve member 86, held in upright position thereby, comprise a set of stationary and nonrotating machine components together with the aforesaid inner cam track sleeve member 78.

As also best shown in FIG. 2, the knitting needle support cylinder 80 is supported on the rotatable inner race 102 of an antifriction bearing 104 suitably a ball bearing. In more detail, the lower portion of the knitting needle support cylinder 80 includes a peripheral external shoulder 100 which rests upon the upper surface of the inner bearing race 102. The knitting needle support cylinder 80 is compressively biased into friction tight supporting relation with such inner bearing race 102 of the bearing 104 by the clamping ring 106 threadedly engaged with the dependent end of the knitting needle support cylinder and the interposed cylindrical hub 108 of the knitting needle cylinder drive pulley 110. The cylindrical hub 108 of drive pulley 110 is also keyed to the knitting needle support cylinder 80 as at 112, to insure conjoint rotative displacement thereof. The stationary outer race 114 of the roller bearing 104 is mounted in the hub portion of an elevator nut 172 by a locking ring 116. As will later be described in detail, the elevator nut 172 is threadedly engaged with the elevator ring 88 and forms the hub of the stitch length control gear 168.

As will now be apparent, rotation of the main drive motor drive shaft effects commensurate rotation of the drive pulley 62 mounted thereon, and which in turn is transmitted, through timing drive belt 68, into rotative displacement of the knitting needle support cylinder drive pulley 110 in accord with the relative effective radii thereof. Rotation of the drive pulley 110 in turn is transmitted through the inner race 102 of anti-friction bearing 104 into commensurate rotative displacement of the knitting needle support cylinder 80 relative to the stationary inner and outer cam track sleeves 78 and 86 respectively.

The main drive motor 52 is of the "stepping" type, suitably a SLO-SYN M112 FN motor as manufactured by the Superior Electric Corp. of Bristol, Conn. As will hereinafter become more apparent and by way of specific example, the specifically disclosed circular weft knitting machine includes six 60° operating sectors within the 360° circumference of the knitting cylinder 80. Each of these sectors is defined by adjacent yarn feed locations and thus includes a yarn feed station at both the start and termination of a sector, i.e. at the 0° and 60° radii and a needle and closing element selection point at the 30° or midsector point between the adjacent and sector defining yarn feed stations. Each operating sector is sized to accommodate 18 needle members therewithin at all times and, as such, the specifically illustrated knitting cylinder 80 has 108 compound needle containing longitudinal slots on the outer surface thereof.

In the preferred embodiment, the stepping drive motor 52 provides 10 discrete steps of rotative displacement per compound needle element slot width and associated land width and makes one revolution for each 60° or single sector rotative displacement of the cylinder 80. Under such circumstances, the motor 52 provides 1080 discrete steps of advance (in either direction) for each revolution of the knitting cylinder 80 or 180 discrete steps of advance (and again in either direction) for each 60° or single sector displacement thereof. The above identified SLO-SYN motor is adapted to be controlled directly by an IM 600 Microprocessor Controller as also manufactured by Superior Electric and such motor is capable of being accelerated to 3,000 r.p.m. within 40 steps, that is, it can reach full speed within a displacement of a knitting cylinder within subsector in the span of four needle members.

As will be later pointed out, the motor 52 is desirably fitted with an integral optical encorder which emits one marker pulse per revolution on one channel and which emits two 90° phased pulses per motor step on a second channel to provide a continual indication of the angular position of drive shaft 54 and the direction of rotation thereof.

Stitch Length Control System

In a manner generally similar to that described above, a stepping motor mounting frame 120 is secured to a recess 122 in the periphery of the lower housing plate member 10, as by bolts 124. A peripheral skirt 126, suitably secured to upper housing plate member 16 serves to enclose a gear containing recess disposed intermediate the stepping motor mounting frame 120 and the upper housing 16. Suspended from the underside of the mounting frame 120, as by bolts 128, is a stitch length control stepping motor 130.

The drive shaft 132 of the stitch length control stepping motor 130 has a spur gear 134 mounted thereon and keyed thereto for conjoint rotation therewith. Rotation of the drive shaft 132 and spur gear 134 is transmitted to intermediate gear 136 mounted on and keyed to vertical stub shaft 138. Stub shaft 138 is supported at its lower extremity in the inner race 140 of anti-friction bearing 142, the outer race 144 of which is fixedly mounted in a suitable aperture on frame member 120. Intermediate support for the stub shaft 138 is provided by an anti-friction bearing 146 mounted in a supporting shelf 148 forming part of the lower housing plate member 10. Mounted at the upper end of stub shaft 138 and appropriately keyed thereto is a second intermediate gear 150. The second intermediate gear 150 in turn drives a third intermediate gear 152 mounted on and keyed to a second stub shaft 154 disposed in coaxial alignment with motor drive shaft 132. The lower end of the second stub shaft 154 is shaped to define an enlarged bore 156 sized to contain the upper end of the motor drive shaft 132 with an interposed needle type of antifriction bearing 158. As will be now apparent, the interposition of such antifriction bearing 158 intermediate the motor shaft 132 and stub shaft 154 permits selective rotation of each of said shafts independent of the other except for, of course, rotation of stub shaft 5 derived through the above described gear train. The upper end of the second stub shaft 154 is mounted in the inner race 160 of an antifriction bearing 162, the outer race of which is mounted in a suitable recess 164 of the upper housing plate member 16. Also mounted on the second stub shaft 154 and appropriately keyed thereto for conjoint rotation therewith is a fourth intermediate gear 166, which, in turn, drives the stitch length control gear 168. As will not be apparent, rotation of the stepping motor drive shaft 132 is directly transmitted through reduction gears 134, 136, 150, 152 and 166 into smaller but proportional increments of rotative displacement of the stitch length control gear 168.

The stitch length control gear 168 is mounted on the periphery of the hub portion 170 of the elevator nut 172, the upper portion of which is threadedly engaged, as at 174, to the stationary elevator ring 88 The hub portion 170 of the elevator nut 172 is mounted on and secured to the outer race 114 of antifriction bearing 104 by locking ring 116 and is thereby rotatably displaceable relative to both the rotatably displaceable knitting needle support cylinder 80 and to the stationary elevator ring 88, the stationary outer cam track sleeve 86 and stationary clamping ring 90. Rotative displacement of the stitch length control gear 168 effects a concomitant rotative displacement of the outer bearing race 114 and elevator nut 172 relative to the stationary elevator ring 88. This latter relative rotative displacement results in an accompanying vertical displacement of the elevator nut 172, the entire antifriction bearing 104, the knitting cylinder drive pulley 110, the knitting needle support cylinder 80 and the sinker member assembly 28 mounted on the upper end thereof.

In the illustrated embodiment the control gear 168 is adapted to effect permissible maximum/minimum vertical knitting cylinder displacement in one revolution. As will later become more apparent, the change in elevation of the knitting cylinder 80 does not effect a change in the locus of vertical compound needle element displacement since the latter is controlled entirely by the control cam tracks in the stationary inner and outer cam track sleeve members 78 and 86 respectively The change in knitting cylinder elevation does however effect a commensurate change in the elevation of the cam track housing of the sinker member assembly 28 and in a concomitant elevation of the yarn engaging sinker members relative to the fixed elevation vertical displacement paths of the compound needle members 84 with a consequent variation in stitch length in accord with knitting cylinder 80 elevation.

As will later become apparent, the elevation of the sinker members through rotation of the control gear 168 may be effected in response to the actual amount of yarn used per course in the fabrication of an article. Such is readily effected by measuring the amount of yarn used per course, comparing the measured amount with a preknown standard value for the article being fabricated and then adjusting stitch length through modification of sinker assembly elevation to correct any sensed departures from the predesired value thereof As shown in FIG. 2, the elevator nut 172 and hence the knitting cylinder 80 and sinker assembly 28 is at the maximum permitted elevation which is production of the maximum possible length of stitch. As will be apparent from the foregoing, vertical displacement of the knitting cylinder 80 is effected through controlled rotative displacement of the stitch length control gear 168 from a known base point, settable at the machine fabrication location and which will be effectively the same for all machines in a computer controlled system as contemplated herein. To the above ends, a light source 178 is mounted on the inner wall of the main motor mounting frame 40, a light-responsive photo cell 180 is disposed in the underside of the upper plate 16 and a suitably located aperture 182 in the stitch length control gear 168 is disposed coaxially therewith to permit generation of an appropriate electrical signal when the interposed aperture 168 permits passage of a light beam from the source 178 to the photo cell 180.

Figure 3:
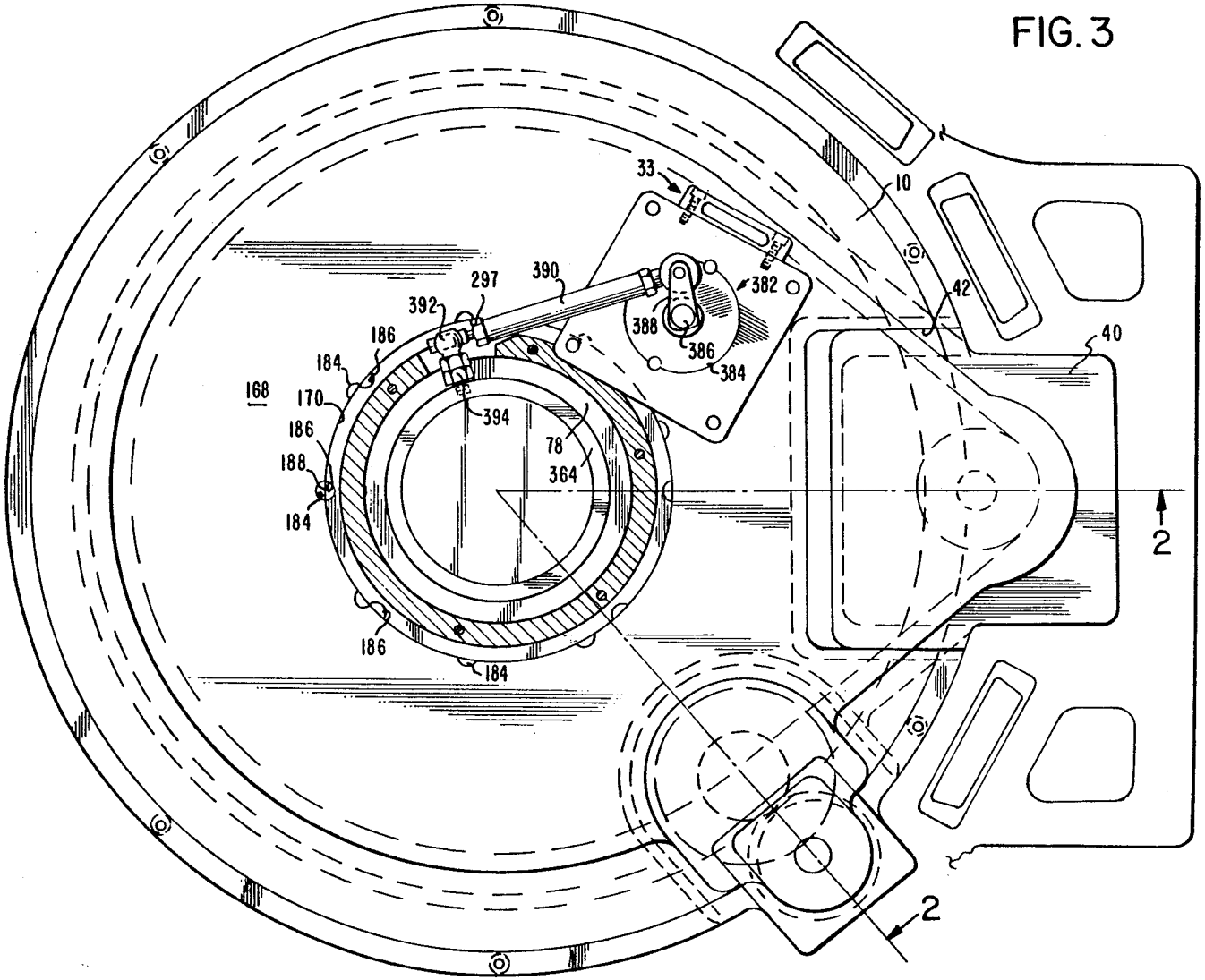
FIG. 3 is a horizontal section as taken on the line 3—3 of FIG. 2.

Associated with the above described photo cell signal system is a vernier type mounting for prelocating the stitch length control gear 168 on the hub 170 of the elevator nut 172. As best shown in FIGS. 2 and 3 the outer periphery of the hub 170 of the elevator nut 172 includes a plurality, suitably eight, of equally spaced semicircular recesses 186 therein. The facing surface of the bore of the stitch length control gear 168 includes a greater number of similarly sized and shaped recesses 184, suitably nine, therein. The eight/nine grouping of recesses provides a vernier type control for presetting of the stitch length control system.

At the time of machine assembly at the factory or the like, the height of the knitting cylinder 80 is preset to a standard value by rotation of the elevator nut 172 relative to the elevator ring 88. When the knitting cylinder height is so preset, establishing a standard or base stitch length, the aperture 186 in the stitch length control gear is coaxially aligned with the light source 178 and photo cell 180. With the control gear so aligned a locking pin 188 is placed in the matching aperture 184/186 to fix the position of the stitch length control gear 168 relative to the elevator nut 172 and hence to the knitting cylinder 80. As will now be apparent, all machines will thus be factory preset to the same base stitch length control standard, which permits all machines to use the same central computer program to knit the same goods In the operation of the above system in the production of knitted articles, all machines may be synchronized at the start of a given operation by driving the control gear to the signal producing base position, which could be, for example, maximum knitting cylinder elevation and hence maximum stitch length and then effecting desired stitch length through computer control of the stepping drive motor 130.

A further signal advantage of the above described stitch length control mechanism is its capability of providing a readily sensible indication of the degree of machine wear, particularly of the hereinafter described control cam tracks and/or the hereinafter described needle and closing elements of the compound needles, as such wear is reflected in a departure of stitch length from standard values thereof

Terry Dial Drive System

As previously pointed out, the tapered base hub portion 58 of an elongate drive shaft extension 60 is secured to the main motor drive shaft 54 and the main drive pulley 62 is mounted thereon. As best shown in FIGS. 2, 5A and 5B, the drive shaft extension 60 extends upwardly through hollow column 20 mounted on the surface of the upper housing plate 16. Disposed in telescoping coaxial arrangement with the hollow column 20 is a second hollow column 190 suspended from the underside of the terry dial support frame 24. The upper end 192 of the drive shaft extension 60 is splined, as at 194, for separable driving engagement with the sleeve 196 mounted on the dependent end of stub shaft 198. As will now be apparent, the aforesaid construction permits the terry dial supporting frame 24 and all components mounted thereon to be lifted and separated from the remainder of the machine components.

The stub shaft 198 is intermediately mounted in a pair of antifriction bearings 200 and 202 mounted in terry dial support frame 24. Mounted on the upper extending end of the stub shaft 198 above the upper surface of the terry dial supporting frame 24 (see FIG. 5A) is the main terry dial drive pulley 204 The main terry dial drive pulley 204 is connected by a timing belt 206 to a first intermediate pulley 208 mounted on a stub shaft 210 supported by spaced antifriction bearings 212 and 214 in terry dial supporting frame 24. Mounted above the first intermediate pulley 208 on stub shaft 210 is a smaller diameter second intermediate pulley 216. The second intermediate pulley is connected by a second timing belt 218 to the terry dial drive pulley 220 mounted on the terry dial assembly drive shaft 222.

The terry dial assembly drive shaft 222 is supported by a pair of antifriction bearings 224 and 226 disposed within an externally threaded sleeve 228. The threaded sleeve is mounted within a threaded bore 230 in the terry dial support frame 24 and, as will later become apparent, such threaded mounting permits adjustment of the vertical position of the terry loop instrument dial assembly 30 relative to the knitting cylinder assembly 26 and the sinker member assembly 28.

The dependent end 232 of the terry dial drive shaft 222 extends below the underside of the terry dial support frame 24 and serves as the support for the terry loop dial assembly, generally designated 30. More specifically, the terminal end thereof has the rotatable terry dial retainer cap 234 bolted thereto as at 236. The dependent end 232 of the terry dial drive shaft 222 is positioned by a pair of antifriction bearings 240 and 242, the outer races of which are disposed within the bore 244 of the hub of the stationary terry dial assembly cam track housing member 246.

As will now be apparent, the rotatable terry dial 238 having the terry bits or instruments 248 and the hereinafter described shedder bars 552 mounted therein is rotatably displaced relative to the cam track housing 246 in response to rotative displacement of terry dial drive shaft 222, which in turn through pulleys 220, 216, 208, stub shaft 198 and extension shaft 60, is driven by the main stepping drive motor shaft 54 in conjunction with above described rotative displacement of the knitting cylinder 80.

Knitting Cylinder

Referring initially to FIGS. 2 and 6–8, the knitting needle support cylinder 80, as described above, is disposed intermediate the stationary inner and outer cam track sleeves 78 and 86 respectively and is rotatably displaceable in either direction in direct response to rotation of the drive shaft 54 of the main drive stepping motor 52. As best shown in FIGS. 6–8, the knitting needle support cylinder 80 essentially comprises a thin walled cylindrical sleeve having a multiplicity of elongate, equally spaced, radially oriented narrow compound needle element containing and guiding slots 82 disposed on its outer surface Suitably, and as generally noted above, a preferred embodiment may include 108 slots each adapted to contain a compound needle member and conveniently divisible into six 60° operating sectors, each intermediate a pair of adjacent yarn feed locations and with each sector adapted to encompass compound needle elements at any given instant of time. As previously noted in conjunction with the foregoing description of the knitting cylinder support and drive system, the knitting cylinder 80 includes an external perimetric flange 258 defining the shoulder 100 that rests upon and is supported by the inner race 102 of the antifriction bearing 104 (see FIG. 2). As also previously described, the dependent terminal end of the cylinder 80 is externally threaded, as at 260, to threadedly receive clamping nut 106 which locks the knitting cylinder 80 into rotatable supported engagement with the knitting cylinder drive pulley 110.

Within each of the elongate, radially oriented slots 82, the portion of wall of the cylinder forming the base of the slot includes a pair of elongate spaced slot-like apertures 262 and 264. The apertures 262 and 264 are, in the transverse direction, sized to closely accommodate and maintain the radial positioning of the hereinafter described inwardly directed cam butts on the needle and closing elements forming the compound needle members and to permit operative access thereof to the displacement control cam tracks on the outer surface of the inner cam track sleeve member 78. The apertures 262 and 264 are sized in the longitudinal direction to accommodate the limits of independent vertical reciprocation of such needle and closing elements as the extent of such vertical displacement is determined by the configuration of the control cam tracks in the outer surface of the inner cam track sleeve member 78 plus the additional distance required to accommodate the necessary extent of vertical displacement of the knitting cylinder 80 required for stitch length control purposes.

Disposed above the upper tier of apertures 264 is an inwardly directed annular shelf 266 defining an inwardly extending peripheral shoulder 268 and an annular recess 270 disposed in spaced relation thereabove. The inwardly extending shoulder 268 serves to support the outer race of an antifriction bearing 272 in the sinker assembly 28, with such bearing being secured in position by a split ring retainer 274 disposed in said recess 270 (see FIG. 2). The upper terminal end of the knitting cylinder includes a plurality of apertures 276 adapted to receive boltheads 278 for retention of the sinker pot ring 280 thereto. Such bolted interconnection of the sinker pot ring 280 and the knitting cylinder provides for conjoint vertical and rotative displacement thereof.

Compound Knitting Needle Members

As pointed out above, the subject presently preferred and specifically disclosed embodiment of the invention employs compound needle members made up of a hooked needle element and an operatively associated slideable closing element that selectively but independently displaceable relative to the needle element, and with both of such elements being of novel configuration.

Referring to FIGS. 9–12, and initially to FIGS. 9 and 10, there is provided an elongate needle element, generally designated 290. Each needle 290 is selectively shaped to include a yarn engaging knitting hook portion 292 at the upper terminal end thereof having an external nugget 293 on the tip thereof, an adjacent upper bifurcated portion 294 defining an elongate channel 296 sized to slideably receive and guide the upper portions of the hereinafter described closing element 310 with the outer defining edge thereof disposed coplanar with the marginal edge of the needle element, an upper intermediate segment 308 of reduced extent to permit needle element flexure, a lower intermediate slotted portion 286 of progressively increasing transverse extent and a base portion 300 in the general form of an inverted T-shaped cam butt. The lower slotted portion 286 contains an elongate transverse or radially oriented slot 284 in coplanar relation with the channel 296 and sized to accommodate passage of the dependent cam butt end portion of the hereinafter described closing element therethrough.

As best shown in FIG. 9, the needle element base portion 300 includes a rectangularly shaped inside cam butt 302 and an outside generally rectangularly shaped cam butt 304 having a dependent tang 306. As best shown in FIG. 10, the book 292 and the dependent end cam butts are disposed in essentially coplanar relation. The upper and lower marginal defining edges of the inside and outside cam butts 302 and 304 are rounded in shape as at 301, to permit an approach to tangential line contact with the interfacially engageable defining walls of the control cam tracks therefor, as will be hereinafter described. Disposed at the upper end of the base portion 300 and spaced from the cam butts by a segment of reduced radial extent, is an outwardly facing and generally rectangularly shaped magnetic containment pad 288, the purpose and function of which will be hereinafter described in conjunction with the needle element selection and displacement system As is apparent from FIG. 9 the upper intermediate segment 308 is of markedly reduced radial extant and desirably provides a flexure location for permitted radially directed flexure of the lower portions of the needle element selectively sized so as to assure avoidance of fatigue failure by operating well within the endurance limits of the materials employed and yet to permit the storage of sufficient energy when flexed to assure positive return of the base portion 30 to an unflexed position where desired, again without exceeding the endurance limit stress of the material when operating for extended periods of time. In conjunction with the foregoing, it should also be noted that the end walls of the slot 284 are desirably of arcuate configuration, as at **284*a* and 284*b***, so as to again reduce if not effectively eliminate any localized stress concentrations that may be attendant the flexing operation.

In addition to the foregoing, the hooked end portion of the needle element is selectively contoured to provide a recessed arcuate segment 293 that provides clearance zone on the inner side of the hook, and a sharper radius on the top of the entry side of the hook compared to the top of the inner side of the hook all of which cooperate to insure passage of the loop of the stitch by the closing element.

Referring now to FIGS. 11 and 12, there is further provided an elongate closing element, generally designated 310, for each such needle element and adapted to be slideably contained within the needle element channel 296 and to be selectively and independently longitudinally displaceable relative thereto. Each closing element 310 includes a relatively pointed tip portion 312 engageable with the dependent end of the hook portion 292 of the needle element to close the same; an upper intermediate portion 324 sized to be slidably contoured within needle element channel 296; lower intermediate portion 314.of reduced transverse or radial extent to permit independent radially directed flexure thereof, and a base portion 316 in the general form of an inverted T-shaped cam butt, the inner portion of which is adapted to extend through the transverse slot 286 in the needle element 290

As best shown in FIG. 11, the base portion 316 includes a rectangularly shaped inside cam butt 318 sized to extend through the transverse slot 284 in the needle element and an outside generally rectangularly shaped cam butt 320 having a dependent tang 322. The upper and lower marginal defining edges of the inside and outside cam butts 318 and 320 are rounded in shape, as at 330, to permit an approach to tangential line contact with the interfacially engageable defining walls of the control cam tracks therefor, as will be hereinafter described.

As is apparent from FIG. 2 the upper intermediate portion 324 of the closing element 310 is adapted to be slidably disposed within the channel 296 in the needle element with the outer marginal edges thereof disposed in coplanar relation and with the inner edge 326 of the lower intermediate portions 314 of the closure element being disposed in spaced relation from the outer defining edge 328 of the upper intermediate portion 308 of the needle element 290 to permit independent radially directed flexure of the closing element 310 vis-a-vis the needle element 290. Disposed immediately above the inverted T-shaped base portion 316 of the closing element 310 is an outwardly facing and generally rectangularly shaped magnetic containment pad 332, the purpose and function of which will be hereinafter described in conjunction with the needle closing element selection and displacement system.

Compound Needle Element Selection and Displacement Systems

As previously pointed out, the specifically disclosed embodiment incorporating the principles of this invention incorporates six 60° operating sectors around the circumference of the circular frame, with each such sector being bounded, as at 0° and 60° by a pair of adjacent yarn feed stations. Each such operating sector may be considered as essentially duplicative of the others and hence only one such sector need be described in detail.

Incorporated in the subject invention is a new and improved needle element displacement and selection system that permits each compound needle member to either knit, tuck or float at each yarn feed location, independent of the direction of approach thereto as determined by direction of knitting cylinder rotation and with a concomitant utilization of the same path of compound needle member displacement to both draw and clear a stitch. To the above ends, the subject circular weft knitting machine incorporates individual drive systems for independent, controlled vertical displacement of the needle elements 290 and their associated closing elements 310 concurrent to horizontal circumferential displacement thereof as effected by knitting cylinder rotation. The hereinafter described drive system selectively provides two available discrete and selectively shaped control paths for vertical needle element reciprocatory displacement and two available discrete and selectively shaped paths for vertical closing element reciprocatory displacement concurrent with horizontal displacement thereof in accord with knitting cylinder rotation and which, in selected permutations, directs each compound needle member to knit, tuck or float at each yarn feed location, independent of the direction of approach thereto and in accord with preprogrammed computer controlled instructions.

Within each operating sector each of said available selectively shaped control paths is symmetric about the pair of boundary defining yarn feed locations and each of said available selectively shaped control paths is also symmetric about the midlocation halfway between said pair of adjacent yarn feed locations independent of the direction of compound needle element approach thereto. As will hereinafter become clear, the selection of one of the two available control paths for the needle element and for the closing element is electromechanically effected, in response to the aforesaid pregrogrammed control, in a selection zone at the midlocation between said adjacent pair of yarn feed locations bounding each operating sector, again independent of the direction of compound needle approach thereto as determined by the direction of knitting cylinder rotation. Such electromechanical selection broadly involves a normal disposition of the compound needle elements into operative association with one set of available control tracks, a mechanical biasing, through flexure, of the compound needle elements into operative association with a second set of available control tracks, an electromagnetic retention of such compound needle elements in flexed, biased condition within the selection zone and an electronically triggered release of such electromagnetic retention of biased elements in response to a remotely generated and preprogrammed electrical signal Needle and Closing Element Displacement System Referring initially to FIG. 2, the stationary outer cam track sleeve 86 includes, on its inwardly facing surface, a lower selectively shaped recessed cam track 340 of continuous character having a marginal retaining shoulder or lip 342 of discontinuous character. The track 340 is sized to closely contain the outside cam butts 304 on the base 300 of the needle elements. The retaining shoulders 342 serve to contain the tangs 306 on such outside cam butts 304 and thus retain the butts in the tracks 40 at all locations other than in the selection zone extending on either side of the midlocation within each operating sector, as will be pointed out in greater detail hereinafter.

The retaining lip 342 thus extends along the length of cam track 340 except for the selection zone area within each sector. As will be later pointed out such selection zone extends roughly for about 5° on either side of the 30° midlocation radial in each operating sector and thus constitutes a subsection extending for 10°, i.e. from about 25° to 35°, at the sector midlocation between each pair of adjacent yarn feed locations.

In a similar manner, the outer cam track sleeve member 86 also includes an upper selectively shaped recessed cam track 346 of continuous character having a marginal retaining shoulder or lip 348 of similar discontinuous character as described above. The upper control cam track 346 and shoulder 348 are sized to contain and retain, except within the area of the selection zone within each operating sector, the outside cam butt 320 and tang 322 on the base 316 of the closing element 310. As will now be apparent, disposition of the outside cam butt 304 of the needle elements 290 in lower cam track 340 results in selective and positively controlled needle element 290 displacement longitudinally within its slot 82 in the vertical direction in accord with a first discrete defined control path as the knitting cylinder 80 is rotatably displaced relative to the outer cam track sleeve 86. Similarly, disposition of the closing element outside cam butt 320 in the upper recessed cam track 346 results in selective and positively controlled independent vertical displacement of each of the closing elements 310 relative to its related needle element 20 in accord with a second discrete defined control path as the knitting cylinder 80 is rotatably displaced relative to the outer cam track sleeve member 86.

The stationary inner cam track sleeve member 78 likewise contains a lower and selectively shaped recessed cam track 352 of continuous character on its outwardly facing surface. The track 352 is sized to receive and contain the inside cam butt 302 on the base 300 of the needle elements 290. In a similar manner, the inner cam track sleeve member 78 also includes an upper and selectively shaped recessed cam track 354 on its outwardly facing surface that is sized to receive and contain, the inside cam butt 318 on the base 316 of the closing elements 310. As most clearly shown in the sectional showing of FIG. 2, inside cam butt access to the upper and lower inner cam tracks 346 and 352 on stationary sleeve member 78 is effected through the respective upper and lower apertures 264 and 262 in the base wall portions in each of the needle member receiving slots 82 in the knitting cylinder 80 (see FIG. 6).

From the foregoing, it will be seen that selective disposition of the inside cam butts 302 of the needle elements 290 in the lower outwardly facing cam track 352 in the inner sleeve member 78 will result in successive and positively controlled vertical displacement of the needle elements 290 longitudinally within their respective slots 82 in accord with a third discrete defined control path as the knitting cylinder 80 is rotatably displaced relative to the inner cam track sleeve member 78. Similarly, selective disposition of the closing element inside cam butt 318 in the upper recessed cam track 354 in the inner sleeve member 78 will result in successive and positively controlled independent displacement of each closing element 310 relative to its related needle element 290 in accord with a fourth discrete defined control path as the knitting cylinder 80 is rotatably displaced relative to the inner cam track sleeve member 78.

The lower inner cam track 352 and the lower outer cam track 340 serve as available control paths and individually function to effect independent positive control of the path of vertical displacement of the individual needle elements 290 within their respective slots 82 in the cylinder 80 as the latter is rotatably displaced. Such lower cam tracks, except for the discontinuous nature of the retaining shoulder 342 associated with the outer track 340 within the area of the selection zones, are of continuous and effectively closed character with respect to the top and bottom marginal defining edges of the cam tracks and are, moreover, of unitary character where the respective sleeve members are integral in nature, which is the preferred construction therefor. The radial depth of each of such tracks is preferably maintained constant throughout the circumferential extent thereof. The vertical extent thereof is sized to be tangent to the curved marginal edges of the cam butts on the needle and closing elements so as to effectively closely contain and confine the upper and lower marginal defining edges of the cam butts when the latter are operatively disposed therein. As noted earlier, the upper and lower defining marginal edges of the needle element cam butts 302 and 304 are of rounded configuration. Such contour in association with the selective track shaping results in a close but contoured fit. However, such constancy of edge tangency necessarily results in varying track widths as the angle of rise or fall varies.

The presently preferred profiles available for vertical needle element 290 displacement are shown in FIG. 13*a*. As previously noted, the specifically illustrated and described circular weft knitting machine incorporates six 60° operating sectors, each of which is effectively identical with the others. FIG. 13*a* shows the vertical profile of both of the available needle element control cam tracks for a single 60° sector, with the understanding that such profile repeats every 60° operating sector. It should be again particularly noted that both the illustrated available profiles are symmetric, both with respect to the pair of adjacent yarn feed locations as represented by the 0° initiation radial and 60° sector termination radial and also that both such profiles are symmetric with respect to the midlocation between such adjacent yarn feed locations as represented by the 30° radial representing the midpoint of the selection zone, and that such symmetry is independent of the duration of knitting cylinder rotation In the specific embodiment, it should also be noted that the vertical profiles of tracks 340 and 352 are identical between approximately 11° and 49° as shown.

In a similar fashion the upper inner cam track 354 and the upper outer cam track 346 serve as available control paths and individually function to effect independent and positive control of the path of vertical displacement of each needle associated closing element 310 in predetermined programmed relation with the associated needle element displacement as described above, as the knitting cylinder 80 is rotatably displaced.

The discrete and independent character of the upper inner cam cam track 354 and upper outer cam track 346 permit effective positive control of the vertical displacement of the individual closing elements 310 independent of the displacement of their respective needle elements as the cylinder 80 is rotatably displaced. Such upper cam tracks, except for the discontinuous nature of the retaining shoulder 348 associated with the outer track 346 are also of continuous and effectively closed character. The radial depth of each such upper track is preferably maintained constant throughout the circumferential extent thereof. The vertical extent thereof is varied, as described above to maintain edge tangency so as to effectively closely contain and confine the upper and lower marginal edges of the cam butts when the latter are operatively disposed therein. As noted earlier the upper and lower defining marginal edges 330 of the closing element cam butts 318 and 320 are of rounded configuration. Such contour, in association with the selective track shaping, results in a close but contoured fit. Such constancy of edge tangency of the recessed cam tracks necessarily results in varying track width as the angle of rise or fall varies.

The presently preferred profiles available for vertical closing element 310 displacement are shown in FIG. 13*b* for a 60° operating sector, again with the understanding that such profile repeats every 60° operating sector. It should be again particularly noted that both the illustrated available profiles are symmetric, both with respect to the pair of adjacent yarn feed locations as represented by the 0° sector initiation radial and 60° sector termination radial and also that both such profiles are symmetric with respect to the midlocation between such adjacent yarn feed locations as represented by the 30° radial, and that such symmetry is independent of the direction of knitting cylinder rotation In the illustrated embodiment it should also be noted that the vertical profiles of tracks 354 and 346 are identical between approximately 7° and 53°, as shown.

By way of illustrative but arbitrary example, FIG. 2 shows the positioning of a needle element 290 and its closing element 310 on the left side of the knitting cylinder 80 as the same would be disposed at a yarn feed location and for a knitting operation. On the right hand side of the knitting cylinder 80, the needle element 290 and its associated closing element 310 are positioned as the same would be disposed at the 30° or midsector selection point.

As will now be apparent to those skilled in this art, the above described inner and outer cam track sleeve construction in association with the described compound needle members and radially slotted knitting cylinder provides two available independent and positively controlled continuous control paths for vertical needle element reciprocatory displacement and two available independent and positively controlled continuous control paths for vertical closing element reciprocatory displacement. Of this total of four possible permutations of combinational needle element and closing element displacement paths, only three are utilizable in the subject machine. Most, if not substantially all of present day commercial product fabrication however may readily and conveniently be effected by various combinations of three conventional operations, namely, knitting, tucking and/or floating. The three available permissible needle/closing element displacement path permutations, when combined with the bidirectional position control of the cylinder 80, permit the fabrication of effectively any desired fabric contour and pattern. With the above described and illustrated cam track paths, the control permutations utilized are as follows:

To Knit: needle element 290 controlled by outer cam track 340 closing element 310 controlled by outer cam track 346

To Tuck: needle element 290 controlled by outer cam track 340 closing element 310 controlled by inner cam track 354

To Float: needle element 290 controlled by inner cam track 352 closing element 310 controlled by outer cam track 346

As noted above, only three of the four available permutations of control track combinations are permissibly employed on the specifically disclosed circular weft knitting machine. As reference to FIGS. 13*a* and 13*b* will show, disposition of the cam butts for both the needle and closing elements in the inside cam tracks would cause the closing element 310 to be elevated at the yarn feed locations to the "tuck" level while forcing the needle element 290 to remain down at the "float" level. This would result in an overclosing of the needle element and hence is impermissible in the disclosed unit.

Needle and Closing Element Displacement Path Selection System

As previously pointed out, the specifically disclosed and described embodiment of a circular weft knitting machine constituted in accord with the principles of this invention, illustratively include six 60° discrete operating sectors around the periphery of the stationary inner and outer cam track sleeve members, each bounded by a yarn feed location and with each of essentially identical construction. As preliminary reference to FIGS. 2, 2*a* and 4 will show, there are provided six discrete displacement path selection systems, generally designated 400, for the needle elements 290, one for each operating sector. There are likewise provided six discrete selection systems, generally designated 402, for the closing elements 310, again one for each sector. Since the needle element and closing element displacement path selection systems are essentially identical in construction and in their mode of operation, only one such system, specifically one of the closing element selection systems, will be described in detail with the understanding that such detailed description is equally applicable, both as to structure and basic mode of operation, to all six needle element selection systems and all six closing element selection systems.

As described above, the three available permissible operational permutations for the desired mode of vertical reciprocatory needle element and closing element displacement to knit, tuck or float at each yarn feed location are determined by the selective initiation and continued maintenance of operational engagement of the needle element and closing element cam butts with the respective inside and outside cam tracks on the outer and inner stationary cam track sleeves 86 and 78 respectively.

In the disclosed knitting machine, the needle elements 290 are sized and contoured so that when such elements are in their normally unbiased or unflexed condition the inner cam butts 302 thereof will normally be disposed within and in operative relation with the lower cam track 352 in the stationary inner cam track sleeve 78. In a similar manner, the closing elements 310 associated with each such needle element are sized and contoured so that they are properly mounted in slidable relation within the needle element channel 296 and are in their normally unbiased or unflexed condition. In such unflexed condition, the inner cam butts 318 thereof will extend through the needle slots 286 for disposition within and in operative relation with the upper cam track 354 in the stationary inner cam track sleeve 78.

As earlier indicated, selection of a particular cam track for control of the path of vertical displacement of a knitting element broadly involves the selective mechanical biasing, through flexure, of the dependent shank portions of all the needle elements and closing elements in a radially outward direction and magnetic retention of such outwardly biased and flexed shank portions within each selection zone in each operating sector, so as to predispose outside cam butt engagement with the cam tracks on the outer cam track sleeve 86. Operatively associated therewith is an electronically controlled release, where desired, of the outwardly biased shank portions under programmed control to permit a flexure induced return displacement of the cam butt bearing base portions of the needle and closing elements into their normally biased or unflexed position with the inside cam butts disposed in operative engagement with the cam tracks on the inner cam track sleeve 78.

In more detail, control cam track selection for operative individual and independent control of the needle element displacement path and the closing element displacement path is effected, for those needle and closing elements that are in the unflexed or unbiased condition and with the inner cam butts thereof disposed in the inner pair of cam tracks within a selection zone subsector within each 60° operating sector, by an initial mechanically induced and radially outwardly directed biasing, through independent flexure of the reduced size midportions 308 and 314 thereof, of the cam butt bearing base portions of the needle and closing elements. Operatively associated therewith is a coordinated means for confining the upper portion of the needle and closing elements within their respective knitting cylinder slots 82 to prevent radial displacement thereof concurrent with the mechanically induced radially outward biasing of the lower portions thereof. Such confining means also operates as a fulcrum for the mechanical flexing of the lower portions thereof. Retention of such mechanically flexed and outwardly displaced needle and closing elements, wherein the outer cam butts 304 and 320 thereof respectively are positioned in operative engagement within the outer cam tracks 340 and 346 respectively, is effected by magnetic means. Such magnetic retention is also equally effective for maintaining those needle and closing elements whose shank portions are already in the outwardly biased or flexed condition and wherein the outer cam butts are operatively designed within the outer cam tracks, in such biased position in the respective selection zones within each operating sector. Thus, as previously pointed out, the subject machine includes a positive radially outwardly directed mechanical biasing of all needle and closing elements through flexure of the lower portions thereof as they enter the selection zone and the magnetic retention of all such outwardly biased shank portions of the needle and closing elements as they approach the selection control point at the 30° midsector location. At the midsector selection point and in those instances where it is desired to appropriately locate control of needle element or closing element displacement in the inner sleeve cam tracks, an electronically controlled release of the magnetic retention forces is effected under preprogrammed control to permit a flexure induced return displacement of the cam butt bearing base portions of such elements to their normally unbiased condition through a release of the stored or potential energy in the flexed and deformed midportions thereof Referring now preliminarily to FIG. 4 and as an introduction to the hereinafter presented detailed description of the component elements, the selection zone for each of the operating sectors preferably comprises a defined subsector extending about 8° on either side of the 30° or midsector selection point. Stated in another way, the selection zone extends from about 22° to about 38° and within which subsector all needle element and closing element control selection operations occur. In accord therewith, the marginal retaining shoulders 342 and 348 on the lower outer cam track 340 and upper outer cam track 346, respectively, operatively terminate at such 22° and 38° radials, leaving the outer cam tracks effectively open within the selection zones. Thus, as a given needle element 290 (and its associated closing element 310) approaches the 22° radial, the lower end cam butts thereof will be disposed in either the inner lower cam track 352 if in their normal or unflexed condition or in the lower outer cam track 340 if in the flexed or biased condition. If such lower end cam butt is disposed in the outer cam track 340 the termination of the marginal retaining shoulder 342 at the 22° radial will effect a permitted release thereof by permitting the energy stored in the flexed shank thereof to inwardly displace such lower end toward its unflexed or normally biased position in operative engagement with the inner cam track 352. In all cases the lower end of the needle element 290 will be in a released or free condition and the inner cam butt 302 thereof will either be disposed in or be moving toward the inner cam track 352.

As such needle element 290 approaches the 24.5° radial, the inner cam butt 302 thereof will engage a selectively shaped presser cam 416 (see also FIGS. 16A, B and C) and be positively deflected in the radially outward direction to locate the outside cam butt 304 in the outer cam track 340. At the same time the upper portion thereof is being subjected to a clamping action by squeeze pads 436 and associated camming ring 437, as shown in FIG. 18*c* and described in more detail hereinafter. At about the 25° radial the magnetic containment pads 288 on the lower portion of the needle element will engage the wear plate 444 associated with permanent magnets 446 and 448 and be retained thereagainst holding the outside cam butt 304 in operative engagement with the outer cam track 340.

Between about the 25.5° and 26.5° radials the upper portion of the needle element 290 will be engaged and held in compression against the rear of its slot 82 by the squeeze pad member 436, which thus also serves as a fulcrum for the now fully flexed needle element 290 as it approaches the selection point.

At the 28.5° radial, the now mechanically biased and magnetically retained needle element 290 is approaching the electromagnetic selection pole 450 which is centered on the 30° radial and which can be electronically pulsed to effect a diminution in the magnetic retention force sufficient to permit the energy stored in the flexed needle element to overcome the residual magnetic retention force and initiate a return of the lower portion of the needle element at about the 31.5° radial to its normally biased condition and consequent ultimate positioning of the inner cam butt in the inner cam track.

At the 33.5° radial, the cam pressure on the squeeze pad 436 starts to release the upper portion of the needle element and by the 34.5° radial the needle will be in its normal unbiased and unflexed condition with the lower inner cam butt 302 thereof disposed in the inner cam track 352 in inner cam track sleeve 78.

As will be apparent, if the electromagnetic selection pole 450 is not electronically pulsed, the magnetic retention force will operate to retain the needle element in its flexed condition and such will be maintained, through an appropriate length of interfacial engagement of the magnetic containment pads 288 with the permanent magnets 446 and 448, to insure entry of the outer cam butt 304 and tang 306 into outer cam track 340 behind the marginal retaining shoulder 342 at the 38° radial. It should be kept in mind that the subject system is symmetrical in construction and the same sequence of events occurs in the reverse order when the knitting cylinder 80 is rotated in the reverse direction.

One desirable characteristic of the above described system is the utilization of the electrical control signal to effect a release of a deformed element, rather than to utilize such electrical force to effect mechanical displacement or deformation of the needle and/or closing elements. Apart from its simplicity, the described system takes advantage of the nonlinear flux fringe effects of the magnetic field through the intentional provision of 2 paths for the magnetic flux, one through the magnetic containment pads on the needle and closing elements and the other through a horizontal air gap between the poles. The drop in retention flux so decreases with distance that a miniscule separation of the magnetic retention plate from the magnet face precludes its magnetic pullback. Also, whenever the needle element retracts between the knitting cylinder slot defining walls the latter acts as a field shorting path with a further marked diminution in flux-induced pulling force on the needle or closing element With the above general depiction of the sequence of operation, I will now turn to a detailed description of the operating components thereof

Presser Cam Assembly

Referring initially to FIGS. 2, 2A, 3, 4 and 16*a*–16*c*, the needle element and/or closing element selection systems broadly include a presser cam sleeve member 364 disposed in interfacially abutting slidable relation with the inner surface of the stationary inner cam track sleeve 78 and adapted to be rotatably displaceable relative thereto through a limited arc to accommodate control of compound needle element selection for both directions of knitting cylinder rotation. The bottom end of the presser cam sleeve 364 abuts a stationary transport coupling member 366 secured to the lower housing plate hub portion 14 by bolts 368. Such transport coupling member 366 serves as a product delivery tube for an associated vacuum induced product removal system (not shown) of the general type conventionally employed in circular knitting machines. An O ring 362 is interposed at the interface with the sleeve 364 to seal against oil leaks and to maintain the necessary vacuum induced air flow to insure product removal during the knitting operation.

The presser cam sleeve 364 includes an outwardly extending peripheral flange 370 sized to ride upon the inner race of antifriction bearing 364. As best shown in FIG. 2, the outer race of antifriction bearing 374 is mounted in a suitable recess in the stationary hub 14 of the lower mounting plate 10 and is secured in position by a retaining ring 376. In a similar manner, the presser cam sleeve member 364 is secured to the movable inner race 372 of bearing 374 by retaining ring 378 and a spacer sleeve 380.

Rotative displacement of the presser cam sleeve member 364 through a limited arc in either direction relative to the stationary lower mounting plate 10 and the stationary inner cam track sleeve member 78 is effected through a presser cam drive assembly disposed on the underside of the lower mounting plate 10 and generally designated 382 in FIG. 3. As most clearly shown in FIGS. 3 and 2 such drive includes a selectively actuatable rotary solenoid 384, whose shaft 386 is connected by a link 388 to one end of a connecting rod 390. The other end of the connecting rod 390 is connected via aperture 396 in stationary hub 14 and through a ball joint 392 to a pin 394 radially extending from the lower end of presser cam sleeve member 364.

As is now apparent, selective rotation of rotary solenoid shaft 386 in either the clockwise or counterclockwise direction in response to preprogrammed signals will be directly transmitted through the above described linkage into concomitant rotative displacement of the presser cam sleeve member 364 relative to the inner cam track sleeve 78. In the presently preferred construction, a presser cam sleeve member displacement of about 10° in either direction affords the desired control function in accord with the direction of knitting cylinder 80 rotation, as will be hereinafter described.

Figure 4:
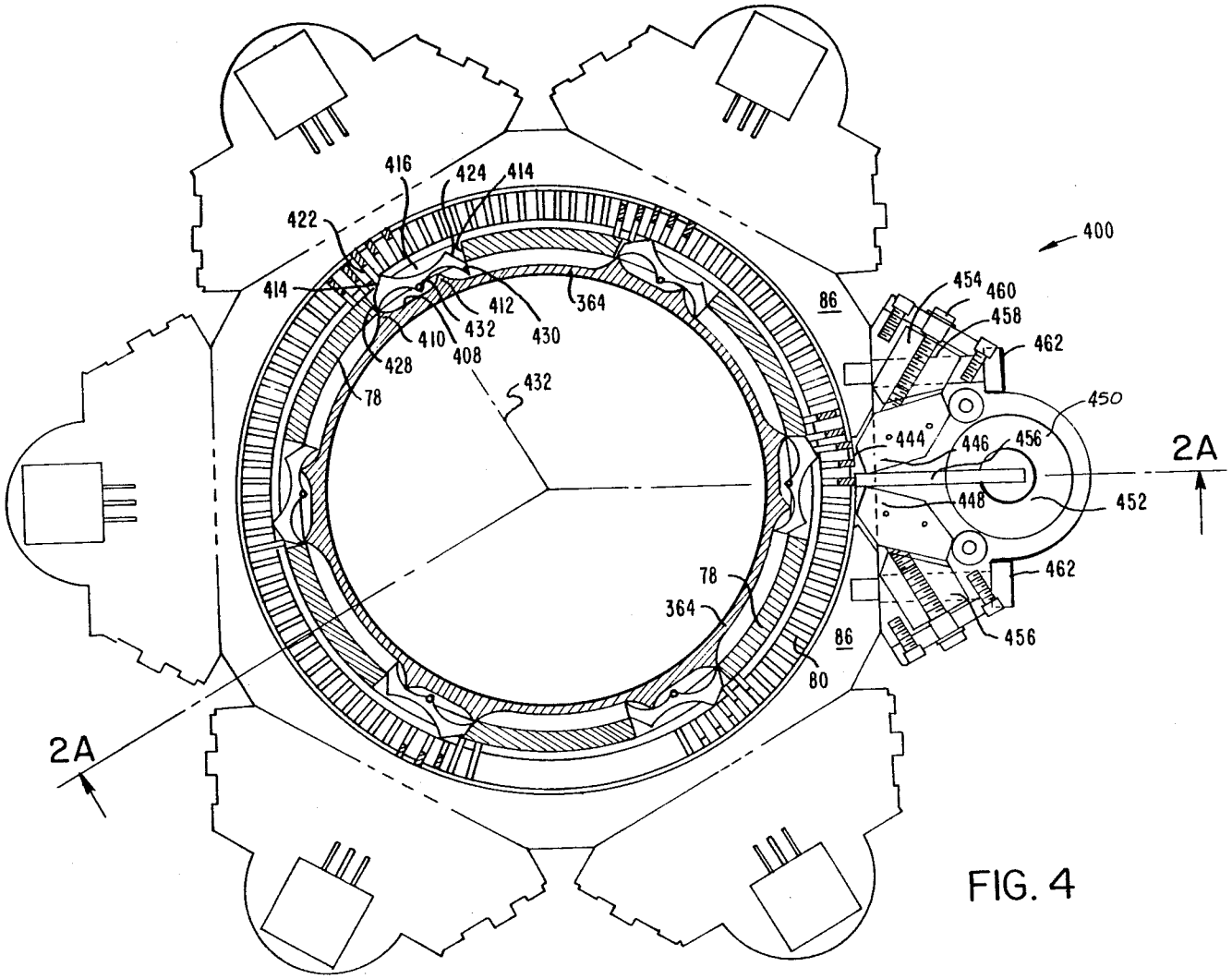
FIG. 4 is a horizontal section as taken on the line 4—4 of FIG. 2*a;*

The means for effecting the initial mechanical biasing or outward flexing of the shank portions of the compound needle elements as they enter the selection zone is also best shown in FIGS. 2–4 and **16*a*–16*c*. As there illustrated, the outwardly facing surface of the presser cam sleeve member 364 contains (for each needle element and each closing element in each operating sector) a pair of outwardly extending conjugate spaced apart cam lobes 410 and 412 separated by an equi-radial surface 408. Pivotally mounted in an appropriately located aperture 414 in the inner cam track sleeve 78 that is centered on the 30° radial selection line is a roughly batwing shaped presser cam, generally designated 416. Each such cam 416, and there is a separate cam for the needle elements and a separate cam for the closing elements in each of the six operating sectors, is constrained by its pivotal mounting in the sleeve 78 by cam lobe contact with the inner wall of inner sleeve 78 and by the retention of the ends thereof by the vertical defining walls of the aperture 414. As best shown in FIGS. 16*a*–16*c*, each of the batwing shaped cams 416 are symmetrical about its center line and includes a pair of inwardly facing surfaces 418 and 420, the extending terminal ends 428 and 430 of which constitute cam followers engageable by the above described cam lobes 410 and 412 on the presser cam sleeve member 364. The outwardly facing surface of the cams 416 includes a pair of dual parabolically shaped and generally inclined cam surfaces 422 and 424 at either end thereof and an intermediate recessed surface 426**.

The batwing cam body, as described above, also includes an integral vertical pin portion 432 of a length extending both above and below the cam body. The extending portions of such pin member 432 are adapted to be contained intermediate the inner defining wall of inner sleeve 78 and the equi-radial intermediate surface 408 of the presser cam sleeve member 364 to effect, in association with the side walls of aperture 414, a confining pivotal mounting for each such presser cam.

As will be apparent from FIG. 4, the selective rotative positioning of the presser cam sleeve member 364 as described above relative to the 30° radial or center line 432 of the operating sector will, through interengagement of cam lobe 412 with cam follower 430 at one limiting presser cam sleeve member position or, through interengagement of the cam lobe 410 with cam follower 428 at the other limiting presser cam sleeve member position, dispose either inclined cam surface 424 or inclined cam surface 422 in the path of advance of the inside cam butt portion of the needle elements (and/or closing elements) to successively deflect the shank portions radially outwardly as the knitting cylinder 80 advances therepast. As will also be apparent such outward successive deflection of the shank portion of the needle elements (and closing elements) will be effected for each direction of rotation of the knitting cylinder in accord with which of the inclined cam surfaces 422 or 424 on the presser cam 416 is positioned in the path of advance of the needle (and closing) elements.

Operating in conjunction with the foregoing is a means for effectively confining the upper portion of the needle and closing elements within its slot against radial displacement when the above described mechanical flexing or biasing of the lower shank portions is being effected. Such means suitably comprise, as schematically shown in FIGS. 2 and **18*c*, a radially elastically deformable and generally arcuately shaped squeeze pad 436 extending from a common upper flange ring 438 positioned in the upper terminal end of each needle retaining slot 82 on the knitting cylinder 80 and rotatably displaceable in conjunction therewith. As indicated, each squeeze pad 436 includes an outwardly extending flange 438 slidably contained within a circumferential recess 440 at the upper end of the outer cam track sleeve member 86 which serves to retain the pads 436 in abutting but loose relation with the upper end of the needle element 290 and its associated closing element 310**.

Synchronized deflection of the squeeze pads 436 into compressive engagement with the upper ends of the needle and closing elements to press the latter against the rear wall of their slot 82 within the foregoing indicated operational subsectors within the selection zone is effected by means of appropriately located cam lobes 442 on the inner surface of the stationary outer cam track sleeve 86. As shown, the cam lobes 442 are disposed for timed interfacial engagement with the outer surface of the arcuately shaped squeeze pads 436 and serve to inwardly elastically deform the latter into the desired compressive engagement with the upper portion of the needle and closing elements to momentarily immobilize the latter against radial or longitudinal displacement. The disengagement of the squeeze pads 436 from the cam lobes 442, as occasioned by displacement therepast, permits elastic reformation of the squeeze pads and a return to their normally biased noncompressive and loose disposition in the slots 82. The above described timed compressive engagement of the needle and closing elements provides an effective clamping action for the upper portion to serve as a fulcrum location for the concurrent mechanical flexing of the shank portions thereof by the batwing presser cam 416 as described above.

The above described successive outward flexing of the dependent shank portions of the needle elements by the action of the presser cam 416 operates to move the radially extending magnetic containment pad portion 288 of the needle element 290 (and magnetic containment pad 330 on closing element 310) into sliding interfacial engagement with a bronze wear plate 444 mounted on the arcuately shaped faces of a pair of permanent magnets 446 and 448. Such wear plate 444 not only functions to reduce wear on the containment pad portions 288 of the needle elements and eliminate dimensional tolerance problems with the positioning of the needle elements but also serves to provide an exact close spacing between the needle element and the poles of the permanent magnets 446 and 448 and to thus contribute to the accurate control of the magnetic retention flux force to which the flexed or mechanically biased needle shank portion is subjected once the needle element passes the inclined cam surface, such as 422 on the presser cam 416.

As best shown in FIG. 4, a suitable magnetic retention and selection control assembly includes a pair of permanent magnets 446 and 448 spaced apart at the 30° midsector line to permit the interposition of an elongate laminated pole piece 450 of an electromagnet 452 therebetween. The arcuate faces of the permanent magnets 446 and 448 extend substantially over the entire selection zone and are faced with the bronze wear plate 444 as noted above. Associated with each of the permanent magnets 446 and 448 is an adjustable shortening pole assembly generally designated 454 and 456 respectively adapted to permit controlled diversion of flux from the operative faces of the permanent magnets. The entire magnetic assembly is adapted to be mounted on the outer cam track sleeve 86 by bolts 462. The shortening pole assembly broadly includes a flux diverting pole element 458 selectively shaped to be interfacially engageable with both the side of the permanent magnet and with the adjacent side wall of the outer cam track sleeve member 86. The pole element 458 is threadedly mounted on a rotatable shaft 460, rotation of which effectively controls and spacing and degree of compressive contact between such pole piece, the permanent magnet and the outer sleeve As will now be apparent the above described shortening pole assembly provides fine control over the amount of flux deliverable to the operative faces of the permanent magnets to magnetically retain the needle elements and closing elements against the wear plate 444 in the selection zone. Preferably an amount of flux necessary to just retain the needle and closing elements in such position as they traverse the midsector location and the pole 456 of the control electromagnet 452 in the absence of a release pulse thereon is employed. Under the magnetic retention conditions as generally described above, the presence of an appropriately timed pulse at the electromagnet 452 of a polarity adapted to generate a magnetic flux in the central pole 456 in opposition to the permanent magnet flux, will result in a net decrease in the magnetic retention flux forces and in a permitted disengagement of the flexed and mechanically biased needle and closing elements from their position in interfacial engagement with the wear plate 444 and in a permitted return to their normally biased position.

A modified and presently preferred construction for the magnetic retention and selection control assembly is shown in FIGS. 15*a*–15*d*. As there shown, such assembly includes a pair of permanent magnets 710 and 712 mounted on either side of the laminated core pieces 714 of bipolar electromagnet, generally designated 716. The permanent magnet 710 is selectively shaped to provide a pair of spaced generally rectangular pole faces 718 and 720 within the selection zone and extending in the horizontal direction from about the 25° radial up to the marginal edge of the electromagnet core pieces 714. In a similar manner, the permanent magnet 712 is selectively shaped to provide a pair of spaced generally rectangular pole faces 722 and 724 within the selection zone and extending in the horizontal direction from the other marginal edge of the electromagnetic pole pieces 714 to about the 35° radial As best shown in FIG. 15*b* the electromagnetic pole pieces terminate in a pair of spaced pole faces 726 and 728 disposed intermediate the permanent magnet pole faces 718, 722 and 720, 724 respectively. The electromagnet pole pieces 714 are coaxially aligned on the 30° radial and are of horizontal width of slightly less than the spacing between two successive needle element containing slots 82 on the knitting cylinder 80.

In this embodiment, the bronze wear plate 730 is of a generally "H" shaped configuration and is recessed within the exposed pole faces of both the permanent magnets and electromagnet. The vertically disposed end portions 732 and 734 thereof are sized in the vertical to approximate the length of the magnetic containment pads on the needle and closing elements and disposed, in the horizontal direction beyond the ends of the permanent magnet pole faces 718, 720 and 722, 724 respectively. Such end portions 732 and 734 of the wear plate assist in guiding the magnetic containment pads of the needle and closing elements that are riding in the outer bearing tracks prior to introduction into the selection zone into smooth interfacially operative engagement with the flux generating components of the assembly. The intermediate portion 736 of the wear plate 730 overlaps the marginal edges of the pole faces of both the permanent magnets 710, 712 and the electromagnet 716, as indicated by the dotted line on FIG. 15*b* with the adjacent portions thereof being exposed and disposed in predetermined spaced relation with the exposed surface of the wear plate.

In this preferred embodiment, the pole pieces 714 of the electromagnet 716 are magnetically isolated from the permanent magnets 710 and 712 by an interposed thin layer 738 of polyester sheeting, suitably mylar. In a similar manner, all of the magnetic flux generating units are encased or potted in an insulating casing of Teflon impregnated epoxy which further serves to magnetically isolate the pole faces from each other and to enhance flux transfer through the exposed pole faces thereof disposed in interfacial proximity to the needle and closing elements.

As indicated above, the electromagnet 716 is adapted to be driven by a bipolar driver adapted to supply pulses of opposite polarity thereto. Retention of the moving needle and closing elements in their flexed condition as they are displaced past the electromagnet core piece 714 here requires the presence of an appropriately polarized pulse that will create magnetic flux supplemental to that generated by the permanent magnets 710 and 712. Absent such a reinforcing pulse and, preferably with the assistance of the presence of a flux negating pulse of opposite polarity, the magnetic retention flux generated by the permanent magnets 710 and 712 and leaking into the electromagnet pole pieces 714 will be insufficient to retain the magnetic containment pads on the needles (and closing elements) in interfacial abutting engagement with the wear plate and the shank portion of the needles and closing elements will be released to permit the potential energy stored therein, by virtue of their prior mechanical biasing into their flexed condition, to initiate the return thereof to their normally biased and unflexed condition.

In operation of either of the above described magnetic retention and selection control systems, the shank portion of the needle elements will be successively mechanically deflected from their normally biased inwardmost position, where the inner cam butts 302 are operatively engaged within the lower inner cam track 352, radially outward by the action of the presser cam 416 so as to bring the magnetic containment pad 288 thereof into interfacially abutting engagement with the bronze wear plate. When so positioned the inner cam butts 302 are displaced out of operative engagement with the lower inner cam track 352. Concurrently therewith, the outer cam butts 304 will be so located so as to permit introduction of such cam butts 304 and tang 306 into the lower outer cam track 340 after a predetermined further degree of needle element advance. Once a needle element 290 has been advanced past the inclined surface on the presser cam 416 it is retained in flexed interfacially abutting engagement with the wear plate solely by the magnetic retention forces generated by the permanent magnets. As the needle elements 290 are successively advanced past the core elements of the control electromagnet, they will be retained in such flexed position unless such electromagnet is appropriately pulsed to reduce the net magnetic retaining flux an amount sufficient to permit the stored potential energy in the flexed needle element shank to displace said shank portion inwardly a sufficient distance to prevent the magnetic flux associated in the downstream permanent magnets to reattract the magnetic containment pads into interfacial engagement with the bronze wear plate. Absent needle element release, further needle element advance, as effected by knitting cylinder 80 rotation, will operate to introduce the outside cam butts 304 into the outside lower cam track 340 and to be therein retained by disposition of the tang 306 behind a retaining shoulder 342 during further passage through the particular operating sector and into the next succeeding sector. Conversely, the application of an appropriately timed electrical pulse to the control electromagnet will effect a release of the needle element shank portion from its outwardly biased position and permit a return of such needle to its unflexed or normal position wherein the inner cam butt 352 will be reintroduced into operative engagement with the lower inner cam track 352 and to there remain during needle element passage through the particular operating sector and into the next succeeding sector.

As noted earlier, a similar needle element selection assembly is provided within each operating sector. A similar but separately operable closing element selection assembly to selectively direct the closing element cam butts 318 and 320 into operative engagement with respective upper inside and outside cam tracks 354 and 346, is also provided for each of the operating sectors. As shown in FIG. 2 the selection assemblies for the closing elements 310, each including separate presser cams and magnetic retention and selection control assemblies is disposed above those for the needle elements 290, as heretofore described above.

As will now be apparent to those skilled in this art, the above described needle and closing element displacement and control selection system provides a positive control of needle element and closing element elevational position at all times through the permitted use of continuous, smooth and closed cam tracks that effectively cage or contain the cam butts at all times during tho operational cycle attendant knitting, tucking or floating within each operating sector. Among the advantageous results that flow from the above disclosed needle and closing element displacement and selection systems are included precision positioning of needle and latch elements at all times during the operational cycle, markedly higher permitted speeds of operation flowing from shorter reciprocation amplitudes for needle members, capability to perform all required operations in either direction of knitting cylinder rotation, permitted increase in the number of operating sectors and concomitant increases in the number of permitted yarn feeds with a 360° circumference for a given diameter of knitting cylinder, avoidance of impact loading of needle and closing elements with a consequent increase in the useful life thereof and a versatility of permitted operation readily obtainable through electronic control without machine modification.

Sinker Assembly

As noted earlier, the sinker assembly 28 included in the disclosed machine affords selectively controlled three dimensional sinker element displacement in conjunction with the earlier described needle member displacement system to permit marked increases in stitch draw speed, reduced maximum yarn tension, and in the overall speed of the knitting operation as well as to minimize, if not effectively avoid, robbing back of yarn from previously formed stitches.

Referring initially to FIGS. 2 and 17, an annular sinker pot ring 280 is disposed within the upper end of the knitting cylinder 80 and is secured by bolts 278 thereto for conjoint rotation therewith. The annular sinker pot ring 280 contains a series of vertical adjacent slots 470 disposed in vertical alignment with the slots 82 on the periphery of the knitting cylinder 80 and each of the slots 470 is adapted to contain a selectively shaped and displaceable sinker member 474.

Figure 2A:
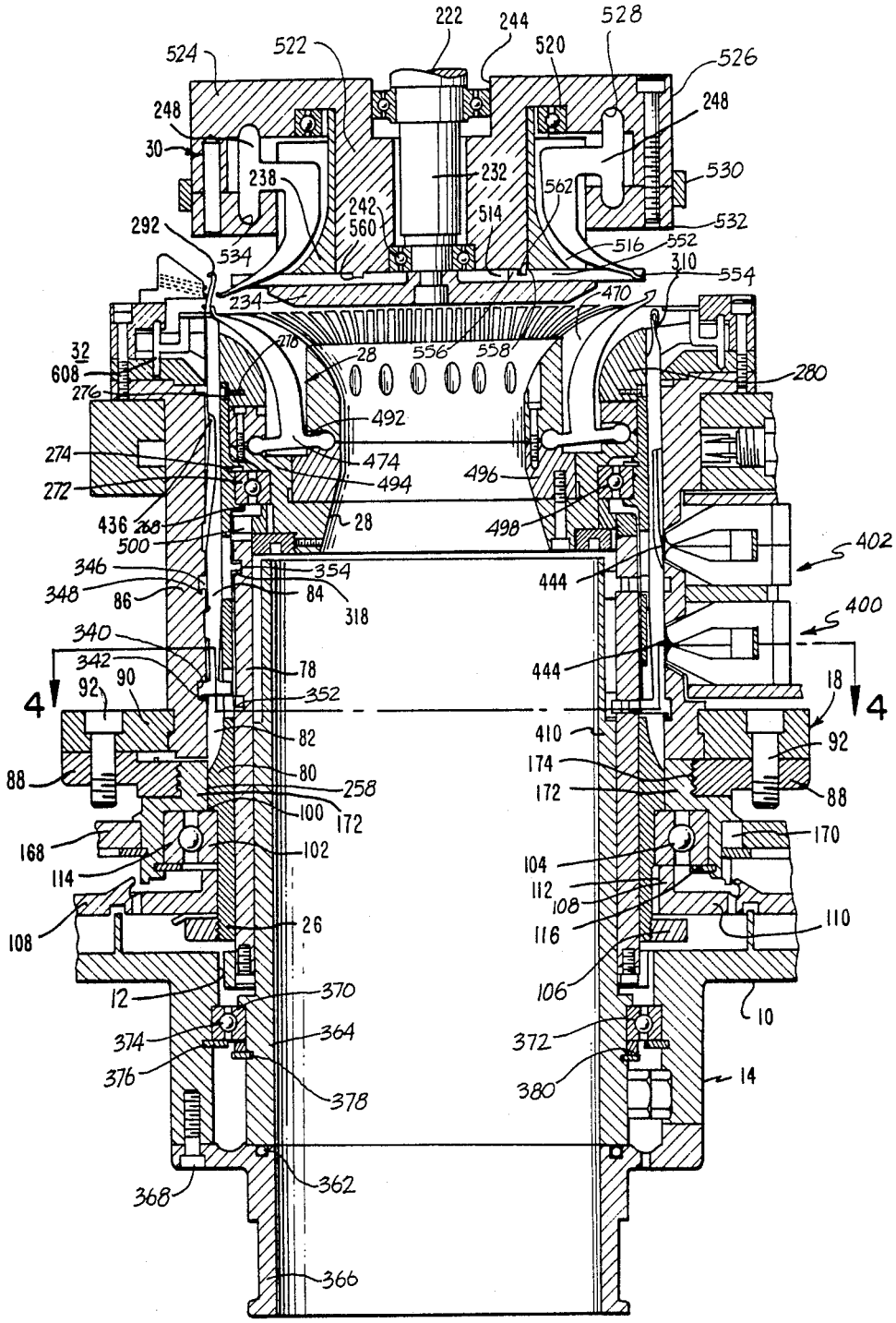
FIG. 2A is an enlarged sectional view of the upper portion of the machine shown on FIG. 2.

The sinker member configuration is best shown in FIG. 17 and includes an elongate curved planar body portion 476 terminating at the free end in a rounded point 478 formed by an upwardly facing inclined surface or land 482. Disposed inwardly of the point 478 and at the end of inclined surface 480 is a recessed hook-like segment 484 and an adjacent land 485. The other and dependent terminal end of the sinker member 474 includes a cross arm 486 terminating in generally circularly shaped inner and outer cam followers 488 and 490 respectively. As best shown in FIGS. 2 and 2A each of the slots 472 in the rotatable sinker pot ring 470 contains a sinker member 474 with the base cross arm 486 thereof extending outwardly through appropriate apertures to position the inner and outer cam followers 488 and 490 in inner and outer cam tracks 492 and 494 respectively in the stationary sinker cam track housing assembly 496.

The stationary sinker cam track housing assembly 496 is mounted on the inner race 498 of the antifriction bearing 272. The outer race of the bearing 272 is supported on the inwardly projecting shoulder 268 on knitting cylinder 80 and is retained thereon by split ring 274 in recess 270. A splined connection 500 to the upper end of the stationary inner cam track sleeve member 78 serves to angularly immobilize the stationary sinker cam track housing assembly 496 against rotation but yet permit conjoint vertical displacement thereof in association with vertical displacement of the knitting cylinder 80 attendant desired variation in stitch length, as described earlier. Rotation of the sinker pot ring 280 in conjunction with rotation of the knitting cylinder 80 effects a rotative displacement of the effectively caged sinker element cam followers 488 and 490 within the closed cam tracks 492 and 494 respectively in the stationary cam track housing assembly 496, to effect, in accord with the contour of said cam tracks 492 and 494 selective vertical and horizontal displacement of the extending ends of the sinker members in controlled time and spatial relation to needle member displacement. The horizontal displacement of such sinker elements notably includes displacement in accord with knitting cylinder rotation and also radially directed displacement thereof in accord with cam tracks 492 and 494.

Terry Dial Assembly

Included in the subject knitting machine is a terry loop forming assembly of markedly improved construction and operational capability. As will be hereinafter described in detail, means are provided to permit two dimensional displacement of the yarn engaging terry bits or terry instruments in association with means to effect a positive shedding or removal of the formed terry loops from the terry instruments. Among the advantages that are obtainable from the hereinafter described construction are a more rapid stitch or loop draw, independent cam track control of terry loop parameters independent of other operating parameters and which includes the ability to control and/or vary terry loop length during article fabrication, positive terry loop shedding, permitted positive yarn insertion in the yarn feed area, separation during stitch drawing and the ability to engage and disengage terry loop production without discontinuity in control cam track paths.

Referring initially to FIG. 2 and as previously described, the depending end 232 of terry dial drive shaft 222 disposed beneath the support frame 24 is mounted in a pair of antifriction bearings 240 and 242. Secured to the dependent terminal end of the drive shaft 222, as by bolt 236, and rotatably displaceable in conjunction therewith is the terry dial retainer cap 234 which also serves as the shedder element support plate. The retainer cap 234 is shaped to provide a plurality of radially disposed slots 514 on its upper surface The radial slots 514 are equal in number to the number of needle members on the knitting cylinder 80 and the number of terry instruments mounted in the terry dial. Mounted on the periphery of the retainer cap 234 is an annular rotatable terry dial or terry instrument support member 238 having a plurality of radially disposed slots 516, each containing a selectively shaped terry instrument 248. The upper end of the slotted terry dial 238 is appropriately positioned by the inner race of an antifriction bearing 520, the outer race of which is mounted in the upper segment 244 of the stationary terry dial cam housing member. The upper segment 244 of the terry dial cam housing includes a hub portion 522 mounted on the outer races of the main drive shaft bearings 240 and 242 and an upper circular plate-like portion 524 having a depending peripheral flange 526 internally contoured, as at 528, to define an internal upper cam track channel Secured in interfacial relation with the dependent edge of the peripheral flange 526, as by retainer ring 530, is an annular ring-like member 532 which serves as the lower segment of the stationary terry dial cam housing. Such ring-like member 532 is of general U-shape in cross section and is internally contoured to define a lower cam track channel 534.

As best shown in FIGS. 2, and 19, the terry instruments each include an elongate base portion 540 terminating in upper and lower cam butts 542 and 544 disposed within the above described upper and lower cam track channels 528 and 534 respectively in the stationary terry dial cam housing assembly. Extending inwardly from and substantially perpendicular to the base portion 540 is an intermediate body portion 546. The remote end of the intermediate body portion 546 merges with an elongate, dependent and outwardly extending arcuate arm 548 terminating in a shallow yarn engaging hook 550. As will be apparent, the above construction provides for permitted individual or conjoint displacement of said yarn engaging hooks 550 at the ends of the terry instruments 248 in both the horizontal and vertical planes.

Slidably disposed within each of the radial slots 514 in retainer cap 234 is an elongate shedder bar element 552 adapted to positively assure shedding or removal of the terry loop yarn from the terry instrument hook element 550 To the above ends, the outward end of the elongate shedder bars 552 is provided with a slightly concave shape 554 and the inner ends thereof include a pair of spaced upwardly directed shoulders 556 and 558 defining a channel 560 therebetween. Dependent from the underside of the hub 522 of the stationary terry dial cam housing is a camming ridge 562 sized to be contained within the channel 560 in the shedder bars. Rotation of the shedder bar support plate 512 relative to the stationary hub 522 of the terry dial cam housing will effect, dependent upon the contour of the camming ridge 562, horizontal reciprocation of the radially disposed shedder bars 552 in timed relation to terry instrument 518 displacement, with such relative displacement operating to positively shed or remove the yarn forming the terry loop from the terry instrument hook 550. In the preferred construction, the shedder bars are advanced and function to strip the terry loops from the terry instruments at the 30° selection point and are then retracted at the yarn feed locations to permit the yarn insertion carriers (to be later described) to reach directly behind the raised hook portions of the needle members at the yarn feed stations.

Terry loop formation in the herein described circular weft knitting machine is basically dependent upon the location of the terry instrument hooks relative to the yarn feed path. In the described machine, means are provided to rotatably displace the stationary terry dial cam housing assembly intermediate one limiting position where terry loops will be formed and a second limiting position where the terry instruments are so located relative to the yarn feed path as to be effectively inoperable.

To the above ends, and now also referring to FIG. 5, there is provided a rotary solenoid 570 mounted on the upper surface of the terry dial support frame 24. The armature-shaft 572 of the rotary solenoid is connected, through an extension shaft 574 and link 576, to a connecting rod 580 disposed within a recess 578 on the underside of the frame 24. The other end of the connecting rod 580 is pivotally connected to the terry dial cam housing upper segment 524 by a pin 582. In the preferred construction the terry dial cam housing is normally biased at one limiting position where terry loop formation will be effected. Actuation of the rotary solenoid 570 in response to preprogrammed instruction will effect a predetermined degree of rotative displacement of the shaft 572 which will be transmitted through the above described linkage into a predetermined degree of rotative displacement of the stationary terry dial cam housing sufficient to preclude yarn feed over the terry instrument hooks and thus render the terry loop formation system inoperative. Similarly deactivation of the rotary solenoid 570 will result in a return rotative displacement of the stationary terry dial cam housing and in automatic terry loop formation.

Rake Assembly

In order to assure positive displacement of yarn from the needle element hooks 292 and out of the path of travel of the closing elements 310 during the upward displacement of the needle members and to further prevent needle re-engagement with such yarn during the next needle member downstroke, the subject circular weft knitting machine includes an auxiliary and tridirectionally displaceable rake member operatively associated with each bidirectionally displaceable needle member and associated tridirectionally displaceable sinker element.

Referring now to FIGS. 2 and 18*a*–18*c*, the sinker pot ring 280 which is bolted to the upper end of the knitting cylinder 80, as at 278, and is thereby rotatably displaced in conjunction therewith, includes an outwardly directed annular extension 590 disposed above the upper end of the knitting cylinder 80 and suitably slotted, as at 592, to permit reciprocation of the needle and closing elements therethrough and the requisite article forming yarn manipulation thereabove. The peripheral portion of such extension is further radially slotted, as at 594, in offset relation with the slots 82 on the knitting cylinder 80 and the sinker member containing slots 470 in the sinker pot ring 280.

Mounted on a radially extending flange 92 at the upper end of the stationary outer cam track sleeve 86 is the lower segment 596 of a stationary annular rake member cam track housing, generally designated 598. Peripherally secured to the lower cam track housing segment 596, as by bolts 600, is an upper housing segment 602. The lower and upper housing segments are internally contoured to provide lower and upper cam tracks 604 and 606 respectively.

Disposed within each of the peripheral slots 594 of the sinker pot extension ring 590 is a selectively shaped rake member generally designated 608. The rake members 608 each include a base portion 610 having a pair of diametrically opposed upper and lower cam butts 612, 614 selectively contoured to be slidably contained within the above described cam tracks 606 and 604 respectively. Extending perpendicularly and then parallel to the base portion is a generally L shaped body portion 616. Mounted on the end of the body portion 616 is an offset rake element 618 having a bifurcated end portion 620 in the form of a pair of spaced arms 622 and 624. The arm members 622 and 624 are spaced apart a sufficient distance to accommodate reception of a needle and sinker member therebetween.

Through the above described construction rotative displacement of the knitting cylinder 80, sinker pot ring 280 and sinker pot extension 590 effects a conjoing rotative displacement of the individual rake members relative to the stationary lower and upper segments 596 and 602 of the cam track housing 598. As will be now apparent the selective contouring of the upper and lower cam tracks 606 and 604 will effect three dimensional displacement of the individual rake members 608, i.e. vertically and radially in association with horizontal displacement thereof attendant knitting cylinder rotation.

Control Cam Track Configurations & Nature of Displacement Paths For The Yarn Engaging Elements As described above, the yarn engaging elements that operatively function in the basic "knit", "tuck" and "float" operations are the needle elements 290, their associated closing elements 310, the selectively shaped sinker elements 474 and the rake elements 608 In addition to the foregoing, and when terry loop formation is desired, both the terry instruments 518 and the terry loop shedders 552 are operatively added to the above identified yarn engaging elements The requisite independent but functionally correlated vertical and/or radial displacement of the yarn engaging elements as the knitting cylinder 80 rotates is effected through the above described:

(a) two discrete control cam tracks for effecting the nature and extent of needle element displacement in the vertical direction, i e cam track 340 in stationary outer cam track sleeve 86 and cam track 352 in stationary inner cam track sleeve 78;

(b) two discrete control cam tracks for effecting the nature and extent of closing element displacement in the vertical direction, i e. cam track 346 in outer sleeve 86 and cam track 354 in inner sleeve 78;

(c) a composite double control cam track for effecting sinker member displacement in both the radial (horizontal) and vertical directions, i.e. cam tracks 492 and 494 in stationary housing assembly 496;

(d) a composite double control cam track for effecting terry instrument displacement in both the radial (horizontal) and vertical directions, i.e. cam tracks 528 and 534 in stationary housing members 524 and 532;

(e) a composite double control cam track for effecting rake element displacement in both the radial (horizontal) and vertical directions, i.e. tracks 604 and 606 in housing segments 596 and 602.

(f) a single control path or channel 560 for effecting lineal displacement of the terry loop shedding instrument.

The conjoint and multidirectional operation of the foregoing elements in effecting the selected knitting operation in accord with preprogrammed instruction, while difficult to depict and describe, contributes to the new and improved results that flow from the practice of the subject invention both in the basic yarn manipulation operations that take place and in the resultant product.

As previously pointed out, the presently preferred and herein specifically described embodument of a circular weft knitting machine includes six discrete 60° operating sectors around the periphery of the inner and outer cam track sleeves 78 and 86, each such sector accommodating, at any instant of time, 18 compound needle members each with an associated sinker member, rake and terry instrument and shedding element as the basic operational entity.

A significant feature of the subject invention is the provision and utilization of control cam track configurations that are symmetric and definitive of vertical and circumferential displacement paths that are symmetric about a pair of adjacent yarn feed locations and which are also symmetric with respect to the midlocation halfway between said pair of adjacent yarn feed locations, independent of the direction of knitting cylinder rotation. Stated in another way and for the illustrated embodiment the control cam track configurations are symmetric within each operating sector as defined by yarn feed locations at the 0° and 60° radials and are also symmetric with respect to the 30° midlocation therebetween, irrespective of the direction of rotation of the knitting cylinder. Such symmetry of displacement paths provides the ability to knit, tuck or float on any needle member at any yarn feed location and independent of the direction of rotation of the knitting cylinder Additionally, such symmetry results in the utilization of the same path of displacement when effecting both stitch draw and stitch shedding or "knockover" operations in an association with the employment of the selectively shaped sinker elements, independent of direction of rotation of the knitting cylinder.

To the above ends and as partially previously described within each of the illustrated 60° operating sectors the needle element and closure element selection zone is centered at the 30° or midsector line, and extends for about 8° on either side thereof. Yarn feeds are located at each 0° sector initiation line and at each 60° sector termination line, which coincides with the 0° sector initiation line for the succeeding operating sector. Such symmetry not only readily accommodates bidirectional operation in accord with the direction of knitting cylinder rotation in response to preprogrammed instructions but also permits the incorporation of a significantly increased number of permitted yarn feeds for a given diameter of knitting cylinder and a diminution in distance between yarn feed location and the midsector selection point.

Referring now to FIGS. 13*a* through *e*, there is depicted, by way of illustrative example, the presently preferred configuration of independent vertical displacement paths within an operating sector for the needle elements 290, the closure elements 310, the sinker members 474, the rake elements 608 and the terry instruments 518, respectively, in accord with knitting cylinder rotation and relative to an arbitrary elevational base line $Z_o$, suitably the location of the top of the sinker pot, as such vertical displacement paths are determined by the configuration of the requisite control cam tracks.

As will hereinafter become apparent, FIGS. 13*a* to 13*e* are not only appropriately depictive of the spatial location in the vertical plane, of each of the respective 18 individual needle elements, closure elements, sinker members, rake elements and terry instruments, vis-a-vis its adjacent neighbor (spaced 3° 20′ therefrom) for each angular position for 0° to 60° within each operating sector of any given instant of time, but are also appropriately depictive of the progressive vertical elevations of each of needle, closure, sinker, rake and terry bit elements as each such element is successively advanced from 0° to 60° or vice versa through each operating sector in accord with the direction of rotative displacement of the knitting cylinder 80.

While FIGS. 13*a* and 13*b* adequately depict the complete path of displacement of the needle elements 290 and the closure elements 310, which move only in the vertical direction, FIGS. 13*c* to 13*e* depict only the vertical displacement paths of the sinker elements 474, rake elements 608 and and terry instruments 518. The nature and extent of the conjoint radial displacement of such sinker elements 474, rake elements 608 and terry instruments 518 is shown in FIG. 13*f*.

Referring initially to FIG. 13*a*, the solid curve 640 illustrates one available path of vertical displacement for each of the needle elements 290 as they are advanced from the 0° sector initiation location, through the midsector 30° selection point and to the 60° sector termination location when the outer cam butts 304 thereof are disposed in the lower cam tracks 340 in the outer cam track sleeve 86. When so displaced the needle elements are being manipulated for a "knit" or "tuck" operation.

Such needle element displacement control cam track curve 640 for the knit and tuck operations, as is the case of all of the herein described cam track control curves, is smoothly formed of only parabolic sections and straight line sections. Thus, by way of example, the needle element elevation cam track curve 640, in the portion thereof extending from 0° to about 4.7°, i.e. to point "a", is a parabolic curve and which causes a needle element 290 to move from its maximum elevated position at 0° downwardly in a nonlinear manner to an intermediate elevation at point "a". The portion of the curve 640 extending from 4.7° to about 11.4°, i.e. from point "a" to point "b", is a straight line which causes the needle element 290 to move from its intermediate position at point "a" downwardly in a linear manner to a lower intermediate elevation at point "b". The portion extending from about 11.4° to about 15.5°, i.e. from point "b" to point "c", is a parabolic curve which causes the needle element 290 to continue to move downwardly, here again however in a nonlinear manner, from the lower intermediate elevation at point "b" to its lowest or retracted position at point "c" below the $Z_o$ base line, at which time the needle element 290 has completed its stitch draw operation. The portion extending from about 15.5° to about 25.5°, i.e. from point "c" to point "d", is a straight line during which time the needle element 290 is maintained stationary at its lowest or retracted position as the needle element 290 approaches and enters the selection zone. Such constancy of needle element elevation after the stitch draw has been completed serves to hold or maintain the tension on the drawn yarn and to so prevent "robbing back" and thus eliminate "barre" in the finished product. The portion of curve 640 extending from about 25.5° to 27.5° i.e. from point "d" to point "e", may be of composite parabolic and straight line character in which the needle element 290 is raised slightly from its lowermost or fully retracted position in order to relieve the tension on the yarn. The portion of the curve 640 extending from about 27.5° to 30°, i.e. from point "e" to point "f", is a straight line wherein the needle element is again maintained at a constant but slightly elevated height as it approaches the control electromagnet pole piece at the 30° radial and is then positioned either for return engagement with the lower cam track 340 in the outer cam track sleeve 86 or for operative transfer into the lower cam track 352 in the inner cam track sleeve 78. As previously noted, the control cam tracks are all symmetric intermediate an adjacent pair of yarn feed locations and are also symmetric with respect to the 30° midlocation point. As such, the portion of curve 640 for outside cam track control that extends from the 30° selection point to the 60° sector terminating point is a mirror image of the above described configuration from 0° to 30° and further detailed description thereof would only be of repetitive character.

In a similar manner, the dotted line curve 642 on FIG. 13*a* depicts a second available path of vertical needle element displacement to accommodate a "float" operation and wherein the inside cam butts 302 will be operatively disposed within the lower cam track 352 in the inside cam track sleeve member 78. In the "float" mode of operation, the needle elements 290 will be disposed at an intermediate elevation above the $Z_o$ base line at the 0° radial sector initiation location. In the portion of curve 642 extending from 0° to about 6°, i.e. to point "m", the curve 642 is a composite of several parabolic curves, which causes the needle element 290 to move upwardly in a nonlinear manner from its intermediate elevation at 0° to its maximum elevation at point "m". The portion thereof extending from about 6° to about 8.7°, i.e. from point "m" to point "n", is a parabolic curve which causes the needle element 290 to move downwardly in a nonlinear manner from its maximum elevated position to an intermediate elevation. The portion thereof extending from about 8.7° to about 11.6°, i.e. from point "n" to point "o", approximates a straight line which causes the needle element 290 to continue to move downwardly but in a linear manner. The portion of the curve 642 extending from about 11.6° to about 15°, i.e. from point "o" to point "p" is a parabolic curve, which causes the needle element to continue to move downwardly, but in a nonlinear manner to its lowest or fully retracted position below the $Z_o$ base line. The portion extending from about 15° to the 30° electronic selection point, i.e. from point "p" to point "f" is, for all practical purposes, identical with that described above for the solid line curve 640 intermediate the points "c" and "f" and will not be here repeated. Here again and as previously noted, the control cam tracks are all symmetrical about the 30° selection point and since the curve 642 from the 30° selection point to the 60° sector termination point is a mirror image of the above described configuration from 0° to 30°, further detailed description thereof would only be of repetitive character.

Referring now to FIG. 13*b*, the solid curve 644 is depictive of one available path of vertical displacement of the compound needle member closing elements 310 when the outside cam butts 320 thereof are operatively engaged with the upper cam track 346 in the outer cam track sleeve member 86 to effect a knit or float operation in cooperation with the needle elements 290.

As illustrated, the closing elements 310, in accord with the solid line curve 644, will move upwardly from an intermediate elevation at the 0° radial to a higher elevation at about the 6° radial. If at this time a "knit" operation is being effected, the needle element 290 will be concurrently descending in accord with solid line curve 640 on FIG. 13*a*, and the conjoint opposing directions of displacement will operate to rapidly close the needle element hook. In contradistinction thereto, and if a "float" operation is being effected, the needle element 290 will also be rising from an intermediate location in accord with the dotted line curve 642 on FIG. 13*a*. For such "float" operation the needle element hook will be effectively closed at the 0° sector initiation line by the elevated closing element 310 and the closed needle 290 and closing element 310 will conjointly rise in unison maintaining the needle hook closed. Such closing element solid line curve 644, from the 0° sector initiation location to the 6° location, i.e. point "g" is a suitable composite of a pair of parabolic sections connected by a straight line section.

The succeeding portion of the closing element curve 644 extending from about 6° to about 15°, i.e. from point "g" to point "h" is also suitably constituted by a pair of parabolic sections interconnected by a straight line section and serves to downwardly displace the closing element 310 from its maximum elevated position above the $Z_o$ base line at point "g" to its maximum lower position below the $Z_o$ base line at point "h". If a "knit" operation is then being effected, the needle element 290 and closing elements will undergo a conjoint downward displacement during this operational subsector with the needle element hook closed, as is apparent from a comparison of the solid line curve 640 of FIG. 13*a* with the solid line curve 644 of FIG. 13*b*. If a "float" operation is being effected, the needle element 290 and closure element 310 will also conjointly descend as generally depicted by dotted line curve 642 in FIG. 13*a* and solid curve 644 of FIG. 13*b*.

The next succeeding operational subsector for curve 644 extends from about 15° to about 25.5°, i.e. from point "h" to point "i", and within which area the closing element 310 together with the needle element 290 for both the "knit" and "float" operations are maintained in their lowermost positions with the needle hook closed; as comparison of solid and dotted line curves 640 and 642 on FIG. 13*a* and solid line curve 644 on FIG. 13*b* clearly shows.

Within the next succeeding subsector extending from about 25.5° to about 27.5°, i.e. from point "i" to joint "j", the closing element 310 will rise slightly from its lowermost position conjointly and in coequal amount with the above described rise of the needle elements 290 in the same subsector, i.e. point "d" to point "e" in FIG. 13*a*. Such closure element elevation serves to maintain the needle element hook in closed condition in both "knit" and "tuck" operations. Such above disclosed closure element elevation is then maintained from about 27.5 to the midsector 30° selection point, i.e. from point "j" to point "k", again for both the "knit" and "float" operations.

As previously pointed out, the closing element control cam track curve 644 is symmetrical about the 30° midsector selection point and since curve 644 from such 30° selection point to the 60° sector termination radial is a mirror image of the above described configuration from 0° to 30°, further detailed description thereof would only be repetitive.

In a similar manner, the dotted line curve 646 on FIG. 13*b* depicts the path of vertical closure element displacement for "tuck" operations and wherein the inside cam butts 318 on the closure elements 310 are operatively disposed within the upper control cam track 354 on the inner cam track sleeve 78. In the "tuck" mode of operation, the closure element will be maintained at maximum elevation about the $Z_o$ base line from the 0° radial sector initiation point to about 6°, i.e. to about point "g". As is apparent from a comparison of the dotted closing element curve 646 with the solid needle element curve 640, the closing elements are maintained at a constant elevation from the 0° sector initiation location through about 6°, i.e. the point "g", within which subsector the needle element 290 is dropping from maximum elevation along curve 640 in FIG. 13*a*. At point "g", the needle element hook will be effectively open, in that the end of the closure element, while being approached by the downwardly moving needle will still be spaced from the needle hook. In the succeeding portion "1" the dotted line curve 646 is the same as the solid line curve 640, i.e. from point "1" to the midsector or 30° line, i e point "k", is the same as that previously described for solid curve 644. Again, the control cam track curve 646 is symmetrical about the 30° midsector selection point and since curve 646 from such 30° selection point to the 60° termination point is a mirror image of the above described configuration from 0° to 30°, further detailed description thereof would be only repetitive.

FIGS. 13*c*, *d* and *e* illustrate the vertical displacement paths of the sinker elements 474, the rake elements 608 and the terry instruments 518 respectively within a 60° operating sector, again in relation to the common $Z_o$ baseline, to provide ready comparison with the aforesaid vertical displacement paths for the needle and closure elements. More specifically, the curve 648 in FIG. 13*c* depicts the vertical displacement path of the sinker element 474 as the knitting cylinder 80 traverse the 60° operational sector; the curve 650, in FIG. 13*d* depicts the vertical displacement of the rake elements 608 within such unitary operational sector and the curve 652 in FIG. 13*e* depicts the vertical displacement of the terry bits 578 within a given operational sector. Again the symmetry of such displacement paths within the sector as defined by a pair of adjacent yarn feed stations at the 0° and 60° radials and the symmetry with respect to the midlocation 30° radial is apparent However, in contradistinction to the undirectional vertical displacement of the needle and closure elements in response to knitting cylinder rotation, the sinker elements 474, the rake elements 608 and the terry instruments 518 are also coincidentally displaced horizontally in the radial direction. The path of such horizontal radial movement for the sinkers, rakes and terry instruments in response to horizontal displacement effected by knitting cylinder rotation are illustrated in FIG. 13*g*. FIG. 13*g* depicts only the radial displacement paths for the 0° to 30° and 30° to 60° portion of the operating sector, it being understood that the displacement paths for the 30°–60° half thereof is a mirror images of the 0° to 30° half. As shown in FIG. 13*g* solid curve 660 is definitive of the radial displacement path of the sinker elements within the 0°–30° portion of the operating sector, the curve being the locus of the center of the hook section thereof. Dashed curve 662 is similarly definitive of the radial displacement path of the rake elements 608 with the curve being the locus of the end of the bifurcated arm of the rake members Dotted curve 664 is definitive of the radial displacement of tip portion of the terry instruments 518 in the radial plane. Dotted curve 666 is definitive of the radial path of travel of the terry bit shedding elements 552. The reference base line for such radial displacement comparison is the indicated back wall line 668 of the slots 82 on the knitting cylinder 80 against which the rear defining edge 670 of the needle elements 290 ride.

As an illustrative supplement to the foregoing FIG. 13*f* when vertically merged, is illustrative of the sequential positioning of the various yarn engaging elements as the knitting cylinder 80 traverses an operating sector. Such Figure when taken with FIGS. 14(1) through 14(18), which show the sequential positioning of the yarn engaging elements in side elevation, provide a graphic depiction of the stitch forming and clearing operation effected by the above described displacement paths. FIG. 13*f* also most clearly shows the initial stitch formation by conjoint vertical displacement of the compound needle elements and the sinker elements and the maintenance of constant spacing therebetween after stitch formation which, because of a capstan effect, effectively prevents "robbing back" and assures stitch formation solely through yarn delivery from a yarn source.

By way of illustrative specific example and as exemplary of element displacement in accord with the foregoing, the drawing down of a loop of yarn of a predetermined length is generally effected, concurrent with rotative displacement of the knitting cylinder away from a yarn feed location, by the following series of operations. The hooked end of a vertically reciprocable needle element is displaced downwardly from an upper limiting position to a lower limiting position as generally depicted by the portion of curve 640 in FIG. 13*a* disposed in the 0° to 15.5° angular sector of rotative knitting cylinder displacement and draws the engaged yarn downwardly therewith. During the first portion of such downward needle displacement and through the angular sector of 0° to about 11° the yarn is brought into engagement with the upper land surface on the sinker element which sinker element is concurrently being displaced conjointly in an upward direction as depicted by curve 648 on FIG. 13*c* and in the radial direction as shown on curve 660 on FIG. 13*g*. It should be noted that the upward displacement of the sinker is completed at about 13°, somewhat prior to completion of the downward displacement of the needle to its lower limiting position. The above described initial portion of the drawing down of a loop of yarn in the 0° to about 11° degree sector is shown on FIGS. 14(1) through 14(4).

As the needle continues its downward displacement (in the angular sector of about 11° to 15.5° as shown on FIG. 13*a*) and thus approaches its lower limit, the sinker continues its upward displacement until the rotative displacement thereof in association with the knitting cylinder reaches about 13° and continues its radial displacement until the knitting cylinder reaches about 18° of angular displacement. A transfer of the yarn loop from the first land to the second land on the sinker occurs during this latter portion of the downward displacement of the needle and such will normally be completed after a knitting cylinder rotation of about 15°, as shown in FIG. 14(5).

After the loop has been drawn during the two stages of a single downward displacement of the needle element, as above described, the formation of the stitch is completed by the subsequent upward displacement of the needle from its lower limiting position, as generally depicted by curve 640 in the 44.5° to 60° sector of knitting cylinder displacement in FIG. 13*a*. During this upward displacement of the needle, the sinker moves downwardly in conjunction therewith as shown by curve 648 in the 47° to 60° sector of knitting cylinder rotative displacement on FIG. 13*c* and conjointly in a radial direction as shown by curve 660 in the 42° to 60° sector of knitting cylinder rotation on FIG. 13*g*. During this period of upwardly directed needle displacement, the loop of yarn is slid down the cheeks of the needle to a position where the closing element can rise with the yarn selectively engaged only on its outer surface, as depicted in FIG. 14(13) through FIG. 14(18).

Yarn Feed Assembly

Each of the 60° operating sectors around the inner and outer cam track sleeves is bounded by and disposed within a pair of yarn feed locations, that is, there is a yarn feed location intermediate each operating sector. At each such yarn feed location there is provided an individual yarn feed assembly adapted to present, in the path of a downwardly moving open needle at each sector dividing line at least one body yarn, one elastic yarn and one terry yarn. Each of such yarn feed assemblies has the capability of presenting one or more yarns chosen from a plurality of available yarns in the needle path under control of the microprocessor.

While the herein disclosed knitting machine includes six discrete yarn feed assemblies, the construction and mode of operation of only one will be hereinafter described in detail, with the understanding that the other yarn feed assemblies are of similar construction.

Referring initially to FIGS. 2, 20 and 21 there is provided a housing 1010 mounted on an elevated pad 1011 in spaced relation above upper housing plate member 16 and in such manner as to properly position the hereinafter described operating elements of the yarn feed assembly in proper relation to effect introduction of selected yarns in the path of downwardly moving needle elements at the dividing line between adjacent operating sectors on the cam track sleeves.

Mounted within the housing 1010 is a yarn selection stepping motor 1012 having an extended pinion drive shaft 1014. Disposed in offset spaced relation with the pinion drive shaft 1014 and supported by an antifriction bearing 1017 mounted in housing 1014 is one terminal end of a cantilevered drive shaft 1016. Additional support for the drive shaft 1016 is provided by a second antifriction bearing 1019 mounted in housing extension 1021. Mounted on the shaft 1016 adjacent to support bearing 1017 is the hub of the sector gear 1018 whose arcuate toothed periphery is drivingly engaged by the pinion drive shaft 1014, whereby rotation of the stepping motor 1012 and of the drive shaft 1014 is converted into concurrent arcuate stepped displacement of the drive shaft 1016. Mounted adjacent to sector gear 1018 in such manner as to be freely rotatable on the shaft 1016 is the hub of a downwardly extending photocell blade member 1020. The photocell blade member 1020 is normally biased in one limiting position by a suitable spring member, not shown, and is displaceable in the opposite direction in accordance with the displacement of the sector gear 1018 by action of an extending pin member 1022 on sector gear 1018 that is sized to engage the marginal edge of the blade member 1020. Disposed adjacent the lower defining edge 1024 of the photocell blade member and appropriately located adjacent one marginal side edge thereof is an aperture 1026 that is displaceable into the path of a light beam emitted by a photocell assembly generally designated 1028, so as to provide an electrical signal indicative of one limiting position of the sector gear 1018 and accordingly of one limiting position for the shaft 1016.

In operation of the above described yarn selection assembly drive components, stepped rotation of the pinion drive shaft 1014 of the stepping motor 1012 effects a controlled stepped displacement of sector gear 1018 and the cantilevered drive 1016. Such stepped arcuate displacement of the sector gear 1018 is transmitted through extending pin member 1012 into commensurate stepped displacement of photocell blade member 1020 against the action of its biasing spring. At one limit of desired sector gear displacement the aperture 1026 in the blade member 1020 will be positioned in the path of the light beam traversing the photocell assembly 1028 to produce an electrical signal indicative of such limiting position of the sector gear 1018 and the cantilevered mounted drive shaft 1016.

Mounted on the outboard end of the housing 1010 is a fixed yarn guide sector element 1034 having a plurality, suitably 12 in the illustrated embodiment, of ceramic guide sleeves 1036 (see FIGS. 1, 2 and 20) mounted in radially spaced relation in an arcuate array adjacent the upper marginal end thereof. Such spacing and arcuate disposition of the ceramic sleeves 1036 provides for discrete separation of up to twelve separate yarns deliverable into the knitting machine from remotely located sources thereof as well as providing a fixed base location for the entry thereof into the operative machine environment.

Referring now to FIGS. 2, 22 et seq. mounted on the extending end portion of cantilever mounted rotatable drive shaft 1016 and rotatably displaceable in stepped increments in conjunction therewith is the hub 1042 of a generally sector shape yarn guide member 1038 This sector shaped yarn guide member 1038 has an equal number, suitably 12, of ceramic sleeve members 1040 mounted in spaced arcuate relation adjacent the periphery thereof with said sleeve members 1040 being generally disposed in the same positional arrangement as that heretofore described for the sleeves 1036 in the fixed guide member 1034.

As best shown in FIGS. 1 and 21, the hub 1042 is of elongate character and the remote end thereof serves to support a plurality of radially and longitudinally offset toggle clamp assemblies, generally designated 1044, with one toggle clamp assembly being provided for each path of yarn advance as delineated by the number and positioning of the ceramic sleeve members 1040 in the rotatably displaceable sector guide member 1038.

As will later become apparent and as best shown in FIGS. 26*a*, *b* and *c*, each toggle clamp assembly 1044 includes an individual toggle clamp subassembly for each of the identical yarn feed paths and, in the illustrated embodiment, there are 12 individual toggle clamp subassemblies mounted on the hub 1042 in progressive radially and longitudianlly offset relation. Each of the toggle clamp subassemblies includes a fixed jaw member 1050 mounted at the terminal end of a radially extended support member 1052 Disposed adjacent to each extended support member 1052 as elongate selectively shaped flexible spring member, generally designated 1054 As best shown in FIG. 26*b*, each flexible spring member 1054 includes a rectangularly shaped perimetric frame portion 1056 having the moveable jaw member 1058 of a clamp subassembly mounted at the upper end thereof and disposed for operative interfacial engagement with the fixed jaw member 1050 Disposed within the central aperture of the illustrated perimetric rectangular frame portion 1056 is an independently flexible and axially located tongue member 1060 integral at one end with the frame 1056 and having the other end thereof 1061 disposed in free spaced relation with the other end of the perimetric frame 1056. Mounted intermediate the free terminal end of the tongue member 1060 and the upper end of the perimetric rectangular framed 1056 is a generally C-shaped and normally compressively biased toggle spring member 1062 When so mounted in compressed relation, the C-shaped toggle spring member 1062 is operative to maintain, in stable condition, the clamping jaws 1050 and 1058 in either the open or closed relation but in no position intermediate thereof As best shown in FIG. 26*c*, both the fixed and moveable jaw members 1050 and 1058 are provided with complementally shaped serpentine facial configurations which, when disposed in interfacial proximinity, result in a firm compressive frictional capstan wrap engagement with a yarn disposed therebetween with such engagement creating a considerable friction resistance in the line of yarn advance but which, if desired, permits yarn displacement and removal therefrom in a direction perpendicular to that of normal yarn advance with application of only a small amount of force.

As will be hereinafter pointed out, the moveable and fixed jaw members 1050 and 1058 of each toggle clamp assembly are brought into closed interfacial relation by a rising rotative displacement of the ball plate 1076 of the cutter assembly solenoid 1078 which also acts to sever the particular yarns downstream of the above described clamping assembly. As will also later become apparent, the individual toggle clamps are opened by the yarn carrier arm 1134 as it engages and displaces a severed yarn end from a location intermediate the rotatable yarn guide 1038 and its respective clamp assembly 1044 longitudinally into the paths of the advancing needle elements for eventual engagement therewith.

Disposed immediately downstream of the above described toggle clamp assembly that serves to clamp and hold the individual yarns is a yarn cutting assembly, generally designated 1070. In contradistinction to the above described toggle clamping assembly which is compositely constituted of a plurality of individual clamping subassemblies, only a single yarn cutting assembly is provided to effect severance of a particular yarn element when the latter is appropriately positioned in the path of advance of the cutting element As necessitated thereby, the operative elements of the yarn cutting assembly are of a generally retractable nature so as to be positionable out of the path of yarn advance, when the cutting elements are not operative to effect a yarn cutting operation To the above ends and best shown in FIGS. 20, 21 and 25, there is provided a first cutting element 1072 mounted in offset relation at the end of an arm member 1074 that is secured to, and is rotatable through a predetermined arc in conjunction with, the rotatable displacement of the ball plate 1076 of the cutting element rotary solenoid 1078. As will be apparent to those skilled in the art, such mounting of the cutting edge 1072 on the solenoid ball plate 1076 effectively results in a helical displacement of such cutting edge with both rotational and lineal motion components attendant thereto in response to rotation of the shaft of the rotary solenoid 1078 The second cutting edge 1082 of the cutting assembly is mounted in offset relation adjacent one end of a rocker arm 1084 The remote end of the rocker arm 1084 is pivotally mounted on a base member supported clevis, generally designated 1086 As best shown in FIG. 25, the bifurcated end portion 1083 of the rocker arm 1084 is secured to the frame of the rotary solenoid 1078 at two diametrically opposed locations designated 1088. The rotating shaft 1090 of the rotary solenoid 1078 is pivotally secured to one end of a crank arm 1092. The remote end of crank arm 1092 is pivotally secured to the upper end of a generally vertically disposed link member 1094 and whose other and dependent end is pivotally secured to a clevis type mounting generally designated 1096.

In the operation of the above described unit, rotation of the shaft 1090 of the solenoid 1078 effects a concomitant rotation of the ball plate 1076 relative to the frame thereof. As the ball plate 1076 and the shaft 1090 of the cutting assembly solenoid 1078 rotate relative to the frame of the solenoid 1078, such motion, because of the above securement of the solenoid frame to the rocker arm 1084 effects a rotation of crank arm 1092 and a concomitant vertical elevation and slight rotative displacement of the second cutting edge 1082 mounted on the rocker arm 1084. Such elevation and rotative displacement of the second cutting edge 1082 is operative to elevate such cutting edge from a position beneath the path of yarn advance upwardly into the path of the yarn advance Concurrently therewith, the conjoint rotation of the ball plate 1076 effects a conjoint helical displacement of the first cutting edge 1072 in both the upward and transverse direction relative to the first cutting edge 1072. As will now be apparent the combined elevation and rotative displacement of the two cutting edges serve to elevate the cutting assembly from a location below and remote from the line of yarn advance, upwardly into the path of advance of the yarn and to concurrently effect severance of a yarn disposed in the path thereof by the scissor-like action of the approaching cutting edges.

Disposed downstream of the above described yarn cutting assembly and positioned in the path of advance of a body yarn, is a yarn usage monitoring assembly generally designated 1104. As best shown in FIGS. 1, 20 and 27, the yarn usage monitoring assembly 1104 basically includes a low inertia and freely rotatable wheel element 1106 having its periphery disposed for frictional engagement with the advancing yarn so as to be driven thereby and rotated in direct accord with the amount of yarn advance Disposed within the web-like body portion of the wheel element 1106 are a plurality of transverse apertures 1108 which are rotatably displaceable into and through the path of a light beam defined by a light emitter 12 and an associated light responsive photocell 1110. As will be apparent, every time one of such apertures 1108 passes through the light path, an electrical pulse will be generated. The number of such electrical pulses that are generated per unit of time is proportional to the rate of yarn advance and from which cumulative yarn advance over an extended period of time can readily be determined. Associated with the housing for the yarn usage monitor assembly 1104 is a guide track 1114 which is suitably located to selectively receive and guide the measured body yarn in its displacement path from its remote source thereof to the needle elements on the knitting cylinder.

Disposed downstream of the body yarn usage monitor 1104 and positioned directly adjacent to the needle elements at the line of demarcation between adjacent sectors on the knitting cylinder 80 is a yarn director assembly generally designated 1120. The illustrated and disclosed yarn director assembly 1120 is a selectively shaped two-channel guide element having a first channel 1122 adapted to guide the paths of the body yarn into the path of the advancing needle for engagement thereby and a second selectively located channel 1124 for guiding the path of advance of the terry yarn. Such channels are suitably located so as to properly dispose the body yarn and terry yarn in the path of advance of the needle elements and the terry bit elements as described earlier.

Referring now to FIGS. 2, 20, 21 and 29, the selective introduction of individual yarns and transport thereof from a location remote from the knitting cylinder into the path of advance of a downwardly moving open needle element and/or terry bit at the sector dividing line of the knitting cylinder is generally effected by means of a yarn insertion carrier arm assembly, generally designated 1130 on FIG. 21. As best shown in FIGS. 21 and 29, such yarn insertion assembly broadly includes an elongate carrier arm 1134 of somewhat triangular configuration having the base end 1135 thereof secured to the rotatable ball plate of a yarn insertion drive solenoid 1132. As best shown in FIG. 21, the rotary drive solenoid 1132 for a given yarn insertion carrier arm assembly is mounted on the housing of the adjacent yarn feed assembly and the elongate carrier arm member 1134 extends from said location a sufficient distance as to properly locate its remote end in appropriate operative positional relationship with the yarn feed assembly component of the adjacent unit wherein the selected yarn is to be introduced into position for engagement by the appropriate knitting needle and/or terry bit.

As best shown in FIGS. 21 and 29*a*, the base end 1135 of the elongate carrier arm 1134 is provided with a clevis type mounting 1136 on the ball plate of the solenoid 1132. Such clevis type mounting 1136 serves to permit rotative displacement of the carrier arm 1134 in conjunction with rotation of the solenoid ball plate 1038 and to concurrently permit an independent pivotal displacement of the carrier arm 1134 about the clevis pin 1037 to thus permit a controlled vertical displacement of the free apex end of the carrier arm 1134 in the vertical plane independent of its rotative orientation.

Mounted on the free apex terminal end of the extending carrier arm 1134 is a yarn engaging jaw assembly, generally designated 1140, which is adapted to selectively grasp, transport and release selected yarns in accordance with carrier arm displacement as will be described in detail hereinafter. As noted above the rotative position of the free or apex end of the carrier arm 1134 is effected by rotation of the drive solenoid 1132. Controlled elevation of the jaw assembly bearing free end of the extending carrier arm 1134, as well as the timed opening and closing of the jaw members in the jaw assembly supported thereby is effected through means of a dual channel arcuate cam track member generally designated 1141 in association with a pair of cam follower assemblies mounted generally at about the midlength of the extending arm 1134.

In more particularity, and as best shown in FIGS. 23, 24, 29 and 29*a* and *b*, there is provided a first flanged cam follower roller 1142 which, in operative association with the elevation control cam track slot 1146 in the cam track member 1141, serves to control the elevation of the free and yarn engaging jaw bearing end of the carrier arm 1134. Disposed closely adjacent thereto is a second cam follower roller assembly, generally designated 1144 which, in association with the jaw control cam track 1148 in cam track 1141, serves to control the timed opening and closing of jaw members of the jaw assembly 1140 necessary to effect yarn grasping, transport and release. As best shown in FIG. 29*b*, the first flanged cam follower roller 1142 is mounted at the dependent end of a dual clevis type mounting member 1150 which, through shaft 1152, is connected to and serves to support the extending carrier arm 1134 intermediate its base mounted terminal end on a solenoid 1132; see FIGS. 29 and 29*a*, and its extending free apex end. The lower clevis portion is sized to straddle the wall 1147 and to thus locate the roller 1142 within the cam track slot 1146. The structure and operation of the second cam follower roller assembly 1144 will be later discussed in conjunction with the operation of the jaw members mounted at the free end of the extending carrier arm 1134.

Referring now to FIGS. 29*c*, *d*, *e* and *f*, which depict in more detail the nature of the yarn engaging jaw assembly 1140, the free terminal end of the extending carrier arm 1134 is in the form of a clevis 1158 having a moveable jaw member 1160 and a detent position jaw member 1162 mounted on a common pivotal mounting 1170 therein to permit both independent opening and closing of the jaw members as well as a conjoint selective location of the entire jaw assembly at either one of two angular positions relative to the plane of the carrier arm 1134. The terminal end of the moveable jaw member 1160 includes a pair of extending tooth members 1164 sized to extend beyond the yarn engaging surface of jaw member 1162 when the jaws are in open condition in order to effectively limit the depth of introduction of the yarn to be transported therewithin. As more clearly shown in FIGS. 29*c* and *d*, the yarn engaging terminal end portion of the jaw member 1160 is of a serpentine configuration and the terminal end of the detent positioned jaw member 1162 includes a complementally shaped replaceable facing of relatively high friction material, suitably urethane, which effectively insures yarn retention within the closed jaws of the carrier arm during yarn transport displacement thereof.

As pointed out above, jaw members 1162 and 1160 respectively have a common pivotal mounting 1170 and are normally biased into closed position by a circular biasing spring 1172 having its ends disposed in suitable notches on the outer jaw surfaces. Conjoint pivotal displacement of both jaw members as a unit into either one of two limiting positions is attained through a two-position detent system. Such two-position detent system includes a transverse bore 1178 through fixed jaw member 1162 having a biasing spring 1180 disposed therein and operative to outwardly bias ball detents 1182 and 1184 located at the terminal ends thereof. Disposed in each of the facing walls of the clevis end 1158 of the arm 1134 are a pair of spaced ball detent receiving recesses 1186 and 1188 connected by an arcuate channel 1192 of lesser depth than the terminal recesses 1186 and 1188 but of sufficient depth to limit and guide the displacement of the ball detent elements when the latter are being displaced from one of the terminal recesses to the other. As will be apparent, the above described construction permits positioning of both jaw members as a unit at either one angular relation to the arm 1134 as determined by disposition of the detent balls in terminal recesses 1186 or at a second angular relation to the arm 1134 as determined by disposition of the detent ball in the second pair of terminal recesses 1188. As will hereinafter be pointed out such two positions provide for selective pickup of either a terry yarn or a body yarn by the jaw members and the proper positioning thereof at the knitting cylinder for engagement by the terry bits or by a downwardly moving needle as the case may be.

The opening and closing of the jaw members 1160 and 1162 against the action of the biasing spring 1172 in either one of the two above described detent controlled limiting positions is effected through manipulation of a pair of extending tapered tangs 1194 and 1196 on the remote ends of the jaw members. As most clearly shown in FIGS. 29*c* and 29*g* the extending tangs 1194 and 1196 define a tapered channel 1197 therebetween within which is disposed the terminal end of an elongate control rod 1198 which passes through a slotted aperture 1200 in a plate extending upwardly from the carrier arm 1134. The remote terminal end of the control rod 1198 is pivotally connected to one end of a vertically disposed link member 1202 and is biased in the retracted position by spring 1199. The link member 1202 is pivotally mounted above its midlength, as at 1204 within a suitable aperture 1206 in the carrier arm 1134. As best shown in FIG. 29*g* the dependent end of the link member is also hingedly connected to the body portion thereof, as at 1205, so as to permit displacement of the lower portion in a direction perpendicular to the axis of the link member so as to permit dual track operation of the cam roller 1148 mounted at the dependent end thereof. The remote dependent end of the link member 1202 supports, as noted above, a spherical cam roller 1208 which is sized to be contained and run within cam track 1148 in the control cam assembly member 1141. As will now be apparent, longitudinal displacement of the control rod 1198 in response to rotative displacement of the link member 1202 about its pivotal mounting 1204 effects a displacement of the terminal end thereof within the tapered channel 1197 defined by the extending tangs 1194 and 1196 on the jaw members. Such displacement of the rod 1198 against the action of its biasing spring will serve to effect a rotative displacement of the jaw member 1160 relative to the detent position jaw member 1162 against the action of the biasing spring 1172 to effect an opening of the normally closed jaw.

Selective positioning of the jaw assembly as a unit in either of the two detent determined limiting positions is effected by means of a plurality of selectively positionable cam elements 1210 mounted on the rotatable yarn guide member 1038 As shown in FIGS. 22 and 22*a*, a cam element 1210 is provided for each yarn and is located in radial alignment with each of the yarn guiding ceramic sleeves 1040 thereon. Each of such cams 1210 includes a terminal selectively shaped cam surface positioned and contoured to engage and to rotatably shift the jaw members as a unit as the jaw members are moved downwardly therepast after engaging a yarn positioned in the related ceramic sleeve 1040 As shown in FIG. 22*a* each of the positioning cams 1210 is pivotably mounted within a recess 1218 in the rotatable yarn guide member 1038 and are selectively positionable either in a stable retracted position within such recess by a spring detent 1216 or in a manually displaced stable outwardly extending position as indicated by the dotted lines in FIG. 22*a*. Displacement of the positioning cams from their retracted or nonoperative position to their extended or operative position is effected by a machine operator during machine setup operation prior to the making of a knitting run.

Operation

In the operation of the above described yarn feeding system the machine operator, during the initial setup and prior to initiation of knitting operations, will selectively and individually thread up to 12 separate yarns through the respective ceramic sleeves 1036 in the fixed yarn guide 1034 and through the respective ceramic sleeves 1040 in the rotatable sector shaped yarn guide element 1038. Following such threading the operator will secure the extending and free end of each of said threaded yarns in its respective and aligned toggle clamp in the toggle clamp assembly 1044.

With the desired yarns so threaded, positioned and clamped the operator will then manipulate the appropriate carrier arm jaw positioning cam 1210 on the rotatable yarn guide element 1038 to its operative position to assure the ultimate proper positioning of the carrier arm yarn engaging jaws in accord with the fact that if the initial yarn that is programmed to be picked up and engaged thereby is a selected body yarn or a terry yarn. As of this time and before knitting machine operation has started, there will be no yarns engaged by the needles in the knitting cylinder 80. To effect introduction of a selected yarn into the knitting cylinder, the yarn guide 1038 is displaced to locate the yarn to be selected and transported and introduced into the knitting cylinder into the path of the jaw elements on the carrier arm 1134, which carrier arm 1134 will be initially positioned in its counterclockwise limiting position as illustrated in the dotted line depiction of FIG. 21. As there shown and as depicted in FIG. 20 by its initial counter-clockwise position the jaw-bearing end thereof is disposed upstream of the yarn guide 1038 as indicated by the terminal end of the dotted line 1039 as positioned at 1039*a* in FIG. 20. Initial clockwise displacement of the carrier arm 1134 is attended by a concomitant upward displacement thereof sufficient to permit clearance of the yarn guide member 1038. After appropriate displacement past the yarn guide member 1038 the jaw-bearing end of the carrier arm 1134, with the jaws 1160 and 1162 thereof in their open condition, will be moved downwardly without interruption of rotative displacement thereof to receive the selected yarn between the jaw elements at a depth determined by the teeth 1164 thereon at which time the jaws will close to grasp the selected yarn in a serpentine configuration as determined by the shape of the jaw member. The downward movement of the carrier arm 1134 with the now closed jaw members 1160 and 1162 will continue and, if the selected yarn is to be a body yarn, engagement of the closed jaws with the displaced cam 1210 disposed in the path of advance thereof will effect a pivotal displacement of the closed jaw assembly as a unit to the appropriate detent controlled limiting position for the handling of a body yarn. The continued downward movement of the jaw-bearing end of the carrier arm 1134 is also operative to effect an opening of the toggle clamp jaws 1050 and 1058 that had previously been in compressive engagement with the selected yarn that has now been picked up, thus freeing the loose end thereof. Such toggle clamp opening is effected by engagement of the dependent end of the jaws with an extended link 1066 that is fixedly mounted at one end 1063 thereof to effect a displacement of the free end thereof 1067 in an arcuate downward path to contact the C-shaped toggle spring 1062. Engagement of the displaced link 1066 effects a reversal of the toggle action and in a consequent opening of the clamp to the open position as shown at 1069. As there shown, the base extending teeth 1048 thereof serve in the open position as an available yarn guide channel The general path of travel of the free end of the carrier arm 1134 is, as previously noted, illustrated by the dotted line starting and finishing positions on FIG. 21. As will be apparent therefrom and as indicated on FIG. 20 the pickup point for the selected yarn is at the location where the jaws are tangent to the yarn advance line at a location roughly midway between the moveable sector guide 1038 and the toggle clamp assembly 1044 as generally illustrated by the reference number 1039*b*, see FIG. 20.

Following the opening of the toggle clamp and release of the free end of the selected yarn, the jaw-bearing free end of the carrier arm 1134 having the selected yarn now firmly grasped thereby is then moved upwardly in the vertical direction while at the same time it is continuously being arcuately displaced toward the knitting cylinder 80 as it is moved toward the dotted line depiction in FIG. 2. Such motion will continue until the yarn engaging closed jaw members 1160 and 1162 are moved over the knitting needles and disposed behind tee path of the raised needle elements in the knitting cylinder 80. At such time the yarn grasped thereby will be positioned in the path of advance of the knitting needle ready for engagement thereby. In general, the grasped end of the selected yarn when so positioned will be located in front of the retracted shedding element, immediately above the terry bit and so positioned that the downward movement of an advancing open needle member will engage the selected yarn at a location adjacent to the closed jaws 1160 and 1162 on the carrier arm 1134. The continued downward and advancing movement of such needle elements will cause the selected yarn to be introduced into the body yarn channel 1122 on the yarn director member 1120 and, at the same time, will effect a reintroduction of the selected and now advancing yarn into its respective open toggle clamp. In such manner, the open toggle clamp is available to serve as a yarn guide and will properly orient the advancing yarn so as to effect the coordinate introduction thereof into operating engagement with the rotating wheel 1106 in yarn usage monitor assembly 1104. As will be apparent, continued rotative advance of the knitting cylinder 80 will result in successive yarn engagement by the advancing and downwardly moving needle elements and in a positive drawing of the selected yarn from a remote supply thereof through its ceramic sleeve 1038 in the fixed yarn guide 1036, through its ceramic sleeve 1040 on the moveable yarn guide 1038, through the yarn usage monitor 1104, through the yarn director 1120 and into the fabric being formed on the knitting cylinder. The introduction of such selected yarn to the fabric being formed and the continual displacement of the knitting cylinder 80 will also effect a withdrawal of the tail of the previously selected and transferred yarn from the carrier arm jaw assembly by displacement thereof in a path generally normal to that of the serpentine engagement between the clamping jaw ends. The carrier arm 1134 will be rotated back to its starting position in front of the moveable yarn guide 1038 in response to solenoid actuation for subsequent repetitive action in accordance with preprogrammed instruction.

The above described operation of effecting selected yarn transfer and introduction thereof into the fabric being formed on the knitting cylinder can be effected at any desired time in accordance with preprogrammed instruction and accompanying programmed displacement of the rotating guide element 1038 to place a newly selected yarn in the path of displacement of the carrier arm jaw assembly as described above.

Removal of a previously engaged yarn currently being drawn into the fabric being knit is effected by selective rotation of yarn guide 1038 to introduce the yarn to be cut into the path of the cutter and the selective operation of the yarn cutting assembly 1070 through operation of the solenoid 1078 in the manner described above The cutting action of the yarn cutting assembly 1070 is also operative to effect a closure of the otherwise open toggle clamp associated with the advancing yarn that is being subjected to the cutting action through the engagement of the extending trip arm 1067 mounted on rocker arm 1084 with the toggle clamp related to the yarn. The closure of the associated toggle results in a regrasping of the severed yarn at a location upstream from the cut end thereof. Subsequent to severing of the yarn in the manner described above rerotation of the moveable yarn guide 1038 will place a newly selectable yarn in the path of advance of the jaw-bearing end of the carrier arm 1134 for introduction into the knitting machine in the manner described above.

Data Processor Control System

As will be now apparent to those skilled in this art, the symmetry of the vertical and horizontal displacement paths of the yarn engaging knitting elements within each operating sector bounded by yarn feed locations when coupled with the operability of knitting, tucking or floating on each needle at each yarn feed location independent of the direction of knitting cylinder rotation is particularly well adapted to preprogrammed control of machine operations by a data processor or computer. Likewise the electrical signals emanating from the stitch length control system, the yarn consumption measuring system and from the various stepping drive motors are all functionally adapted to such data processor control.

To the above ends the mechanical functions described hereinabove are electrically and electronically controlled in the general manner illustrated in FIG. 31. Since all knitting machine units are contemplated to be substantially identical from a functional viewpoint, the subscript employed to identify a specific knitting machine unit in FIG. 30 is omitted in FIG. 31 whereby description of knitting machine unit 802 is intended to also describe any one of knitting machine units $802_1$, $802_2 \ldots 802_N$ of FIG. 30.

Referring now to FIG. 31, knitting machine block 816 generally includes all of the mechanical, electrical and electromechanical components previously described and receives a selectable set of yarn strands from a yarn feeder designated by 818. A remote yarn supply creel 820 contains all of the yarns which may be called for by yarn feeder 818 and feeds them through a set of auxiliary yarn use sensors 822 to yarn feeders 818. Since knitting machine 816, yarn feeders 818, remote yarn supply creel 820 and yarn use sensors 822 are either conventional or have been fully described herein, further description of these elements will be omitted here.

All functions performed within knitting machine unit 802 are controlled by a unit CPU 824 which receives its style and production quantity instructions from, and provides data to, system data bus 804. Unit CPU 824 is the sole link between the outside world and a knitting machine unit 802. All data coming in and passing out from and to system data bus 804 is communicated on a bus 826. Internal to knitting machine unit 802, the CPU 824 communicates either directly or through a unit data bus 828. A unit random access memory (RAM) 830 communicates with unit CPU 824 solely through unit data bus 828. Unit RAM 830 stores the data and operating instructions for unit CPU 824. Certain of the required data and instructions are retrieved from unit RAM 830 by unit CPU 824 prior to the need for such data and these are stored in a scratch pad RAM 832 using a bus 834 directly connected between scratch pad RAM 832 and unit CPU 824 without passing through the intermediate communication path of unit data bus 828. As is conventional, scratch pad RAM 832 has relatively limited capacity but is extremely fast compared to unit RAM 830. Thus, data can be retrieved from unit RAM 830 by unit CPU 824 at convenient times and temporarily stored in scratch pad RAM 832 prior to the need therefor Once the need for such data does arise, it can be very rapidly retrieved from scratch pad RAM 832. Scratch pad RAM 832 may contain, for example, the knitting program for the next stitch in each sector as well as yarn feeder instructions for the next stage. Alternately, scratch pad RAM 832 may contain some or all of the instructions for knitting machine unit 802 operations for one set of sectors.

At appropriate times, unit CPU 824 produces sets of six needle and six closing element control signals on a set of lines 836 which are applied to bipolar coil drivers 838. Bipolar coil driver 838 thereupon produces six needle control signals and six closing element signals which are applied, respectively, to the appropriate control electromagnets 452 in knitting machine 816. As was previously described, electromagnet 452 requires a reinforcing pulse to retain the needle and closing element magnetic containment pads in interfacial abutment with the wear plates as they pass the gap between electromagnets 710 and 712 (not shown in FIG. 31). In a preferred embodiment, in the absence of a command to retain the magnetic containment pads in abutment with the wearplates, a flux negating pulse is applied by bipolar coil driver 838 to the appropriate electromagnets 714 to positively overcome the effect of the permanent magnet retention flux as the magnetic retention pads pass in front of control electromagnet 452 and thereby release the magnetic containment pads to permit the potential energy stored therein by virtue of their prior mechanical biasing into their flexed positions to initiate the return thereof to their normally biased and unflexed condition. As has been previously explained, the three valid conditions of needle and closing element signals to each sector determine whether the resulting operation is a knit, tuck or float.

It will be realized that bipolar coil driver 838 contains 12 coil drivers (six needle coil drivers and six closing element coil drivers). All 12 coil drivers are substantially identical and, therefore, only one will be described in detail. Referring to FIG. 32, a bipolar coil driver, part of 838, is shown in which the drive signal from unit CPU 824 is applied to an input of an optical coupler 840 via line 836. Optical coupler 840 is operative to either apply or remove a plus 15 volt voltage source to the top end of a resistive voltage divider consisting of resistors R1, R2, R3, R4, R5 and R6 whose opposite end is connected to minus 15 volts. Breakdown diodes D1 and D2 establish a required input voltage to the plus input of an operational amplifier 842 which has the coil of a control electromagnet 452 connected in series between its output and its negative input. A current control resistor R7 is connected between the negative input of operational amplifier 842 and ground to control the amount of current which passes through the coil and control electromagnet 452 For example, if resistor R7 is 1 ohm, at appropriate input voltage levels, a current of 1 ampere will be driven through control electromagnet 452. If the resistance of resistor R7 is changed, the current driven through control electromagnet 452 is correspondingly changed.

Referring again to FIG. 31, a unit I/O 844 communicates with unit CPU 824 via lines 846 for providing signals to an output isolator and wave shaper 848 and receiving signals from input isolators 850. The isolator portion of output isolators and wave shapers 848 are preferably optical isolators in order to isolate unit I/O 844 and unit CPU 824 from electrical noises likely to exist in the factory environment of the electrical and electromagnetic components of knitting machine unit 802 and other equipment nearby. In response to signals from unit I/O 844, output isolators and wave shapers 848 provide a tail air blowoff signal, six yarn inserter control signals and six yarn cutter signals to yarn feeders 818. In addition, output isolators and wave shapers 848 provide a sock transport signal, a presser cam control signal and a terry cam control signal to knitting machine 816. In order to speed the response of yarn feeders 818 and knitting machine 816 to the control signals, the wave shaper portions of output isolators and wave shapers 848 respond to the step input signal such as shown in FIG. 33A by producing an output having a high initial spike such as shown at 852 in FIG. 33B which is much higher than the actuators in yarn feeders 818 and knitting machine 816 can survive on a continuous basis, followed by a rapid decay to a quiescent level 854 to complete the actuation. By essentially overdriving the actuators in this way during the initial spike, more rapid response to the control signal of FIG. 33A is achieved.

A main drive motor controller 856, a stitch length motor controller 858 and a yarn feed motor controller 860 receive input signals from unit data bus 828 which they employ to drive respective stepping motors 52, 130 and 862. All of these motors and their controllers are identical except that yarn feed motor controller 860 contains six motor controllers individually feeding six yarn feed stepping motors Since the controllers and motors are identical, only those elements associated with the main drive are described in detail.

Referring now to FIG. 34, main drive motor controller 856 is seen to contain a bus I/O 864 receiving main drive motor control signals from unit data bus 828 and producing four separately phased control signals on lines 866, 868, 870 and 872 which are respectively fed to coil M1 current driver 874, coil M2 current driver 876, coil M3 current driver 878 and coil M4 current driver 880. It is contemplated that all of these current drivers are identical and, therefore, only coil M1 current driver is shown in detail and described hereinafter.

Coil M1 current driver 874 includes a AND gate 882 receiving the control signal from line 866 at one of its inputs. The output of AND gate 882 is applied to the base of a series current limiting transistor Q1. The collector of transistor Q1 is connected to the base of a control transistor Q2 between a voltage +V and wear end of coil M1 in main drive motor 52. The other end of coil M1 is connected through a sampling resistor R4 to ground. Voltage +V has a value substantially higher than the voltage which coil M1 can sustain For example, if coil M1 is a 10-volt coil, voltage +V may be 10 times as high, that is, 100 volts.

Sampling resistor R4 has a small value of resistance and thereby produces a voltage at its upper end which is proportional to the current in coil M1. If resistor R4 is, for example, 1 ohm, a current of 4 amperes in coil M1 produces a voltage of 4 volts at the upper end of sampling resistor R4. This sample voltage is applied to the plus input of a comparator 884. A positive voltage produced by a voltage divider consisting of resistor R2 and variable resistor R3 is applied to the minus input of comparator 884. An output of comparator 884 is applied to the second input of NAND gate 882.

In the absence of a control signal on line 866, NAND gate 882 provides an enable signal to the base of transistor Q1 which is thereby turned on and grounds the base of transistor Q2. Thus, no current is permitted to flow through coil M1. This holds the voltage at the plus input of comparator 884 at zero and thus the inverting output thereof is high or one. When a high or one signal is received at the second input of NAND gate 882 from line 866 (FIG. 35A), the output of NAND gate 882 changed from high to low. This cuts off transistor Q1 and permits conduction in transistor Q2 from emitter to collector and through drive coil M1. Due to the inductance in drive coil M1, it takes an appreciable time for the current in coil M1 to rise. If the normal drive current were applied to coil M1 without the control system shown, the current rise would be relatively slow as indicated in FIG. 35B. However, the actual voltage applied to drive coil M1 is much higher than the voltage required to drive the normal value of current therethrough. Therefore, the current through coil M1 rises much more rapidly from zero to an initial peak at a point 886 at which time the voltage developed by sensing resistor R4 exceeds the reference voltage at the minus input of comparator 884. The resulting low at the inverting output of comparator 884 inhibits NAND gate 882 and again turns transistor Q1 on to ground the base of transistor Q2. The current in coil M1 decays until it reaches a first minimum 888 at which time the voltage at the plus input of comparator 884 has decreased to a value less than the reference voltage at its minus input. This again enables the second input of NAND gate 882 and cuts off transistor Q1 to again apply the full voltage +V at the top end of coil M1 to again produce a current buildup in coil M1. This process continues to the end of the control signal (FIG. 35A) at which time line 866 applies a low or zero signal to an input of NAND gate 882 to again hold the base of transistor Q2 at ground. The time constant for this circuit is much less than the normal switching cycle of the motor.

Referring again to FIG. 31, a shaft angle encoder 890 which may be of any convenient type such as, for example, an optical shaft angle encoder is mechanically coupled to knitting machine 816 to provide 10 cycles of a sine signal on a line 892 and 10 cycles of a cosine signal on a line 894 for each needle position in knitting machine 816. The sine and cosine signals are applied to a forward-reverse decoder 896, to be described hereinafter. Forward-reverse decoder 896 provides a direction signal on a line 898 to unit CPU 824 indicating whether knitting machine 816 is moving in the forward or reverse direction. It is characteristic of forward-reverse decoder 896 that it multiplies the frequency of its input signals by a factor of two and applies the resulting signal to a divide-by-20 counter 900. After division by five in divide-by-20 counter 900, an output is applied on line 902 to unit CPU 824 which is exactly in step with the needle positions in knitting machine 816. In order to establish synchronism between the shaft angle positions derived from shaft angle decoder 890, a shaft home-position encoder 904 is provided which produces a single home-position output signal at a predetermined rotational position of knitting machine 816. Shaft home-position encoder may be any convenient electromechanical or electro-optical device capable of generating a home-position signal but, in the preferred embodiment, an electro-optical sensing device is employed. Such electro-optical sensing device may, for example, be similar to light source 178, photocell 180 and aperture 182 employed in stitch length home-position encoder previously described. The shaft home-position signal is applied to unit CPU 824 which thereupon establishes synchronism between the shaft angle signals and the actual position of knitting machine 816. Although shaft home-position encoder 904 is shown applying its output directly to unit CPU 824, it may alternately provide such signal through an input isolator such as, input isolator 850 and through unit I/O 844.

Stitch length home-position encoder composed of elements of 178, 180 and 182 applies its output home-position signal to input isolators 850 from whence its isolated signal is applied through unit I/O 844 to unit CPU 824 Similarly, a set of six yarn feeder home-position encoders 906, one encoder for the yarn feeder of each sector, produces a set of six independent yarn feeder home-position signals which are applied on six lines 960 to input isolators 850.

A set of six yarn use encoders 910 measure the amount of yarn being used by each of yarn feeders 818 and apply signals containing this information on six lines 912 to input isolators 850. By keeping track of the yarn actually used in the six sectors, yarn use encoders 910 provide information to CPU 824 and from there to system computer 806 (FIG. 30) which permits system computer 806 to perform inventory evaluation of yarn supply and do other bookkeeping functions. In addition, unit CPU 824 or system computer 806 may be programmed to alert the machine operator to impending depletion of a particular yarn in the remote yarn supply creel 820 prior to the occurrence thereof so that timely substitution of a new supply may be performed.

As is conventional in knitting machines, remote yarn supply creel 820 contains reels of all of the yarns which may be employed in knitting. As is further conventional, a yarn tension sensor is employed on each yarn actually being fed to knitting machine 816 to sense insufficient tension which may be a result of yarn breakage or depletion and yarn excessive tension which may indicate yarn feeding difficulties. Since the knitting machine of the present invention may simultaneously employ six or more strands of yarn, a yarn tension sensor 914 for each yarn end is provided. Yarn tension sensors 914 produce a machine stop signal on a line 916 which, applied through input isolators 850 and unit I/O 844 to unit CPU 824 causes unit CPU 824 to stop the operation of knitting machine unit 802 until the cause of improper yarn tension is found and corrected.

Referring now to FIG. 36, forward-reverse decoder 896 includes an exclusive OR gate 918 receiving the sine and cosine signals from lines 892 and 894 at its inputs. In addition, the sine signal is applied to the D input of a flip flop 920. Similarly, the cosine signal on line 894 is applied to the D input of a flip flop 922. The output of exclusive OR gate 918 is applied to the clock inputs C of flip flops 920 and 922. It should be noted that the output of exclusive OR gate 918 has been delayed by one gate delay therein and tends to arrive at the clock inputs C slightly later than the D inputs to flip flops 920 and 922. Since the data inputs D are effective to trigger these flip flops only when their C inputs are high or one, this slight gate delay makes a difference in whether or not the respective flip flops are triggered depending on the direction of rotation of the knitting machine. Referring to FIGS. 37A, 37B and 37C, if the knitting machine is rotating in the reverse direction, the positive-going leading edges of the sine signal in FIG. 37B are seen to occur before the transition of the output of exclusive OR gate 918 shown in FIG. 37C However, the positive-going leading edges of the cosine signal in FIG. 37A are seen to occur within the high or one condition of the output of exclusive OR gate 918. Thus, flip flop 922 is triggered into the set condition and produces a one on reverse line **898*b* for application to unit CPU 824 If rotation is in the forward direction, the sense of the delay of the output of exclusive OR gate 918 is reversed In that case, high or one output is produced on line 898*a* from flip flop 920** indicating this direction of rotation.

It should be noted that the output of exclusive OR gate 918 shown in FIG. 37C is twice the frequency of either the sine or cosine signal Thus, although the sine and cosine signals are produced at the rate of 10 cycles per needle position, the exclusive OR output contains 20 cycles per needle position. For this reason, divide-by-twenty counter 900 (FIG. 30) is required to count down the exclusive OR output so that the signal fed to unit CPU 824 is in one-to-one correspondence with needle positions.

The construction of a sock requires a complex serial assemblage of separate yarn knitting techniques and procedures simultaneously going forward at a plurality of locations about a knitting cylinder. Knitting starts at the top of the sock or the welt, where it is required to provide an initial elastic band around which the fabric knitting operation may start. As the knitting operation progresses, the leg portion of the sock is knit more loosely through certain stitch formations so as to readily permit the foot to enter the sock top and yet provide the ability to cling to and hug the ankle and leg. This may be accomplished by including a plurality of expandable mock ribs.

In the area where such ribs are knitted, spandex or other elastic covered yarn is spirally wound through the fabric, i.e. "laid in". In addition, decorative panels may be included in this portion of the sock which contain multicolored decorative patterns.

As the knitting operation continues below the rib portion of the sock, additional yarns my be introduced to plate to the outside of the sock. Such yarns serve to provide enhanced shoe wear resistance and structural strength for the softer, more delicate yarns which are normally disposed on the inside of the sock.

In addition to the above, socks which have knit-in heels present an additional complexity required by the knitting of a heel pocket on one or more feeds in conjunction with reciprocation of the knitting cylinder. That is, instead of having the yarn supplied to the machine knit continuously around and around the sock like a spiral staircase, the knitting operation progresses in a reciprocating manner over a diminishing sector of the knitting cylinder. The courses formed in this operation are then sutured to the main portion of the sock as the heel is completed. Finally, it may be also necessary to reciprocate the knitting cylinder to form a toe pocket which is subsequently closed to complete the sock.

Traditionally, these operations have taken place sequentially at one or more feeds in the knitting machine. That is, all body or terry yarn has been knitted at a location that is separate and distinct from the point of introduction of spandex.

This traditional separated feed approach has been necessitated wholly because of the programming complexity and latch needle camming required to control the needles. The knitting machine of the present invention has six feeds and is capable of forming any type stitch on any needle at any feed. However, because of the multiple feed locations and the increased number of options at each feed, needle selection and instruction becomes far more complex This problem becomes especially acute at the transition interfaces between the various zones of the sock described above. While, mechanically and electronically, the above described machine is capable of deciding whether to knit, tuck or float on each needle as it approaches each feed from either direction, organization and issuance of the necessary instructions becomes quite complex.

In addition, such instructions must be issued by the computer in response to interrupt information delivered by the machine as to needle location within a narrow time interval again determined by mechanical machine parameters. In the subject device and in contradistinction to more conventional practice, the real time operation of the computer must be subservient to the mechanical knitting machine operations. Such drastically limits the time available for the necessary interrupt service routines, and requires an efficient means of storage and retrieval of the required data.

In the subject machine, the sock is formed by sequentially advancing the needles by the yarn feeds in the order that the yarn feeds actually appear on the machine That is, if the cylinder rotates in a forward direction, each needle will first encounter yarn feed 0, then yarn feed 1 and so on until it passes yarn feed 5. In order to introduce different yarns into the construction of the sock for different purposes, each yarn feed may be doing a different operation. For instance, needles approaching a yarn feed which introduces spandex into the machine will never knit. If the mock rib being formed is $3\times2$ rib, the spandex yarn feed will have a sequence of operations: tuck, tuck, float, float, float, tuck, tuck, etc., whereas the adjacent yarn feeds will be knitting yarn on all needles.

In order to form a sock on the described machine, there is required a steady stream of data to each of the six selection control positions (12 coils) each located at the sector midpoint between the yarn feeds at the sector ends. These selection control positions will determine what the needle and closing element will do as they approach a given yarn feed from either direction.

From the above description, it can now be seen that operation requires the computer not only to prescribe what operation—knit, tuck or float—is to be required for each compound needle but to be aware of the location of each such compound needle at all times.

As the sock is fabricated, yarn may be introduced at all six feeds or in some situations at none of the feeds. Additional courses in the sock result only from knitting on a feed where yarn is introduced. All of the selection coils must operate on all the needles and closing elements at all times. Even if a needle function is only to pass by the feed without engaging the yarn, a float command must be issued to the selection coils for that needle and closing element in advance of the approach of that needle and closing element to that particular feed. Such a situation occurs many times when no yarn is introduced at a feed as well as in the cases of when the yarn passes behind the needle.

The conventional approach to the required data organization in a computer memory would be to arrange the data in a continuous stacked sequence for each selection coil by requiring six queues containing the number of elements corresponding to the number of needles passing each feed in the whole process of producing the sock.

However, it is virtually impossible for a human being to organize such required data for a complex sock into this type of a structure because such sock is formed like a multiple pitch screw. The pitch of the multiple pitch screw analogy changes many times as the sock is formed. For example, when knitting occurs on all six feeds, the fabric advances like a six start screw. However, when the welt is wound, spandex is introduced on one feed only and although the cylinder rotates four or more turns no knitting occurs on any feed and hence the pitch of the screw is zero and no finished course in the sock results from such four revolutions of the cylinder.

In the preferred embodiment of FIG. 31, the data is organized in unit RAM 830 in 108 queues, one for each needle in the machine or more importantly, one for each wale in the sock. By inserting the instructions into unit RAM 820 in this manner, it is a relatively straightforward job for the designer of the sock to specify what must happen on each needle from the welt to the toe of the sock. The data in unit RAM 830 is, therefore, configured as if one took a pair of scissors and slit the sock along a wale from the top to the bottom and laid the fabric out in a rectangle.

Because conventional microprocessors such as, for example, the Intel 8086 microprocessor can only retrieve or store data in either a byte (8 bits) or a word (16 bits), with each command the sock data for the described machine is stored in 18 major queues (18 words) in which each major queue consists of 6 minor queues. The needle selection commands require two bits, therefore, each minor queue consists of 2 bits of information (representing knit, tuck, float, and an illegal feed command) with all six feeds using 12 of the possible 16 bits of data in each major queue. Unit CPU 824 is programmed to reject an illegal feed command. Below is a summary of the feed data stored in each major queue:

| | | | | | | |
|---|---|---|---|---|---|---|
| Major queue 00 | needle 00, | 18, | 36, | 54, | 72, | 90 |
| 01 | 01, | 19, | 37, | 55, | 73, | 91 |
| 02 | 02, | 20, | 38, | 56, | 74, | 92 |
| 03 | 03, | 21, | 39, | 57, | 75, | 93 |
| 04 | 04, | 22, | 40, | 58, | 76, | 94 |
| . | . | . | . | . | . | . |
| . | . | . | . | . | . | . |
| . | . | . | . | . | . | . |
| 16 | 16, | 34, | 52, | 70, | 88, | 107 |
| 17 | 17, | 35, | 53, | 71, | 89, | 108 |

The present invention further includes a unique accessing technique. For purposes of illustration and by way of analogy, assume that the queues are 108 vertical pipes arranged in a cylindrical configuration, one for each wale in the sock. Each pipe contains a stack of marbles, one on top of the other and free to drop. The marbles are of three different colors equated to the selection commands of float, tuck or knit.

Positioned beneath this cylindrical assemblage of pipes is a carousel with six equally spaced radial arms the types of which rotate beneath the pipes and which is turned as the knitting machine cylinder rotates. When the tip of each radial arm is beneath a pipe, it effects a release of the waiting marble in that pipe and it then assembles the information sequentially from all six arms into a twelve bit word which is, in turn, released to the selection coils The carousel rotates forward and backward in phase with the rotation of the knitting cylinder by receiving commands from the "divide-by-20" counter 900 which is driven directly from the main motor shaft angle encoder 890.

When the first arm is under queue 0, the second arm is under queue 17 and the third arm is under queue 35, etc. The CPU functions so as to remove the information it needs from the appropriate queues simultaneously and to direct that information to the appropriate selection coil. Arm 1 on the carousel is associated with the selection coils disposed between feeds 0 and 1, arm 2 with the selection coils between feeds 1 and 2, etc. Using this method, it is possible to stop the cylinder rotation at any point and reverse its direction while still providing all the information necessary to effect control of every needle and associated closing element as it approaches each yarn feed location.

In the above conceptual description, it will be recognized that unit RAM 830 may function as the cylindrical assembly of pipes storing the entire sock program and that scratch pad RAM 832 may perform the function of the carousel receiving the next-required set of data.

The arrangement of data in this structure and the above described accessing method effectively perform a rectangular to helical coordinate transformation to allow the machine to properly structure the garment from a simple rectangular array depicting the unwrapped garment. In other words, this data storage structure converts a two-dimensional rectangular array of data into a variable pitch three-dimensional helix.

As the conceptual carousel rotates past each queue (in either direction), an incrementing count in unit RAM 830 is advanced, thus monitoring progress toward completion of the garment. Incidental functions such as yarn selection, yarn insertion, yarn removal, cylinder speed setting, terry selection, stitch length setting, presser cam position, tail air blowoff, and sock transport commands are contained in a separate data stack in unit RAM 830 and accessed as needed. When the incrementing progress count is equal to the next value in a sequential look-up table, the next incidental command will be popped from its stack and executed.

Unit CPU 824 is responsive to other special incidental commands. One such command causes unit CPU 824 to review the yarn use signal from one of yarn use encoders 912 at a selected feed. This information may be used to incrementally modify the stitch length setting so as to compensate for machine part wear and changes in the coefficient of friction or yarn tension at a given instant in the knitting process. It also allows the CPU to update total yarn consumption by the machine.

Having thus described my invention, I claim:

1. In the circular weft knitting of articles, the step of selectively displacing a yarn engaging hooked end needle element in a discrete vertical and circumferential displacement path in response to knitting cylinder rotation that is symmetric about each of a pair of adjacent yarn feed locations and which is also symmetric about midlocation halfway between said pair of adjacent yarn feed locations independent of the direction of circumferential displacement thereof effected by said knitted cylinder rotation.

2. In the circular weft knitting of articles as set forth in claim 1, the step of concurrently displacing a yarn engaging sinker element associated with said hooked end needle element in a composite vertical and radial displacement path in response to knitting cylinder rotation that is symmetric about each of said pair of adjacent yarn feed locations and that is also symmetric about the midlocation halfway between said pair of adjacent yarn feed locations independent of the direction of circumferential displacement thereof effected by said knitting cylinder.

3. In the circular weft knitting of articles as set forth in claim 1, the further step of concurrently displacing a terry instrument associated with said hooked end needle element in a discrete composite vertical and radial displacement path that is symmetric about each of said pair of adjacent yarn feed locations and that is also symmetric about the midlocation halfway between said pair of adjacent yarn feed locations to form terry loops concurrent with the knit article fabrication.

4. In the circular weft knitting of articles as set forth in claim 3, the further step of radially displacing a shedding bar in timed synchronous relation with said displacement of said hooked end needle element and terry instrument to positively removed formed terry loops from operative engagement with said terry instrument.

5. In the circular weft knitting of articles as set forth in claim 1, the further step of concurrently displacing a stitch shedding rake element associated with said hooked needle element in a discrete conjoint vertical and radial displacement path in response to knitting cylinder rotation that is symmetric about each of said pair of adjacent yarn feed locations and that is also symmetric about the midlocation halfway between said adjacent yarn feed locations independent of the direction of circumferential displacement thereof effected by said knitting cylinder rotation.

6. In the circular weft knitting of articles as set forth in claim 1, the further step of concurrently displacing a yarn engaging sinker element associated with said hooked end needle element in a composite vertical and radial displacement path in response to knitting cylinder rotation that is symmetric about each of said pair of adjacent yarn feed locations and that is also symmetric about the midlocation halfway between said adjacent yarn feed locations independent of the direction of circumferential displacement thereof effected by said knitting cylinder rotation and concurrently displacing a stitch shedding rake element associated with said hooked end needle element in a discrete conjoint vertical and radial displacement path in response to knitting cylinder rotation that is symmetric about said pair of adjacent yarn feed locations and that is also symmetric about the midlocation halfway between said adjacent yarn feed locations independent of the direction of horizontal displacement thereof effected by said knitting cylinder rotation.

7. In the circular weft knitting of articles through controlled displacement of compound needle members, the step of selectively effecting the displacement of a yarn engaging hooked end needle member in one of the two available discrete vertical and circumferential displacement paths in response to knitting cylinder rotation, each of said discrete vertical paths being symmetric about each of a pair of adjacent yarn feed locations and each of which discrete paths is also symmetric with respect to the midlocation halfway between said pair of adjacent yarn feed locations independent of the direction of circumferential displacement thereof effected by said knitting cylinder rotation.

8. In the circular weft knitting of articles as set forth in claim 7, the further step of effecting the selection of the desired discrete displacement path for said compound needle member in accord with preprogrammed instructions.

9. In the circular weft knitting of articles as set forth in claim 7, the step of selecting the desired discrete displacement path for said hooked end needle member as said needle element is displaced past the midlocation between adjacent yarn feed stations by said knitting cylinder rotation.

10. In the circular weft knitting of articles as set forth in claim 7, the further step of selectively effecting the displacement of a closing element operatively associated with said hooked end needle member in one of two available discrete composite vertical circumferential displacement paths in response to said knitting cylinder rotation, each of said discrete vertical paths being symmetric about each of said pair of adjacent yarn feed locations and each of said discrete vertical paths also is symmetric with respect to said midlocation halfway between said pair of adjacent yarn feed locations independent of the direction of circumferential displacement thereof effected by said knitting cylinder rotation.

11. In the circular weft knitting of articles as set forth in claim 10, the further step of effecting the selection of the desired discrete displacement paths for said needle member and for said closing element in accord with preprogrammed instructions.

12. In the circular weft knitting of articles as set forth in claim 10, the step of effecting the selection of the desired discrete displacement paths for said needle and closing elements as the latter are displaced past said midlocation between adjacent yarn feed stations by said knitting cylinder rotation.

13. In the circular weft knitting of articles as set forth in claim 7, the step of concurrently displacing a yarn engaging sinker element associated with said needle member in a composite vertical and radial displacement path in response to knitting cylinder rotation that is symmetric about each of said pair of adjacent yarn feed locations and that is also symmetric about the midlocation halfway between said pair of adjacent yarn feed locations independent of the direction of circumferential displacement thereof effected by said knitting cylinder rotation.

14. In the circular weft knitting of articles through controlled displacement of a hooked compound needle element and an independently displaceable closing element associated therewith in a rotatably displaceable knitting cylinder, the steps of selectively introducing a portion of said hooked compound needle element at a predetermined location into one of a plurality of available discrete closed continuous cam tracks each of which is of symmetric configuration about each of an adjacent pair of yarn feed locations and each of which is also symmetric with respect to the midlocation halfway between said adjacent pair of yarn feed locations to control the path of vertical displacement of said needle element in accord with its degree of circumferential displacement as occasioned by knitting cylinder rotation and independent of the direction of the latter and independently selectively introducing a portion of said closing element into one of a plurality of available discrete closed continuous cam tracks each of which is of symmetric configuration about each of said adjacent pair of yarn feed locations and each of which is also symmetric with respect to the midlocation halfway between said adjacent pair of yarn feed locations to control the path of vertical displacement of said closing element in accord with its degree of circumferential displacement as occasioned by knitting cylinder rotation and independent of the direction of the latter, whereby said compound needle member as constituted by said needle and closing element is adapted to knit, tuck or float with respect to available yarn at each yarn feed location and to draw and clear stitches independent of the direction of approach thereof.

15. The method as set forth in claim 14 wherein the step of selective introduction of said portions of said hooked needle elements and said portions of said closing elements into operative engagement with its selected control cam track is effected in response to remotely generated preprogrammed electrical signals.

* * * * *